US005817449A

United States Patent [19]

Nakamura

[11] Patent Number: 5,817,449

[45] Date of Patent: Oct. 6, 1998

[54] METHOD FOR FORMING A COLOR IMAGE

[75] Inventor: Koichi Nakamura, Minami-ashigara, Japan

[73] Assignee: Fuji Photo Film Co., Ltd., Kanagawa-Ken, Japan

[21] Appl. No.: 911,436

[22] Filed: Aug. 12, 1997

[30] Foreign Application Priority Data

Aug. 12, 1996 [JP] Japan ..... 8-227381

[51] Int. Cl.[6] ..... G03C 7/44

[52] U.S. Cl. ..... 430/399; 430/398; 430/448; 430/566

[58] Field of Search ..... 430/398, 399, 430/448, 566

[56] References Cited

U.S. PATENT DOCUMENTS

| | | | |
|---|---|---|---|
| 2,507,114 | 5/1950 | McQueen | 430/380 |
| 3,764,328 | 10/1973 | Birkeland | 430/543 |
| 4,060,418 | 11/1977 | Waxman et al. | 430/212 |
| 5,250,397 | 10/1993 | Kamada et al. | 430/399 |
| 5,667,945 | 9/1997 | Takeuchi et al. | 430/380 |

FOREIGN PATENT DOCUMENTS

| | | |
|---|---|---|
| 05 45491A1 | 9/1993 | European Pat. Off. . |
| 05 65165A1 | 10/1993 | European Pat. Off. . |
| A 33-192031 | 11/1958 | Japan . |
| A 566235 | 1/1981 | Japan . |
| A 8227131 | 9/1996 | Japan . |
| A 8234388 | 9/1996 | Japan . |
| A 8286340 | 11/1996 | Japan . |

*Primary Examiner*—Hoa Van Le
*Attorney, Agent, or Firm*—Birch, Stewart Kolasch & Birch, LLP

[57] ABSTRACT

There is disclosed a method for forming a color image comprising exposing a silver halide light-sensitive material comprising at least one light-sensitive silver halide emulsion layer on a base, to light, and then development-processing the light-sensitive material, to form a color image, wherein the step of development-processing the light-sensitive material that contains a dye-forming coupler, a color-forming reducing agent of formula (D-1), and an auxiliary developing agent, with an alkaline activator solution of pH 9 to 14 substantially free from any color-developing agent, comprises the step of adsorbing anionic organic substances dissolved out into the activator solution, to remove the substances:

$(L)_n$—D formula (D-1)

wherein, L is an electron-attracting group capable of coupling split-off during the development processing, D is a residue formed by removing n hydrogen atoms from a compound HnD having a development activity, and n is an integer of 1 to 3. According to the method, processing stability with an activator solution is remarkably improved.

19 Claims, 2 Drawing Sheets

METHOD FOR FORMING A COLOR IMAGE

FIELD OF THE INVENTION

The present invention relates to a method for forming an image for a silver halide color photographic light-sensitive material containing a light-sensitive silver halide emulsion, a dye-forming coupler, a color-forming reducing agent, and an auxiliary developing agent or its precursor. The present invention also relates to a method for forming an image wherein the image can be formed by processing a silver halide color photographic light-sensitive material only with an alkali bath.

Further, the present invention relates to a method for forming an image with good processing stability that is little influenced by fatigue of the processing solution due to its the environment, for example, air, and that gives excellent photographic properties even when continuous processing is carried out.

BACKGROUND OF THE INVENTION

Generally, silver halide color photographic light-sensitive materials are processed through a color-development step and a desilvering step, to form an image. In the color-development step, silver halide grains that have been exposed to light are subjected to development (reduction) with an aromatic primary amine developing agent, and the subsequent reaction of its oxidation product with a coupler, gives a color-developed image.

For example, in color-print-paper processing, a silver halide color photographic light-sensitive material is subjected to development with an alkali bath containing 4-amino-N-ethyl-N-(β-methanesulfonamidoethyl)-aniline sulfate as an aromatic primary amine developing agent.

When the above conventional color-developing agent or the like is contained in an alkaline solution, it is oxidized by air to be conspicuously deteriorated. Therefore, a large amount of preservative and a large amount of replenishing solution are used, to retain the solution composition and the photographic properties.

In recent years, in the photographic processing industry, it is desired to lower the loading on the environment as well as the amount of waste, or recycling-use of waste, and reduction of the processing chemicals of the above color developer and greatly reduced-rate replenishment are being positively pursued.

However, to retain photographic properties in both continuous processing and intermittent processing, as well as to lower the replenishment rate, it is further required to increase the concentrations of processing chemicals in the replenishing solution. Therefore, under the present conditions, reduction of the processing chemicals in number of their kinds and amounts to be used, has not yet been attained. Further, when low-rate replenishment is carried out, there arises a problem that stain or fluctuation of photographic properties due to accumulated components, conspicuously increases.

As a proposed effective means of reducing the processing chemicals and attaining a low replenishment rate, it is suggested to build a color-developing agent or its precursor in a light-sensitive material and to process the light-sensitive material with an alkaline solution free from any color-developing agent (hereinafter referred to as an activator solution), which is described, for example, in U.S. Pat. Nos. 2,507,114, 3,764,328, and 4,060,418, and JP-A-56-6235 ("JP-A" means unexamined published Japanese patent application) and 58-192031. However, these aromatic primary amine developing agents and their precursors used therein are unstable, and they have the defect that stain is formed when the unprocessed light-sensitive material is stored for a long period, or when the light-sensitive material is color-developed.

In addition to the foregoing color-developing processes, a process described, for example, in EP-A-0 545 491 (A1) and 0 565 165 (A1) is known, wherein a sulfonylhydrazine-type compound and a coupler are built in a light-sensitive layer, and upon a coupling reaction at the time of development, an image is formed.

However, when a light-sensitive material having a color-forming reducing agent built in, such as the above silver halide light-sensitive material containing a hydrazine compound for color formation and a coupler, is continuously subjected to development with an activator solution, there arises a problem that the fluctuation of photographic properties is increased, i.e. the image density is lowered, fogging is increased, or the gradation is made soft. In particular, it becomes to be known that when an auxiliary developing agent is built in to accelerate the formation of an image, the foregoing fluctuation is conspicuously increased.

SUMMARY OF THE INVENTION

Thus, when a color photographic light-sensitive material having a color-forming reducing agent used therein, is continuously processed with an activator solution substantially free from any color-developing agent, the processing fluctuation of the photographic properties is large.

Therefore, an object of the present invention is to provide a method of forming an image by using a silver halide color photographic light-sensitive material, wherein the silver halide color photographic light-sensitive material can be subjected to development with an activator solution, and the long-term preservation is good in the light-sensitive material.

Further, another object of the present invention is to provide a method for forming an image by using a silver halide color photographic light-sensitive material improved further in processing stability in continuous processing with an activator solution.

Other and further objects, features, and advantages of the invention will appear more fully from the following description, taken in connection with the accompanying drawings.

In the present invention, "continuous processing" means that the processing is carried out with replenishment of a replenishing solution.

BRIEF DESCRIPTION OF THE DRAWINGS

FIG. 1 shows examples of processing apparatuses preferable for carrying out the processing process of the present invention.

FIG. 2 shows an enlarged cross section of a shutter means placed between the rinsing tanks.

DETAILED DESCRIPTION OF THE INVENTION

Figure 1A:
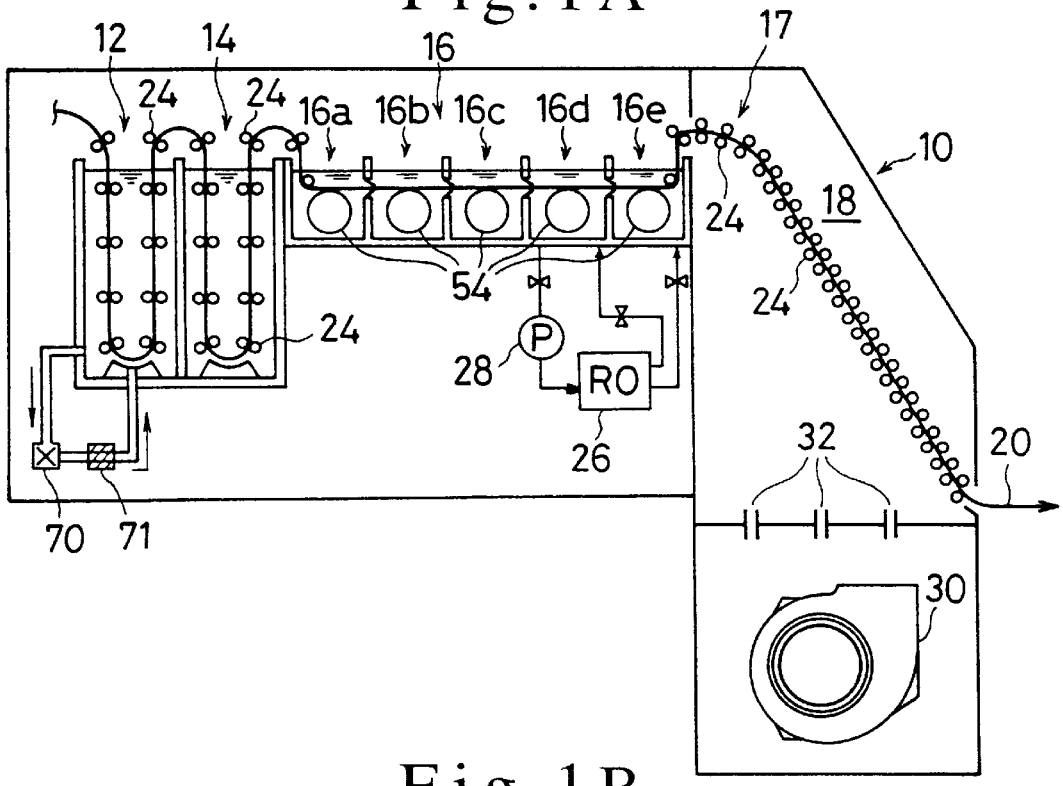
FIG. 1A is a schematic view showing an example wherein rinsing tanks of a washing tank are horizontally arranged.

In light of the above problems, the inventor of the present invention has studied intensively and has found that the above objects can be attained by the following means.

That is, the present invention provides:

(1) A method for forming a color image comprising the steps of exposing a silver halide light-sensitive material that comprises at least one light-sensitive silver halide emulsion layer on a base, to light, and then development-processing the said silver halide light-sensitive material, to form a color image, wherein the step of development-processing the said silver halide light-sensitive material that contains at least one dye-forming coupler, and at least one color-forming reducing agent represented by the following formula (D-1), and an auxiliary developing agent and/or its precursor, with an alkaline activator solution substantially free from any color-developing agent, comprises the step of adsorbing anionic organic substances dissolved out into the said activator solution, to remove the substances:

$$(L)_n—D \qquad \text{formula (D-1)}$$

wherein, in formula (D-1), L represents an electron-attracting group capable of coupling split-off during the development processing, D represents a compound residue formed by removing n hydrogen atoms from a compound HnD having a development activity, and n is an integer of 1 to 3;

(2) The method for forming a color image as stated in the above (1), wherein the compound represented by formula (D-1) is a compound represented by the following formula (I):

$$R^{11}—NHNH—X—R^{12} \qquad \text{formula (I)}$$

wherein, in formula (I), $R^{11}$ represents an aryl group or a heterocyclic group, $R^{12}$ represents an alkyl group, an alkenyl group, an alkynyl group, an aryl group, or a heterocyclic group, and X represents $—SO_2—$, —CO—, —COCO—, —CO—O—, —CO—$N(R^{13})$—, —COCO—O—, —COCO—N—$(R^{13})$—, or $—SO_2—N(R^{13})—$, in which $R^{13}$ represents a hydrogen atom or a group represented by $R^{12}$ that is mentioned above; and (3) The method for forming a color image as stated in the above (1) or (2), wherein the said step of adsorbing anionic organic substances to remove is carried out using an anion exchange resin or an anion exchange membrane.

Further, the objects of the present invention can be preferably attained by the following methods:

(4) The method for forming a color image as stated in the above (2), wherein the compound represented by formula (I) is represented by formula (II) or formula (III):

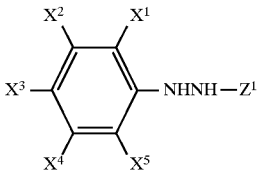

formula (II)

$$R^3—NHNH—Z^2 \qquad \text{formula (III)}$$

wherein, in formulae (II) and (III), $Z^1$ represents an acyl group, a carbamoyl group, an alkoxycarbonyl group, or an aryloxycarbonyl group; $Z^2$ represents a carbamoyl group, an alkoxycarbonyl group, or an aryloxycarbonyl group; $X^1$, $X^2$, $X^3$, $X^4$, and $X^5$ each represent a hydrogen atom or a substituent, provided that the sum of the Hammett substituent constant up values of $X^1$, $X^3$, and $X^5$ and the Hammett substituent constant σm values of $X^2$ and $X^4$ is 0.80 or more but 3.80 or below; and $R^3$ represents a heterocyclic group.

(5) The method for forming a color image as stated in the above (4), wherein the compound represented by formula (II) or formula (III) is represented by formula (IV) or formula (V), respectively.

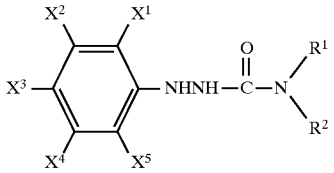

formula (IV)

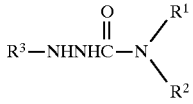

formula (V)

wherein, in formulae (IV) and (V), $R^1$ and $R^2$ each represent a hydrogen atom or a substituent; $X^1$, $x^2$, $X^3$, $X^4$, and $X^5$ each represent a hydrogen atom or a substituent, provided that the sum of the Hammett substituent constant σp values of $X^1$, $X^3$, and $X^5$ and the Hammett substituent constant σm values of $X^2$ and $X^4$ is 0.80 or more but 3.80 or below; and $R^3$ represents a heterocyclic group.

(6) The method for forming a color image as stated in the above (5), wherein the compound represented by formula (IV) or formula (V) is represented by formula (VI) or formula (VII), respectively.

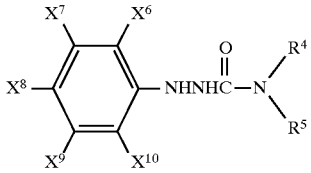

formula (VI)

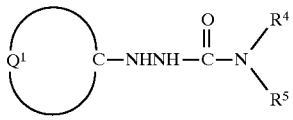

formula (VII)

wherein, in formulae (VI) and (VII), $R^4$ and $R^5$ each represent a hydrogen atom or a substituent; $X^6$, $X^7$, $X^8$, $X^9$, and $X^{10}$ each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, provided that the sum of the Hammett substituent constant σp values of $X^6$, $X^8$, and $X^{10}$ and the Hammett substituent constant σm values of $X^7$ and $X^9$ is 1.20 or more but 3.80 or below; and $Q^1$ represents a group of nonmetal atoms required to form, together with the C, a nitrogen-containing 5-membered to 8-membered heterocyclic ring.

(7) The method for forming a color image as stated in the above (1), (2), (3), (4), or (5), wherein the said step of adsorbing anionic organic substances to remove is carried out using a porous adsorbent or an adsorbent having a large surface area (e.g. activated carbon, activated carbon fiber, silica gel, activated alumina, and activated clay).

(8) The method for forming a color image as stated in the above (1), (2), (3), (4), (5), (6), or (7), wherein the exposure to light is carried out by scanning exposure with the exposure time being $10^{-8}$ to $10^{-4}$ sec per picture element.

In the present invention, the term "activator process" means a process wherein a color-forming reducing agent is built in a light-sensitive material and the light-sensitive material is subjected to a development process with a processing solution substantially free from any color-developing agent. In the present invention, "the activator solution" is a high-pH aqueous solution capable of causing development, and it is characterized by being substantially free from any color-forming reducing agent as mentioned above and any p-phenylenediamine-series color-developing agent as conventionally used, and it may contain other components (e.g. buffers, halogens, and chelating agents). As buffer, examples are carbonates, phosphates, hydroxybenzoates as described below. To retain the processing stability, preferably a reducing agent is not contained in the activator solution in some cases, and preferably it is substantially free from auxiliary developing agents, hydroxylamines, sulfites, and the like in the same viewpoint.

Herein, the term "substantially free from" means that in each case the content is preferably 0.5 mmol/liter or less, more preferably 0.1 mmol/liter or less, and particularly preferably zero (not contained at all).

The pH of the alkaline solution (aqueous solution) used in the present invention is preferably 9 to 14, and particularly preferably 10 to 13.

Now, the specific constitution of the present invention is described in detail below.

The image obtained by using the color-forming reducing agent and the coupler for use in the present invention exhibits high color density and low minimum density, and it is excellent in rapid activator development processibility. However, with respect to the image obtained by using the color-forming reducing agent and the coupler for use in the present invention, along with the progress of continuous processing, processing unevenness appears, resulting in an increase in fogging and a decrease in the maximum density, or softening of the gradation. When anionic organic substances are removed (eliminated) from the activator solution with an adsorbent at the time of processing and processing is carried out, the processing unevenness is suppressed and an image can be obtained stably with the above fogging and the above decrease in the maximum density suppressed remarkably. Further, when the color-forming reducing agents represented by formula (II) or (III), and particularly the color-forming reducing agents represented by formula (IV) or (V), are used, an image excellent in processing stability can be obtained. Generally, when anionic compounds are removed from a developing solution, accumulated halide ions, other organic antifoggants, preservatives, etc., are also removed. Therefore, fogging is inclined to increase. However, unexpectedly it has been revealed that, in the present invention, fogging is suppressed and an image with a less-fluctuated gradation is obtained.

To remove the color-developing agent from a waste liquor, such as a color-developing solution, the use of adsorbents is known. For example, U.S. Pat. No. 4,606,827 describes the use of a cation exchange resin to remove a paraphenylenediamine-series color-developing agent selectively, GB-A-2 054 182 describes the use of an ion exchange resin to remove deteriorated products of a developing agent in a fixing solution from which dissolved silver has been eliminated electrolytically, and WO-A91/17479 describes the use of activated carbon or an ion exchange resin to eliminate a developing agent carried into an intensifier from a previous bath.

However these patents do not describe the problems of processing, the action, or the effect when an activator solution substantially free from any color-developing agent is used, as in the present invention, nor do they teach the present invention.

For example, the step of removing anionic organic substances from an activator solution with an adsorbent is provided in a part of a solution circulating system in an apparatus in an activator development step. Alternatively, the step of removing is carried out in such a way that an activator solution is stored in a separate tank other than the original tank holding the activator solution, anionic organic substances are removed from the activator solution stored in the said separate tank, and then the activator solution is again returned to be used.

Preferably, in view of minimizing the apparatus or ease of handling, the removing step is carried out in the said solution circulating system of the activator development step.

Examples of the anionic organic substances referred to in the present invention include dyes and their decomposed products, products separated from couplers, auxiliary developing agents, photographic stabilizers. Particularly it seems that the nonretention of auxiliary developing agents in the activator solution gives preferable results.

Now, the color-forming reducing agent used in the present invention is described. Generally a developing agent used in a silver halide color photographic light-sensitive material reduces silver halides imagewise directly or through another electron transferring agent, to produce the oxidized developing agent, in proportion to the exposure amount. The oxidized developing agent further reacts with a coupler, to form a dye. Generally, in this color photographic system, a p-phenylenediamine-series developing agent is contained in a developing solution, and the developing agent permeates the light-sensitive material in the development process, so that the development progresses. That is, the developing agent high in reactivity (since the developing agent is a reducing agent, it is susceptible to air oxidation, to be decomposed), is supplied in the developing process in a fresh form all the time.

Therefore, the color-developing agent (color-forming reducing agent) that is contained in a light-sensitive material, is required to have such a seemingly incompatible feature that the preservation stability before and after the developing process is excellent and a high development activity is exhibited in the developing process. Accordingly, to use a p-phenylenediamine-series developing agent as it is, which is generally used in the processing of photographic light-sensitive materials, is impossible (because of the preservation stability). On the other hand, a p-phenylenediamine-series developing agent that is designed to increase the oxidation potential for the purpose of satisfying the preservation stability, cannot exhibit a satisfactory development activity during the processing. As one proposed means of solving this problem, there is a means of using, as a color-forming reducing agent, a compound having a development activity into which a group capable of coupling split-off during the color developing process has been introduced. This color-forming reducing agent can be represented by the following formula (D-1):

$$(L)_n—D \qquad \text{formula (D-1)}$$

In formula (D-1), L represents an electron-attracting group capable of coupling split-off during the development processing, D represents a compound residue formed by removing n hydrogen atoms from a compound HnD having a development activity, and n is an integer of 1 to 3.

The color-forming reducing agent represented by formula (D-1) preferably has a structure represented by the following formula (D-2):

$$L^1L^2N—(NH)_p—(X{=}Y)_q—Z \qquad \text{formula (D-2)}$$

In formula (D-2), $L^1$ and $L^2$ each represent a hydrogen atom or a monovalent electron-attracting group capable of coupling split-off during the color-development processing, with the proviso that $L^1$ and $L^2$ are not hydrogen atoms respectively simultaneously; X and Y each independently represent methine or azomethine; Z represents a hydrogen atom, a hydroxyl group, an amino group, or —$NHL^3$, in which $L^3$ represents an electron attracting group; p is an integer of 0 or 1, q is an integer of 1 to 3, and any two of $L^1$, $L^2$, X, Y, and Z may bond together to form a ring.

Preferable color-forming reducing agents represented by formula (D-2) are described in detail below. In formula (D-2), as the electron-attracting group represented by $L^1$ and $L^2$, an acyl group, a sulfinyl group, a sulfonyl group, and a phosphoryl group are preferable, with particular preference given to an acyl group and a sulfonyl group. Although $L^1$ and $L^2$ are released in the color-developing process, they may be released after or before the developing agent represented by formula (D-2) is oxidized. However, because it is preferable that the development does not progress in an unexposed part (suppression of fogging), and in order to prevent the development active species produced in the development processing from remaining unreacted in the light-sensitive material and causing colored matters (to suppress staining), preferably the developing agent used in the present invention causes development of a silver halide imagewise under basic condition, and the resulting oxidation product of the developing agent couples with a coupler to release $L^1$ and $L^2$, to form a dye. $L^1$ and $L^2$ may be released in the form of anions or radicals and may be released by the action of a nucleophilic species or a base (e.g. water, a hydroxide ion, hydrogen peroxide, a sulfite ion, and hydroxylamine) in the developing solution. Particularly in the latter case, by adding a nucleophilic species positively to the developing solution, the release of $L^1$ or $L^2$ can be accelerated, or when a compound for accelerating silver development (particularly preferably hydrogen peroxide) is added, the nucleophilicity thereof can be used to accelerate the release of $L^1$ or $L^2$.

In formula (D-2), $(X{=}Y)_q$ represents a π electron conjugated system with carbon atoms or nitrogen atoms, particularly preferably X and Y bond together to form a ring, preferably q is 2 or 3, and preferably the number of nitrogen atoms contained is 0 to 3. When $(X{=}Y)_q$ forms a ring, preferably the number of ring members is 5 or 6; as a constitutional atom of the ring, a hetero atom may be contained, and preferably the hetero atom is a nitrogen atom, an oxygen atom, or a sulfur atom, and particularly preferably a nitrogen atom. Further, $(X{=}Y)_q$ may have a condensed ring, and as the condensed ring, a benzene ring is preferable.

When p is 0, X bonded to $L^1L^2N$ can be either a carbon atom or a nitrogen atom, and when p is 1, X bonded to NH is preferably a carbon atom.

In formula (D-2), when p is 0, Z is preferably a hydroxyl group, an amino group, or $NHL^3$, and when p is 1, Z is preferably a hydrogen atom or $NHL^3$. When Z is represented by $NHL^3$, $L^3$ is preferably an acyl group, a sulfinyl group, a sulfonyl group, or a phosphoryl, and particularly preferably an acyl group or a sulfonyl group.

The color-forming reducing agent represented by formula (D-2) is preferably introduced into the light-sensitive material by a method in which the color-forming reducing agent is dissolved in a high-boiling organic solvent, and then it is dispersed and is applied, that is the so-called oil-protect system. Therefore preferably the developing agent has a relatively large lipophilic group, generally called a ballast group, so that it can be easily dissolved in a high-boiling organic solvent and can be retained stably in the light-sensitive material. Thus, preferably this ballast group has one or more straight-chain or branched somewhat large alkyl groups, and preferably the total number of carbon atoms of these alkyl groups is 3 to 32, more preferably 6 to 22, and particularly preferably 8 to 18. The substitution position of the ballasting group may be on any of $L^1$, $L^2$, (X=Y), and Z, with preference given to $L^1$ or $L^2$.

The color-forming reducing agent represented by formula (D-2) may be substituted, so as to give a preferable pKa (acid dissociation constant) corresponding to the pH of the development processing solution to be used, and in order to adjust the absorption wavelength of the dye to be formed, the release speed of $L^1$ or $L^2$, the speed of coupling with a coupler, or the oxidation potential to the intended range. Examples of the substituent can be mentioned a halogen atom, a cyano group, a nitro group, an amino group, a carboxyl group, a sulfo group, an acyl group, an acylamino group, a carbamoyl group, a sulfonyl group, a sulfonylamino group, a sulfamoyl group, an alkyl group, an aryl group, an alkoxy group, a heterocyclic group, and an aryloxy group.

Out of the color-forming reducing agents represented by formula (D-2), particularly preferable ones are developing agents represented by one of the following formulas (D-3) to (D-10):

$$R^1SO_2NH—\phi^1—NR^2R^3 \qquad \text{Formula (D-3)}$$

$$R^4SO_2NH—\phi^2—OH \qquad \text{Formula (D-4)}$$

$$R^5CONH—\phi^3—NR^6R^7 \qquad \text{Formula (D-5)}$$

$$R^8CONH—\phi^4—OH \qquad \text{Formula (D-6)}$$

$$R^9SO_2NHNHR^{10} \qquad \text{Formula (D-7)}$$

$$R^{11}CONHNHR^{12} \qquad \text{Formula (D-8)}$$

$$R^{13}SO_2NHN{=}\phi^5 \qquad \text{Formula (D-9)}$$

$$R^{14}CONHNH{=}\phi^6 \qquad \text{Formula (D-10)}$$

In formulas (D-3) to (D-10), $R^2$, $R^3$, $R^6$, and $R^7$ each represent an alkyl group, an aryl group, or a heterocyclic group, $R^{10}$ and $R^{12}$ each represent an aryl group or a heteroaryl group, $R^1$, $R^4$, $R^5$, $R^8$, $R^9$, $R^{11}$, $R^{13}$, and $R^{14}$ each represent a hydrogen atom, an alkyl group, an aryl group, a heterocyclic group, an alkoxy group, an aryloxy group, or an amino group, $\phi^1$ to $\phi^4$ each represent an arylene group or a heteroarylene group, $\phi^5$ and $\phi^6$ each represent a heterocyclic group or hydrocarbon ring group bonded to the nitrogen atom through a double bond.

In formulas (D-3) to (D-10), the alkyl group represented by $R^1$ to $R^{14}$ is preferably a straight-chain or branched, chain or cyclic alkyl group having 1 to 30 carbon atoms, and particularly preferable is a straight-chain or branched alkyl group having 1 to 22 carbon atoms, such as a methyl group, an ethyl group, an isopropyl group, an n-butyl group, a 2-ethylhexyl group, an n-dodecyl group, a t-octyl group, an n-tetradecyl group, an n-hexadecyl group, and an n-octadecyl group.

In formulas (D-3) to (D-10), the aryl group represented by $R^1$ to $R^{14}$ is preferably an aryl group having 6 to 20 carbon atoms, and more preferably 6 to 10 carbon atoms, such as a phenyl group, a naphthyl group, and an anthracenyl group, with particular preference given to a phenyl group.

In formulas (D-3) to (D-10), the heterocyclic group represented by $R^1$ to $R^{14}$ is preferably a 5- to 7-membered heterocyclic group, preferably having 1 to 10 carbon atoms, whose hetero atoms are preferably nitrogen atoms, oxygen atoms, and sulfur atoms, and particularly preferably a nitrogen-containing 5- or 6-membered heterocyclic ring, such as a 2-imidazolyl group, a 1,3oxazol-2-yl group, a 1,3-thiazol-2-yl group, a 5-tetrazolyl group, a 3-indolinyl group, a 1,3,4-thiadiazol-2-yl group, a 1,2,4-thiadiazol-5-yl group, a 1,3-benzoxazol-2-yl group, a 1,3-benzothiazol-2-yl group, a 1,3-benzimidazol-2-yl group, a 1,2,4-triazol-3-yl group, a 3-pyrazolyl group, a 2-pyridyl group, a 3-pyridyl group, a 4-pyridyl group, a 2-pyrimidyl group, a 4-pyrimidyl group, a 1,3,5-triazin-2-yl group, a 1,2,4-triazin-3-yl group, a 4-quinazolyl group, and a 2-quinoxalyl group. These rings may have a condensed ring, and a preferable condensed ring is a benzene ring.

In formulas (D-3) to (D-10), the alkoxy group represented by $R^1$, $R^4$, $R^5$, $R^8$, $R^9$, $R^{11}$,$R^{13}$, and $R^{14}$ is preferably a straight-chain or branched, chain or cyclic alkoxy group having 1 to 30 carbon atoms, and more preferably a straight-chain or branched alkoxy group having 1 to 22 carbon atoms, such as a methoxy group, an ethoxy group, an isopropoxy group, an n-butoxy group, a 2-ethylhexyloxy group, an n-dodecyloxy group, an n-tetradecyloxy group, an n-hexadecyloxy group, and an n-octadecyloxy group.

In formulas (D-3) to (D-10), the aryloxy group represented by $R^1$, $R^4$, $R^5$, $R^8$, $R^9$, $R^{11}$ $R^{13}$, and $R^{14}$ is preferably an aryloxy group having 6 to 20 carbon atoms, and more preferably 6 to 10 carbon atoms, such as a phenoxy group, a naphthoxy group, and an anthracenoxy group, with particular preference given to a phenoxy group.

In formulas (D-3) to (D-10), the amino group represented by $R^1$, $R^4$, $R^5$, $R^8$, $R^9$, $R^{11}$, $R^{13}$, and $R^{14}$ is preferably an alkylamino group, a dialkylamino group, an arylamino group, a diarylamino group, a heteroarylamino group, a diheteroarylamino group, an alkylarylamino group, an alkylheteroamino group, or an arylheteroarylamino group, each of which group has 2 to 40 carbon atoms, and more preferably an alkylamino group, a dialkylamino group, or an arylamino group, each of which group has 1 to 20 carbon atoms, such as a methylamino group, an ethylamino group, a propylamino group, a diethylamino group, a di-n-octylamino group, a phenylamino group, a dodecylamino group, or a hexadecylamino group.

In formulas (D-3) to (D-10), the arylene group represented by $\phi^1$ to $\phi^4$ is preferably an arylene group having 6 to 20 carbon atoms, and more preferably 6 to 10 carbon atoms, such as a phenylene group, a naphthylene group, and an anthracenylene group, with particular preference given to a phenylene group. These may have a condensed ring, and a preferable condensed ring is a benzene ring.

In formulas (D-3) to (D-10), as the hetero atom constituting the heteroarylene group represented by $\phi^1$ to $\phi^4$, a nitrogen atom, an oxygen atom, and a sulfur atom are preferable, and the number of hetero atoms is preferably 1 to 4, more preferably 1 to 3, and particularly preferably 1 or 2. The number of carbon atoms is preferably 2 to 8, and more preferably 3 to 5, and the number of the ring members is preferably 5 or 6. The heteroarylene group may have a condensed ring, which is preferably a benzene ring. Examples of the heteroarylene group represented by $\phi^1$ to $\phi^4$ include the below-shown ones, with particular preference given to (HA-1), (HA-6), (HA-22), and (HA-23); $\phi^1$ to $\phi^4$ each represent a benzene ring, most preferably:

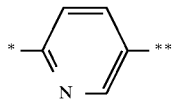

(HA-1)

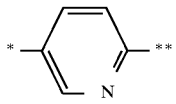

(HA-2)

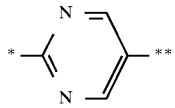

(HA-3)

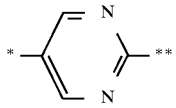

(HA-4)

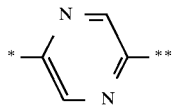

(HA-5)

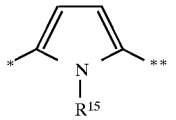

(HA-6)

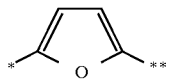

(HA-7)

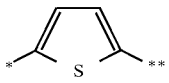

(HA-8)

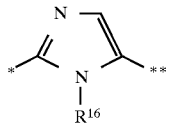

(HA-9)

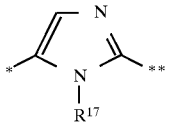

(HA-10)

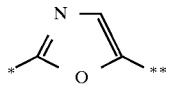

(HA-11)

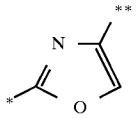

(HA-12)

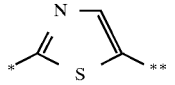

(HA-13)

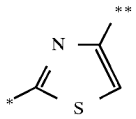

(HA-14)

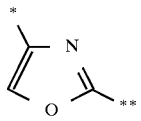

(HA-15)

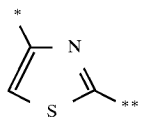

(HA-16)

-continued

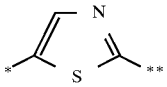

(HA-17)

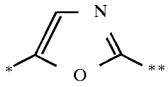

(HA-18)

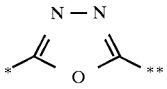

(HA-19)

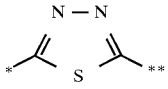

(HA-20)

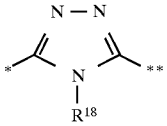

(HA-21)

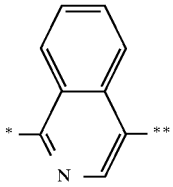

(HA-22)

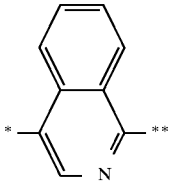

(HA-23)

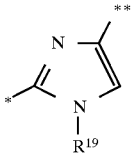

(HA-24)

In formulas (HA-1) to (HA-24), * represents the position where it is bonded to NH in formulas (D-3) to (D-6), ** represents the position where it is bonded to $NR^2R^3$, OH, or $NR^6R^7$, $R^{15}$ to $R^{19}$ each represent an alkyl group or an aryl group, which have the same meanings as those of the alkyl group and the aryl group represented by $R^1$ to $R^{14}$ in formulas (D-3) to (D-10).

"The hydrocarbon residue or the heterocyclic group bonded to the nitrogen atom through a double bond" represented by $\phi^5$ and $\phi^6$ in formulas (D-9) and (D-10) is preferably a 5- to 7-membered hydrocarbon ring group or heterocyclic group. The hetero atoms are preferably nitrogen atoms, oxygen atoms, and sulfur atoms, and the number of the contained hetero atoms is preferably 0 to 3, and more preferably 0 to 2, and the number of the carbon atoms is preferably 2 to 8, and more preferably 3 to 6, with particular preference given to a 5- or 6-membered nitrogen-containing unsaturated heterocyclic ring. In formulas (D-9) and (D-10), these hydrocarbon rings and heterocyclic rings each preferably form a double bond with $R^{13}SO_2NHN$ or $R^{14}CONHN$ at the carbon atom in the ring, and each may have a condensed ring, which is preferably a benzene ring. Examples of "the hydrocarbon ring group or the heterocyclic group bonded to the nitrogen atom through a double bond" represented by $\phi^5$ and $\phi^6$ are (CH-1) to (CH-19), with particular preference given to (CH-5), (CH-6), (CH-9), (CH-10), (CH-11), (CH-16), and (CH-18):

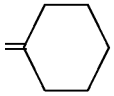

(CH-1)

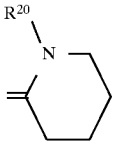

(CH-2)

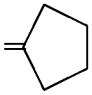

(CH-3)

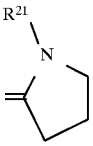

(CH-4)

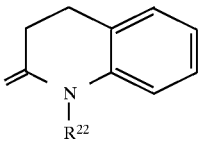

(CH-5)

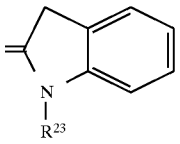

(CH-6)

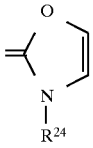

(CH-7)

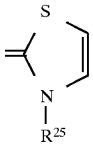

(CH-8)

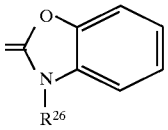

(CH-9)

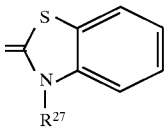

(CH-10)

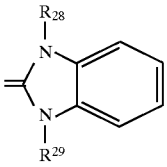

(CH-11)

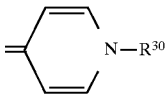

(CH-12)

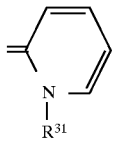

(CH-13)

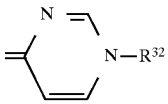

(CH-14)

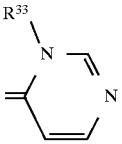

(CH-15)

-continued

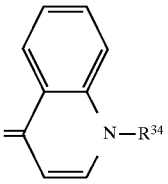

(CH-16)

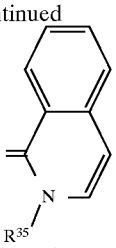

(CH-17)

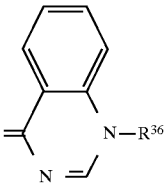

(CH-18)

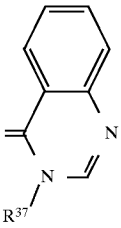

(CH-19)

In formulas (CH-1) to (CH-19), $R^{20}$ to $R^{37}$ each represent an alkyl group or an aryl group, which have the same meaning as those of the alkyl group and the aryl group represented by $R^1$ to $R^{14}$ in formulas (D-3) to (D-10).

In formulas (D-3) and (D-5), $R^2$ and $R^3$, $\phi^1$ and $R^2$, $\phi^1$ and $R^3$, $R^6$ and $R^7$, $\phi^3$ and $R^6$, and $\phi^3$ and $R^7$ may be bonded, respectively, to form a ring. In that case, the number of the ring members is preferably 5 or 6; the atoms constituting the ring may contain a hetero atom, and a preferable hetero atom is an oxygen atom.

A preferable range of the color-forming reducing agents represented by formulas (D-3) to (D-10) will be described in more detail.

In formulas (D-3) to (D-10), preferably $R^1$, $R^4$, $R^5$, $R^8$, $R^9$, $R^{11}$, $R^{13}$, and $R^{14}$ each represent an aryl group, a heteroaryl group, an alkoxy group, an aryloxy group, an amino group, or an anilino group. As the amino group and the anilino group, those having a hydrogen atom bonded on the nitrogen atom of these groups are particularly preferable.

$R^1$ and $R^4$ of formulas (D-3) and (D-4) preferably each represent an aryl group, an alkyl group, an amino group, or an anilino group, with particular preference given to an alkyl group and an aryl group. $R^5$ and $R^8$ of formula (D-5) and (D-6) preferably each represent an aryl group, an alkyl group, an amino group, or an anilino group, with particular preference given to an amino group and an anilino group.

Preferably $R^9$ of formula (D-7) represents an aryl group, an alkyl group, an amino group, or an anilino group, with particular preference given to an aryl group and an alkyl group. Preferably $R^{11}$ of formula (D-8) represents an aryl group, an alkyl group, an amino group, or an anilino group, with particular preference given to an amino group and an anilino group. Preferably $R^{13}$ of formula (D-9) represents an aryl group, an alkyl group, an amino group, or an anilino group, with particular preference given to an aryl group and an alkyl group. Preferably $R^{14}$ of formula (D-10) represents an aryl group, an alkyl group, an amino group, or an anilino group, with particular preference given to an amino group and an anilino group.

Of those represented by formulas (D-3) to (D-10), preferable ones are (D-3), (D-4), (D-6), (D-7), (D-8), (D-9), and (D-10), more preferable ones are (D-4), (D-6), (D-7), (D-8), and (D-10), further more preferable ones are (D-4) and (D-8), and the most preferable one is (D-8).

In formulas (D-7) and (D-8), $R^{10}$ and $R^{12}$ each represent an aryl group or a heteroaryl group. The aryl group is preferably an aryl group having 6 to 10 carbon atoms, which may have a condensed ring. As a preferable aryl group, a phenyl group can be mentioned, which preferably has at least one electron-attracting group. Herein, the term "electron-attracting group" means one having a positive value in terms of the Hammett sigma para-value ($\sigma p$ value). More preferably, the total of the $\sigma p$ values of all the substituents is 0.7 or more but 3.5 or less, further more preferably 1.2 or more but 3.0 or less, and most preferably 1.5 or more but 2.5 or less. Examples of preferable electron-attracting groups are a halogen atom (e.g. fluorine, chlorine, and bromine), an acyl group, a carbamoyl group, an alkoxycarbonyl group, a cyano group, a sulfonyl group, a sulfamoyl group, a nitrogen-containing heterocyclic group, a polyfluoroalkyl group, and a nitro group, and particularly preferably a halogen atom, a carbamoyl group, a sulfamoyl group, a sulfonyl group, a cyano group, a nitrogen-containing heterocyclic group, and a polyfluoroalkyl group. Preferably the heteroaryl group is a 5- or 6-membered heteroaryl group, which may have a condensed ring. As the hetero atom, a nitrogen atom, an oxygen atom, and a sulfur atom are preferable. If the heteroaryl group contains no nitrogen atom in the ring, preferably the heteroaryl group has at least two electron-attracting groups. More preferably the heteroaryl group contains at least one nitrogen atom and at least one electron-attracting group. Preferable examples of $R^{10}$ and $R^{12}$ are shown below. * represents the site where it is bonded to NH in the formulas.

$R^1$, $R^4$, $R^5$, $R^8$, $R^9$, $R^{10}$, $R^{11}$, $R^{12}$, $R^{13}$, and $R^{14}$ each may have a substituent, and preferable substituents are a halogen atom (e.g. fluorine, chlorine, and bromine), an alkyl group (having 1 to 22 carbon atoms), an acyl group (having 1 to 18 carbon atoms), a sulfonyl group (having 1 to 18 carbon atoms), an alkoxy group (having 1 to 22 carbon atoms), an aryloxy group (having 6 to 23 carbon atoms), an alkoxycarbonyl group (having 2 to 23 carbon atoms), an aryloxycarbonyl group (having 7 to 23 carbon atoms), a carbamoyl group (having 2 to 23 carbon atoms), a sulfamoyl group (having 0 to 22 carbon atoms), an acylamino group (having 1 to 22 carbon atoms), a sulfonylamino group (having 1 to 22 carbon atoms), an acyloxy group (having 1 to 22 carbon atoms), a carboxyl group, a sulfo group, an amino group (having 0 to 22 carbon atoms), a hydroxyl group, a cyano group, a polyfluoroalkyl group, and a nitro group.

Preferably $R^2$, $R^3$, $R^6$, and $R^7$ in formulas (D-3) to (D-5) each represent an alkyl group having 1 to 8 carbon atoms, whose substituent may preferably be a hydroxyl group, an alkoxy group (having 1 to 12 carbon atoms), an acylamino group (having 1 to 12 carbon atoms), a sulfonylamino group (having 1 to 12 carbon atoms), and a cyano group.

The specific examples of the color-forming reducing agent used in the present invention are shown below.

(1)
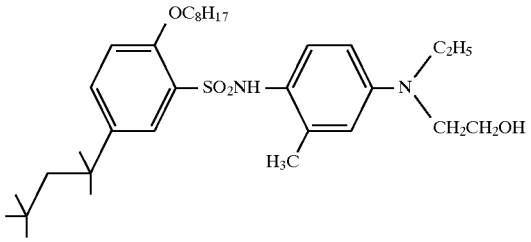
(2)
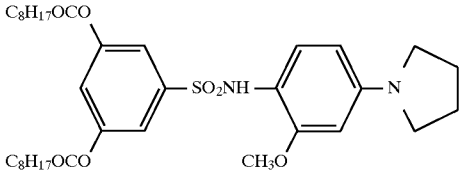
(3)
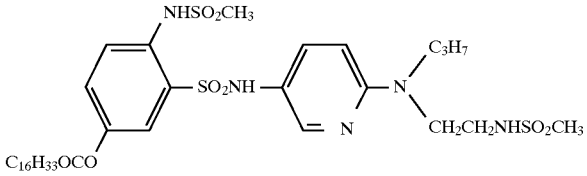
(4)
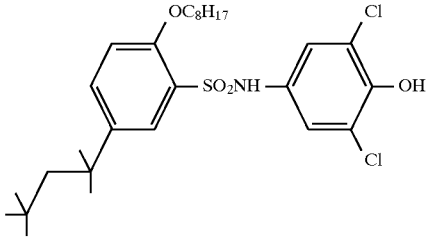
(5)
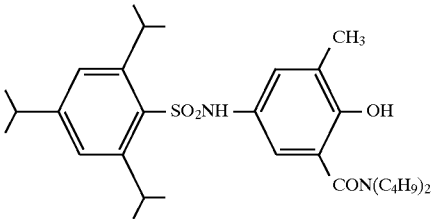
(6)
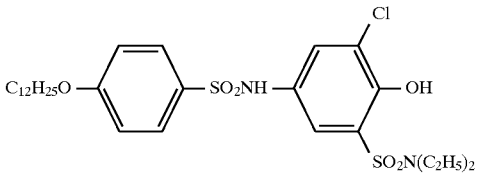
(7)
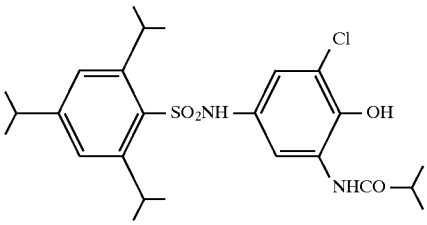

-continued
(8)
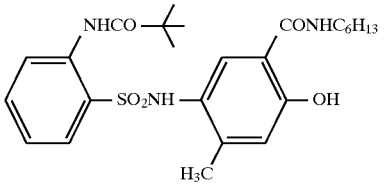
(9)
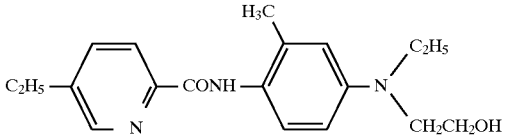
(10)
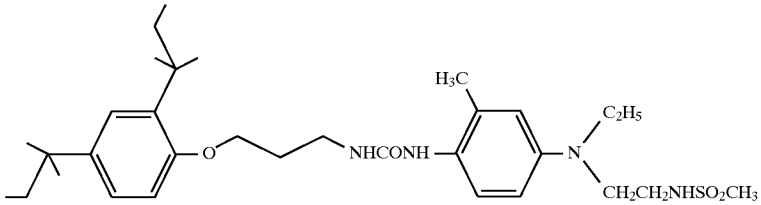
(11)
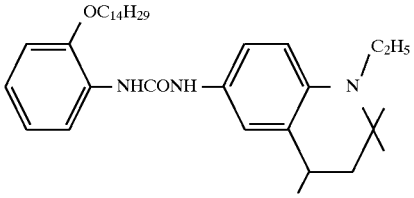
(12)
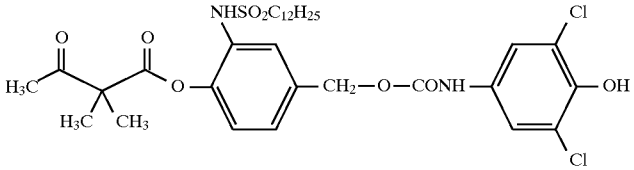
(13)
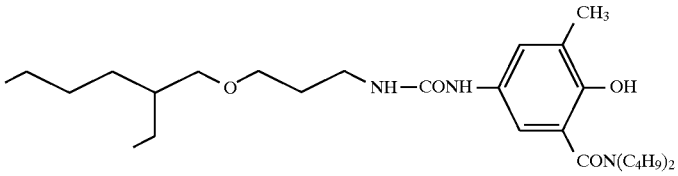
(14)
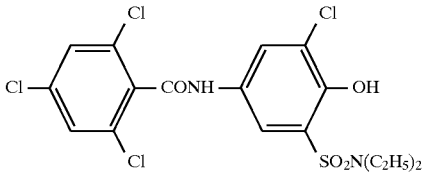
(15)
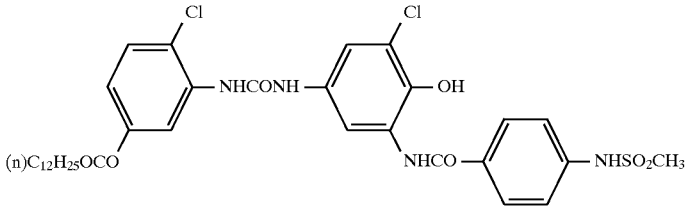

-continued
(16)
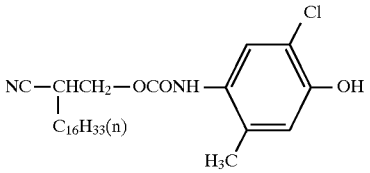
(17)
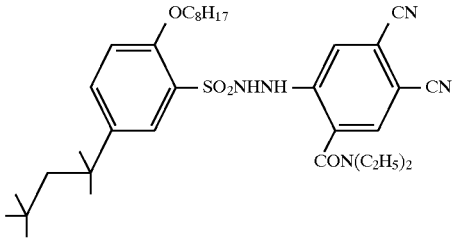
(18)
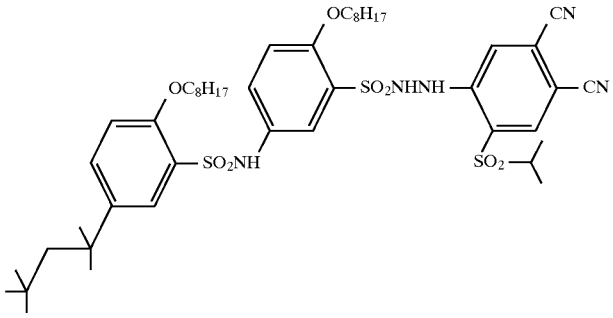
(19)
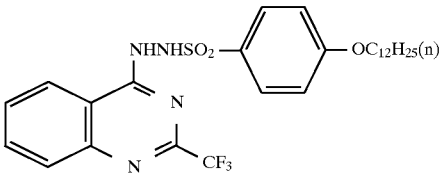
(20)
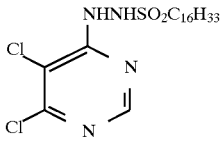
(21)
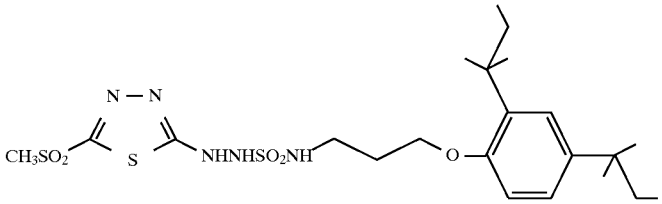

-continued
(22)
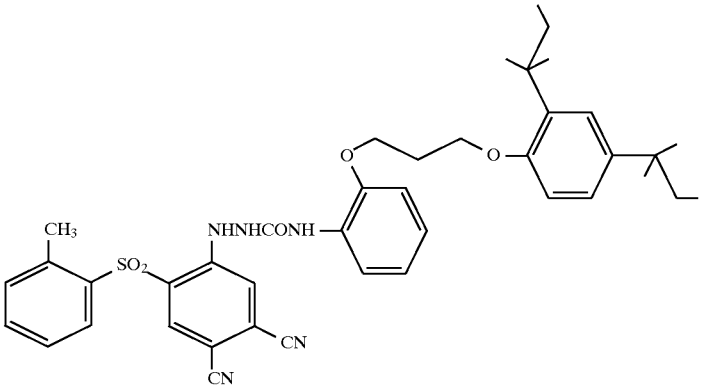
(23)
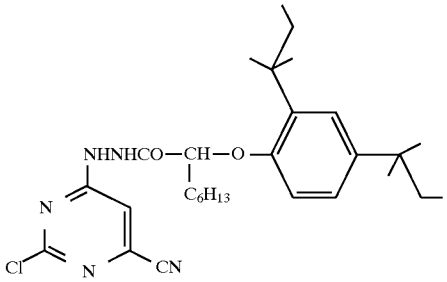
(24)
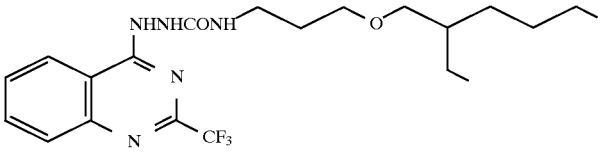
(25)
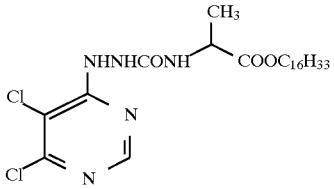
(26)
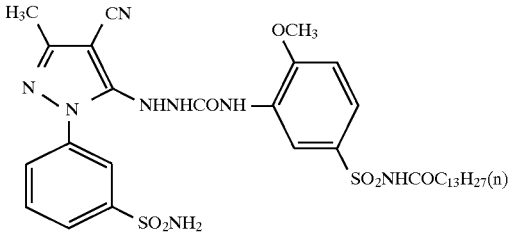
(27)
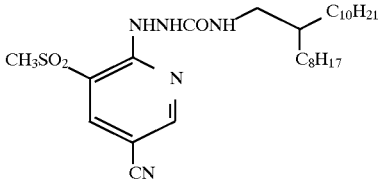

-continued
(28)
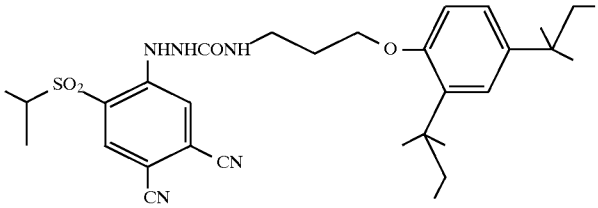
(29)
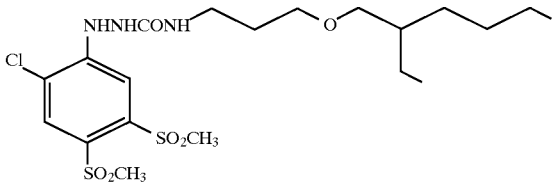
(30)
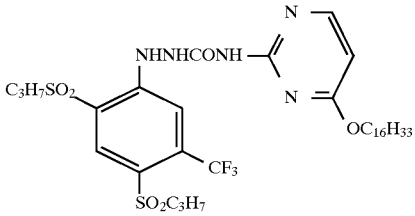
(31)
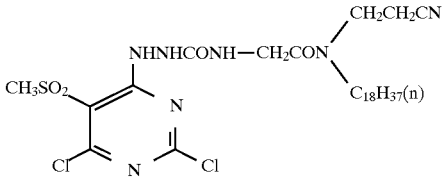
(32)
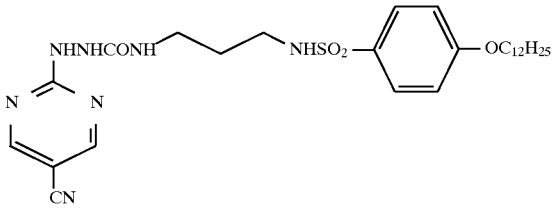
(33)
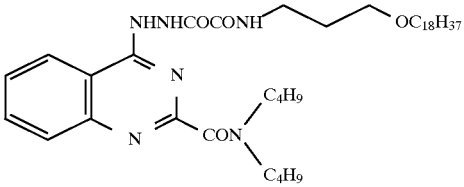
(34)
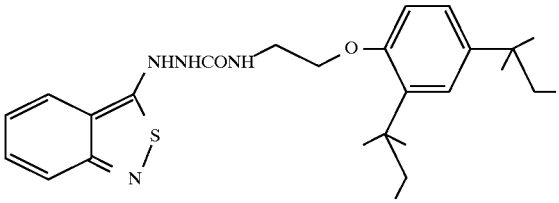
(35)
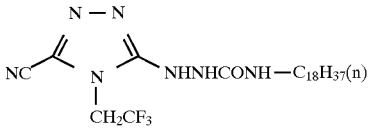

-continued

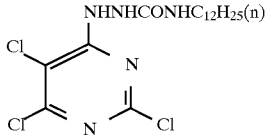

(36)

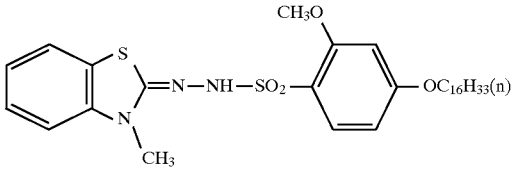

(37)

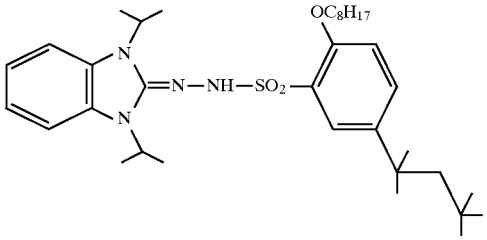

(38)

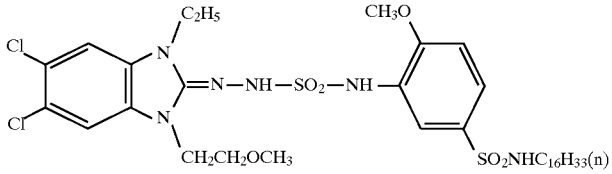

(39)

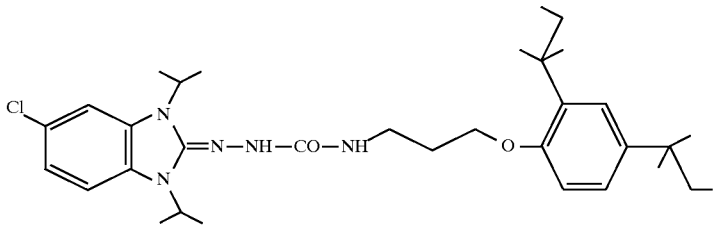

(40)

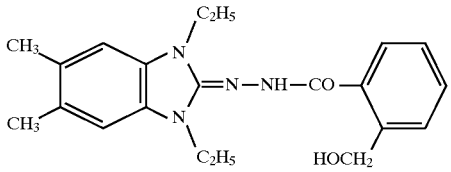

(41)

Now, among the color-forming reducing agents, more preferable compounds, which are represented by formula (I), are described in detail.

The color-forming reducing agent represented by formula (I) used in the present invention, is a compound characterized in that the compound undergoes, in an alkali solution, a reaction directly with an exposed silver halide and is oxidized, or an oxidation-reduction reaction with an auxiliary developing agent oxidized with an exposed silver halide and is oxidized. The compound is also characterized in that the resultant oxidation product further reacts with a dye-forming coupler, to form a dye.

The structure of the color-forming reducing agent represented by formula (I) is described in detail below.

In formula (I), $R^{11}$ represents an aryl group or heterocyclic group, which may be substituted. The aryl group represented by $R^{11}$ has preferably 6 to 14 carbon atoms, and examples are phenyl and naphthyl. The heterocyclic group represented by $R^{11}$ is preferably a saturated or unsaturated, 5-membered, 6-membered, or 7-membered heterocyclic ring containing at least one of nitrogen, oxygen, sulfur, and selenium, to which a benzene ring or a heterocyclic ring may be condensed. Examples of the heterocyclic ring represented by $R^{11}$ are furanyl, thienyl, oxazolyl, thiazolyl, imidazolyl, triazolyl, pyrrolidinyl, benzoxazolyl, benzothiazolyl, pyridyl, pyridazyl, pyrimidinyl, pyrazinyl, triazinyl, quinolinyl, isoquinolinyl, phthalazinyl, quinoxalinyl, quinazolinyl, purinyl, pteridinyl, azepinyl, and benzooxepinyl.

Examples of the substituent possessed by $R^{11}$ include, for example, an alkyl group, an alkenyl group, an alkynyl group, an aryl group, a heterocyclic group, an alkoxy group, an aryloxy group, a heterocyclic oxy group, an alkylthio group, an arylthio group, a heterocyclic thio group, an acyloxy group, an acylthio group, an alkoxycarbonyloxy group, an aryloxycarbonyloxy group, a carbamoyloxy group, an alkylsulfonyloxy group, an arylsulfonyloxy group, an amino group, an alkylamino group, an arylamino group, an amido group, an alkoxycarbonylamino group, an aryloxycarbonylamino group, a ureido group, a sulfonamido group, a sulfamoylamino group, an acyl group, an alkoxycarbonyl group, an aryloxycarbonyl group, a carbamoyl group, an acylcarbamoyl group, a carbamoylcarbamoyl group, a sulfonylcarbamoyl group, a sulfamoylcarbamoyl group, an alkylsulfonyl group, an arylsulfonyl group, an alkylsulfinyl group, an arylsulfinyl group, an alkoxysulfonyl group, an aryloxysulfonyl group, a sulfamoyl group, an acylsulfamoyl group, a carbamoylsulfamoyl group, a halogen atom, a nitro group, a cyano group, a carboxyl group, a sulfo group, a phosphono group, a hydroxyl group, a mercapto group, an imido group, and an azo group.

$R^{12}$ represents an alkyl group, an alkenyl group, an alkynyl group, an aryl group, or a heterocyclic group, each of which may be substituted.

The alkyl group represented by $R^{12}$ is preferably a straight-chain, branched, or cyclic alkyl group having 1 to 16 carbon atoms, such as methyl, ethyl, hexyl, dodecyl, 2-octyl, t-butyl, cyclopentyl, and cylooctyl. The akenyl group represented by $R^{12}$ is preferably a chain or cyclic alkenyl group having 2 to 16 carbon atoms, such as vinyl, 1-octenyl, and cyclohexenyl.

The alkynyl group represented by $R^{12}$ is preferably an alkynyl group having 2 to 16 carbon atoms, such as 1-butynyl and phenylethynyl. The aryl group and the heterocyclic group represented by $R^{12}$ include those mentioned for $R^{11}$. The substituent possessed by $R^{12}$ includes those mentioned for the substituent of $R^{11}$.

X represents —$SO_2$—, —CO—, —COCO—, —CO—O—, —CON($R^{13}$)—, —COCO—O—, —COCO—N($R^{13}$)— or —$SO_2$—N($R^{13}$)—, in which $R^{13}$ represents a hydrogen atom or a group represented by $R^{12}$ that is defined above.

Among those groups, —CO—, —CON($R^{13}$)—, and —CO—O—are preferable, and —CON($R^{13}$)— is particularly preferable for giving the particularly excellent color-forming property.

Out of the compounds represented by formula (I), the compounds represented by formula (II) or (III) are preferable, the compounds represented by formula (IV) or (V) are more preferable, the compounds represented by formula (VI) or (VII) are further more preferable.

Compounds represented by formulae (II) to (VII) are described in detail below.

In formulae (II) and (III), $z^1$ represents an acyl group, a carbamoyl group, an alkoxycarbonyl group, or an aryloxycarbonyl group, and $Z^2$ represents a carbamoyl group, an alkoxycarbonyl group, or an aryloxycarbonyl group. Preferably the acyl group has 1 to 50 carbon atoms, and more preferably 2 to 40 carbon atoms. Specific examples include an acetyl group, a 2-methylpropanoyl group, a cyclohexylcarbonyl group, an n-octanoyl group, a 2-hexyldecanoyl group, a dodecanoyl group, a chloroacetyl group, a trifluoroacetyl group, a benzoyl group, a 4-dodecyloxybenzoyl group, a 2-hydroxymethylbenzoyl group, and a 3-(N-hydroxy-N-methylaminocarbonyl)propanoyl group.

With respect to the case wherein $Z^1$ and $Z^2$ each represent a carbamoyl group, a description is made in detail in formulas (IV) to (VII).

Preferably the alkoxycarbonyl group and the aryloxycarbonyl group each have 2 to 50 carbon atoms, and more preferably 2 to 40 carbon atoms. Specific examples include a methoxycarbonyl group, an ethoxycarbonyl group, an isobutyloxycarbonyl group, a cyclohexyloxycarbonyl group, a dodecyloxycarbonyl group, a benzyloxycarbonyl group, a phenoxycarbonyl group, a 4-octyloxyphenoxycarbonyl group, a 2-hydroxymethylphenoxycarbonyl group, and a 2-dodecyloxyphenoxycarbonyl group.

$x^1$, $x^2$, $x^3$, $x^4$, and $X^5$ each represent a hydrogen atom or a substituent. Examples of the substituent include a straight-chain or branched, chain or cyclic alkyl group having 1 to 50 carbon atoms (e.g. trifluoromethyl, methyl, ethyl, propyl, heptafluoropropyl, isopropyl, butyl, t-butyl, t-pentyl, cyclopentyl, cyclohexyl, octyl, 2-ethylhexyl, and dodecyl); a straight-chain or branched, chain or cyclic alkenyl group having 2 to 50 carbon atoms (e.g. vinyl, 1-methylvinyl, and cyclohexen-1-yl); an alkynyl group having 2 to 50 carbon atoms in all (e.g. ethynyl and 1-propinyl), an aryl group having 6 to 50 carbon atoms (e.g. phenyl, naphthyl, and anthryl), an acyloxy group having 1 to 50 carbon atoms (e.g. acetoxy, tetradecanoyloxy, and benzoyloxy), a carbamoyloxy group having 1 to 50 carbon atoms (e.g. N,N-dimethylcarbamoyloxy), a carbonamido group having 1 to 50 carbon atoms (e.g. formamido, N-methylacetamido, acetamido, N-methylformamido, and benzamido), a sulfonamido group having 1 to 50 carbon atoms (e.g. methanesulfonamido, dodecansulfonamido, benzenesulfonamido, and p-toluenesulfonamido), a carbamoyl group having 1 to 50 carbon atoms (e.g. N-methylcarbamoyl, N,N-diethylcarbamoyl, and N-mesylcarbamoyl), a sulfamoyl group having 0 to 50 carbon atoms (e.g. N-butylsulfamoyl, N,N-diethylsulfamoyl, and N-methyl-N-(4-methoxyphenyl) sulfamoyl), an alkoxy group having 1 to 50 carbon atoms (e.g. methoxy, propoxy, isopropoxy, octyloxy, t-octyloxy, dodecyloxy, and 2-(2,4-di-t-pentylphenoxy)ethoxy), an aryloxy group having 6 to 50 carbon atoms (e.g. phenoxy, 4-methoxyphenoxy, and naphthoxy), an aryloxycarbonyl group having 7 to 50 carbon atoms (e.g. phenoxycarbonyl and naphthoxycarbonyl), an alkoxycarbonyl group having 2 to 50 carbon atoms (e.g. methoxycarbonyl and t-butoxycarbonyl), an N-acylsulfamoyl group having 1 to 50 carbon atoms (e.g. N-tetradecanoylsulfamoyl and N-benzoylsulfamoyl), an alkylsulfonyl group having 1 to 50 carbon atoms (e.g. methanesulfonyl, octylsulfonyl, 2-methoxyethylsulfonyl, and 2-hexyldecylsulfonyl), an arylsulfonyl group having 6 to 50 carbon atoms (e.g. benzenesulfonyl, p-toluenesulfonyl, and 4-phenylsulfonylphenylsulfonyl), an alkoxycarbonylamino group having 2 to 50 carbon atoms (e.g. ethoxycarbonylamino), an aryloxycarbonylamino group having 7 to 50 carbon atoms (e.g. phenoxycarbonylamino and naphthoxycarbonylamino), an amino group having 0 to 50 carbon atoms (e.g. amino, methylamino, diethylamino, diisopropylamino, anilino, and morpholino), a cyano group, a nitro group, a carboxyl group, a hydroxyl group, a sulfo group, a mercapto group, an alkylsulfinyl group having 1 to 50 carbon atoms (e.g. methanesulfinyl and octanesulfinyl), an arylsulfinyl having 6 to 50 carbon atoms (e.g. benzenesulfinyl, 4-chlorophenylsulfinyl, and p-toluenesulfinyl), an alkylthio group having 1 to 50 carbon atoms (e.g. methylthio, octylthio, and cyclohexylthio), an arylthio group having 6 to 50 carbon atoms (e.g. phenylthio and naphthylthio), a ureido group having 1 to 50 carbon atoms (e.g. 3-methylureido, 3,3-dimethylureido, and 1,3-diphenylureido), a heterocyclic group having 2 to 50 carbon atoms (e.g. a 3-membered to 12-membered monocyclic ring or condensed ring having at least one hetero atom(s), such as nitrogen, oxygen, and sulfur, for example, 2-furyl, 2-pyranyl, 2-pyridyl, 2-thienyl, 2-imidazolyl, morpholino, 2-quinolyl, 2-benzimidazolyl, 2-benzothiazolyl, and 2-benzoxazolyl), an acyl group having 1 to 50 carbon atoms (e.g. acetyl, benzoyl, and trifluoroacetyl), a sulfamoylamino group having 0 to 50 carbon atoms (e.g. N-butylsulfamoylamino and N-phenylsulfamoylamino), a silyl group having 3 to 50 carbon atoms (e.g. trimethylsilyl, dimethyl-t-butylsilyl, and triphenylsilyl), and a halogen atom (e.g. a fluorine atom, a chlorine atom, and a bromine atom). The above substituents may further have a substituent, and examples of such a substituent include those mentioned above. Further, $X^1$, $X^2$, $X^3$, $X^4$, and $X^5$ may bond together to form a condensed ring. As a condensed ring, a 5- to 7-membered ring is preferable, and a 5- or 6- membered ring is more preferable.

The number of carbon atoms of the substituent is preferably 50 or below, more preferably 42 or below, and most preferably 34 or below, and there is preferably 1 or more carbon atom(s).

With respect to $X^1$, $x^2$, $x^3$, $x^4$, and $X^5$ in formulae (II) and (IV), the sum of the Hammett substituent constant σp values of $X^1$, $x^3$, and $X^5$ and the Hammett substituent constant σm values of $X^2$ and $X^4$ is 0.80 or more but 3.80 or below. $X^6$, $X^7$, $X^8$, $X^9$, and $X^{10}$ in formula (VI) each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, which may have a substituent and may bond together to form a condensed ring. Specific examples of $X^6$ through $X^{10}$ are the same as those described for $X^1$, $X^2$, $X^3$, $X^4$, and $X^5$. However, in formula (VI), the sum of the Hammett substituent constant σp values of $X^6$, $X^8$, and $X^{10}$ and the Hammett substituent constant σm values of $X^7$ and $X^9$ is 1.20 or more but 3.80 or below, more preferably 1.50 or more but 3.80 or below, and further more preferably 1.70 or more but 3.80 or below.

Herein, if the sum of the σp values and the σm values is less than 0.80, the problem arises that the color formation is unsatisfactory, while if the sum of the σp values and the σm values is over 3.80, the synthesis and availability of the compounds themselves become difficult.

Parenthetically, Hammett substituent constants σp and σm are described in detail in such books as "Hammett no Hosoku/Kozo to Hannousei," written by Naoki Inamoto (Maruzen); "Shin-jikken Kagaku-koza 14/Yukikagoubutsu no Gosei to Hanno V," page 2605 (edited by Nihonkagakukai, Maruzen); "Riron Yukikagaku Kaisetsu," written by Tadao Nakaya, page 217 (Tokyo Kagakudojin); and "Chemical Review" (Vol. 91), pages 165 to 195 (1991).

$R^1$ and $R^2$ in formulae (IV) and (V), and $R^4$ and $R^5$ in formulae (VI) and (VII), each represent a hydrogen atom or a substituent, and examples of the substituent are the same as those described for $X^1$, $X^2$, $X^3$, $X^4$, and $X^5$; preferably each represents a hydrogen atom, a substituted or unsubstituted alkyl group having 1to 50 carbon atoms, a substituted or unsubstituted aryl group having 6 to 50 carbon atoms, or a substituted or unsubstituted heterocyclic group having 1 to 50 carbon atoms, and more preferably at least one of $R^1$ and $R^2$, and at least one of $R^4$ and $R^5$, are each a hydrogen atom.

In formulae (III) and (V), $R^1$ represents a heterocyclic group. Herein, a preferable heterocyclic group has 1 to 50 carbon atoms, and the heterocyclic group contains at least one hetero atom, such as a nitrogen atom, an oxygen atom, and a sulfur atom, and further the heterocyclic group is a saturated or unsaturated 3-membered to 12-membered (preferably 3-membered to 8-membered) monocyclic or condensed ring. Specific examples of the heterocyclic ring are furan, pyran, pyridine, thiophene, imidazole, quinoline, benzimidazole, benzothiazole, benzoxazole, pyrimidine, pyrazine, 1,2,4-thiadiazole, pyrrole, oxazole, thiazole, quinazoline, isothiazole, pyridazine, indole, pyrazole, triazole, and quinoxaline. These heterocyclic groups may have a substituent, and preferably they have one or more electron-attracting groups. Herein, the term "an electron-attracting group" means one wherein the Hammett σp value is a positive value. When the color-forming reducing agent for use in the present invention is built in a light-sensitive material, preferably at least one of $Z^1$, $z^2$, $R^1$ to $R^5$, and $X^1$ to $X^{10}$, has a ballasting group (a group, having 5 to 50, preferably 8 to 40 carbon atoms, which makes the color-forming reducing agent that has a ballasting group, easily-soluble in a high-boiling organic solvent, and which makes the color-forming reducing agent immobilized).

Further, in the present invention, a compound represented by formula (I) is useful when it is a carbamoylhydrazine compound, because it reacts sufficiently with a two-equivalent coupler. Further, it is remarkably superior, in view of long-time storage preservability of the non-processed light-sensitive material.

Now, among novel color-forming reducing agents, other than above examples, used in the present invention, compounds represented by formula (I) are described specifically, but the scope of the present invention is not limited to them.

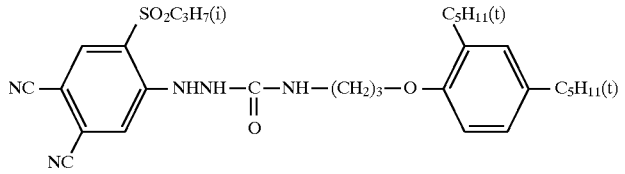

I-1

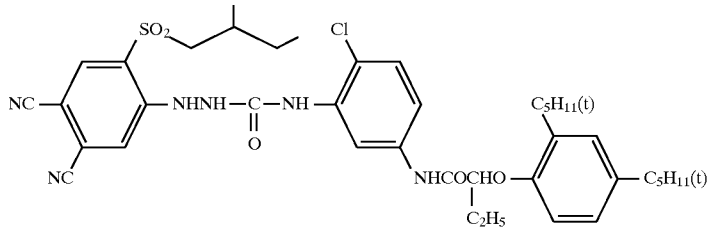

I-2

-continued
I-3
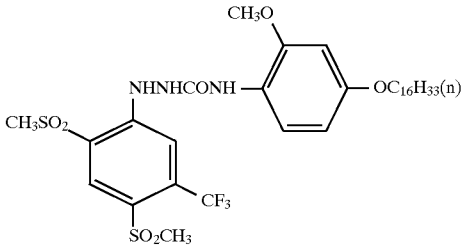
I-4
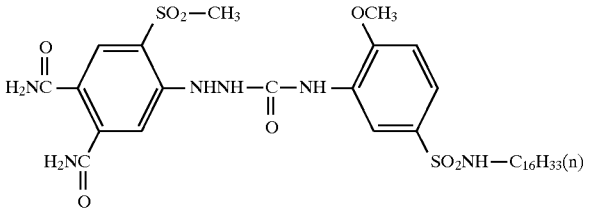
I-5
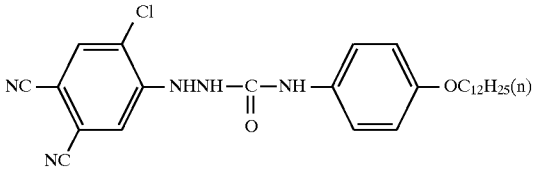
I-6
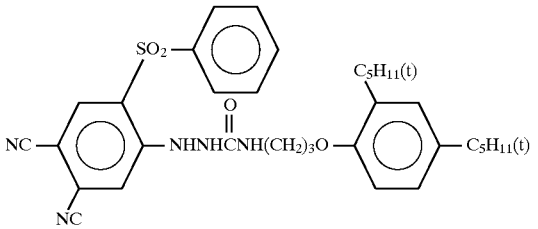
I-7
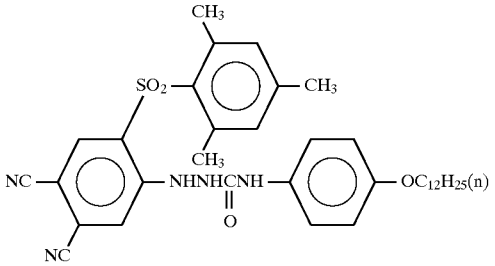
I-8
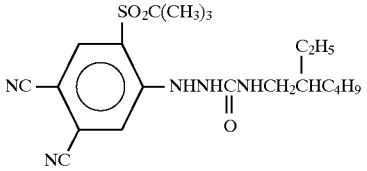
I-9
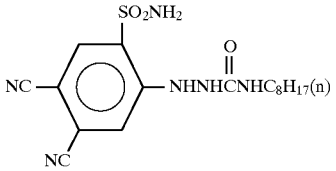

-continued
I-10
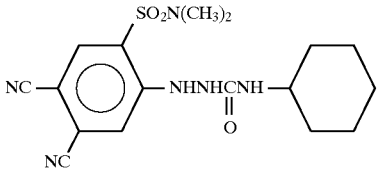
I-11
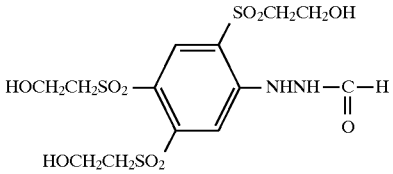
I-12
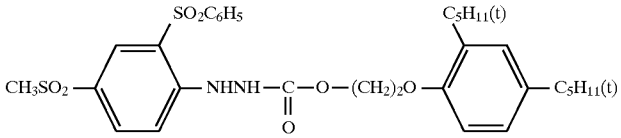
I-13
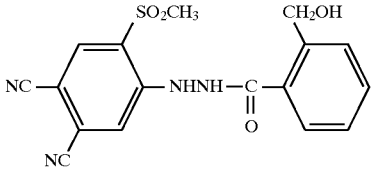
I-14
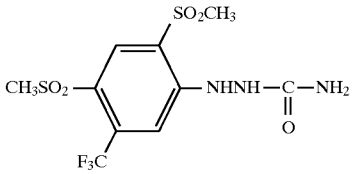
I-15
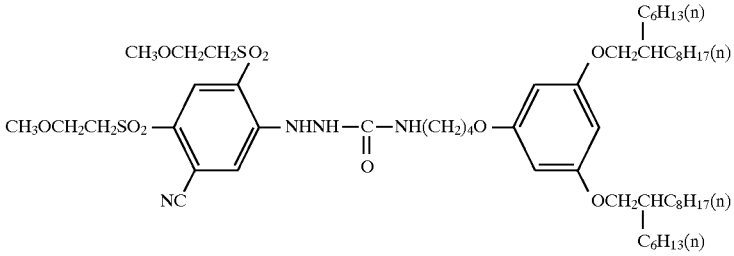
I-16
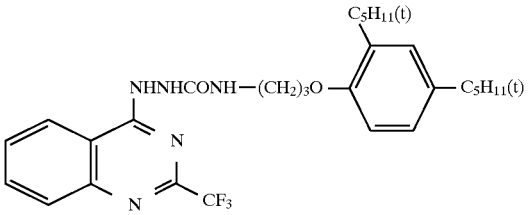
I-17
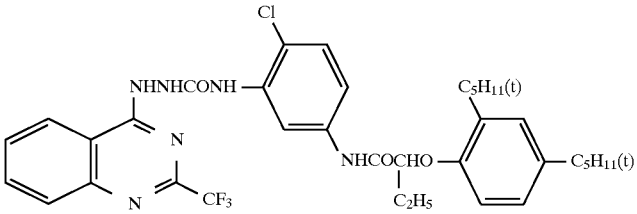

-continued
I-18
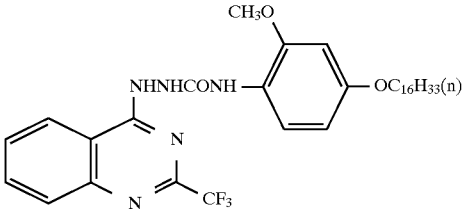
I-19
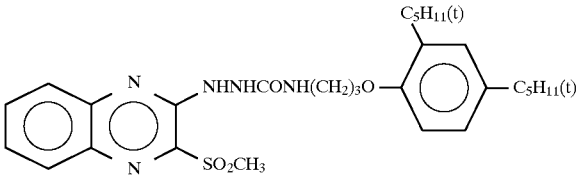
I-20
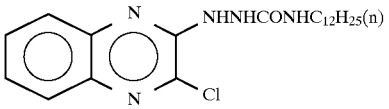
I-21
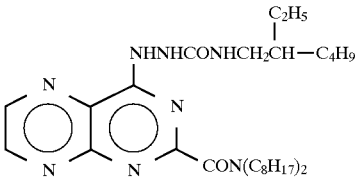
I-22
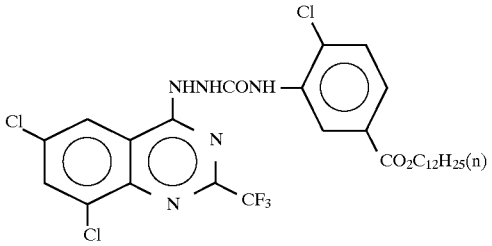
I-23
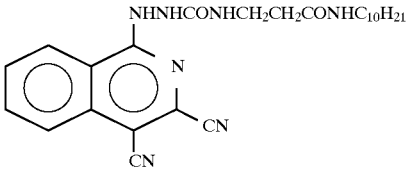
I-24
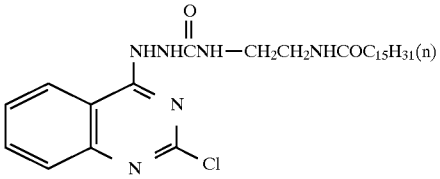
I-25
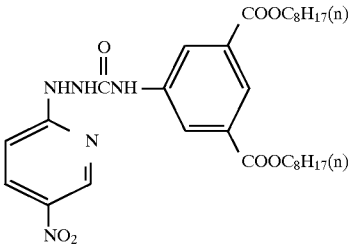

-continued
I-26
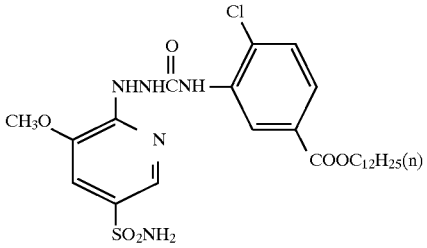
I-27
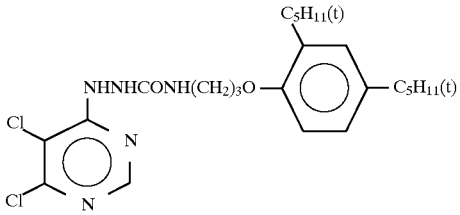
I-28
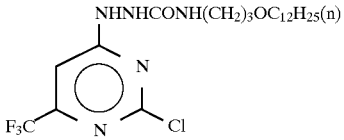
I-29
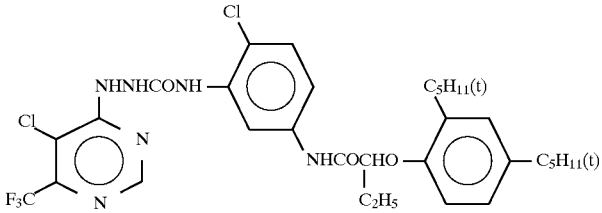
I-30
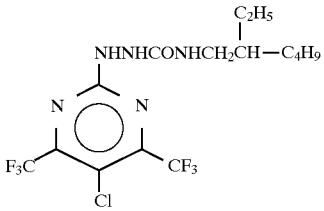
I-31
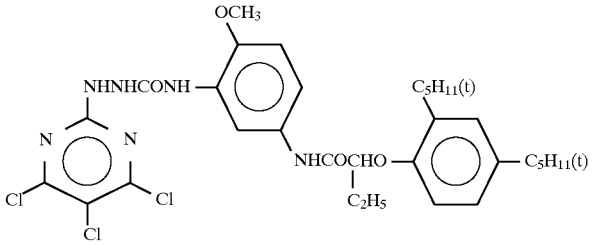
I-32
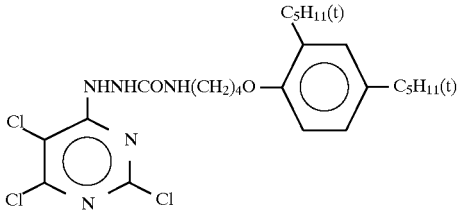

-continued
I-33
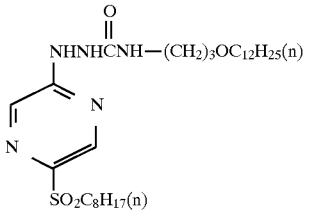
I-34
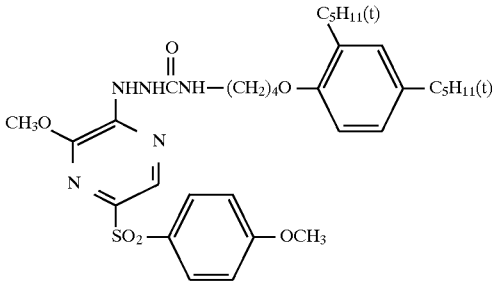
I-35
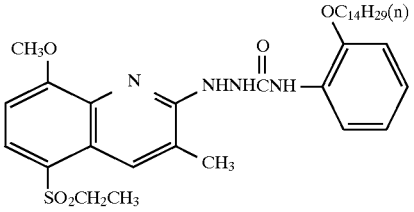
I-36
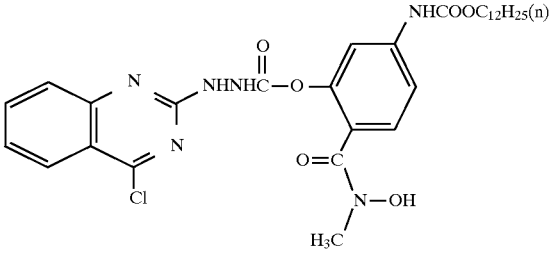
I-37
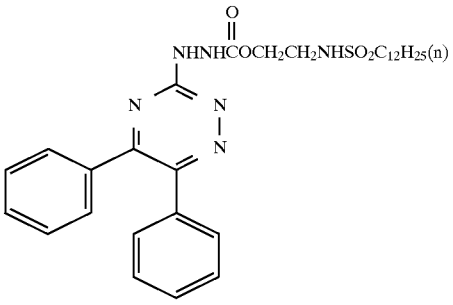
I-38
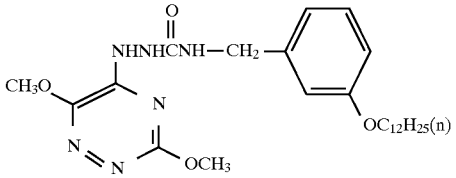
I-39
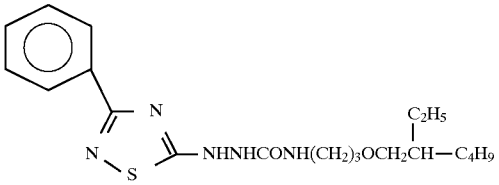

-continued
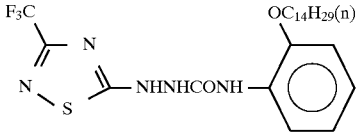
I-40
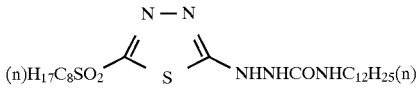
I-41
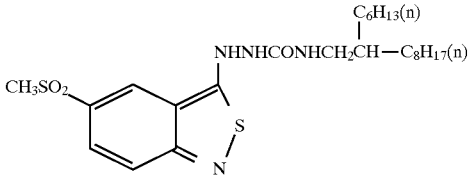
I-42
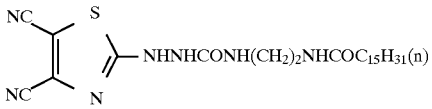
I-43
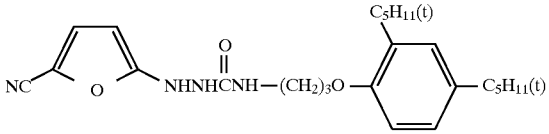
I-44
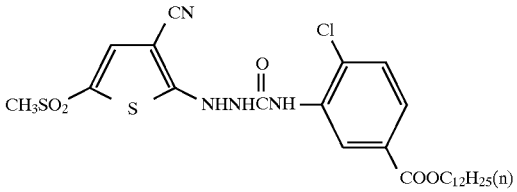
I-45
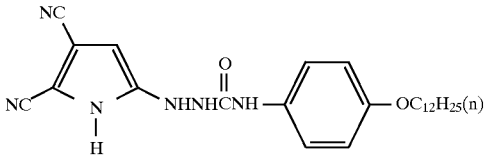
I-46
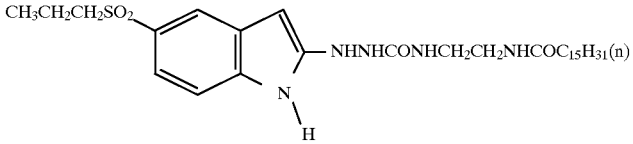
I-47
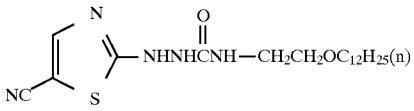
I-48
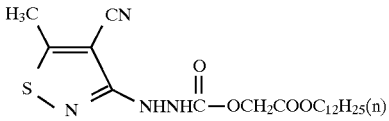
I-49
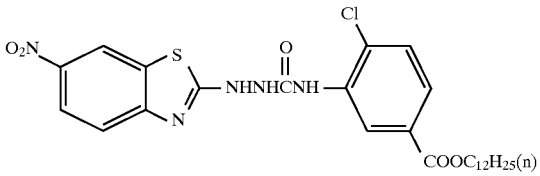
I-50

-continued
I-51
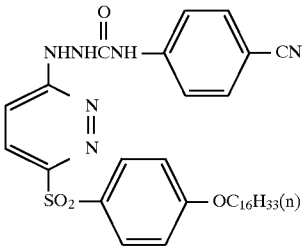
I-52
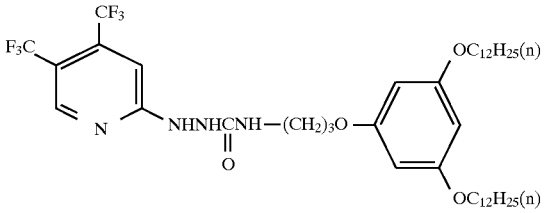
I-53
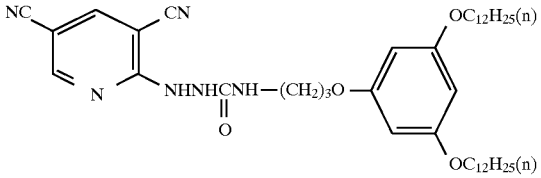
I-54
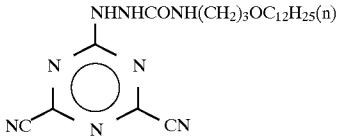
I-55
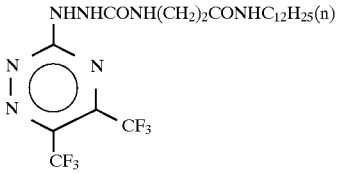
I-56
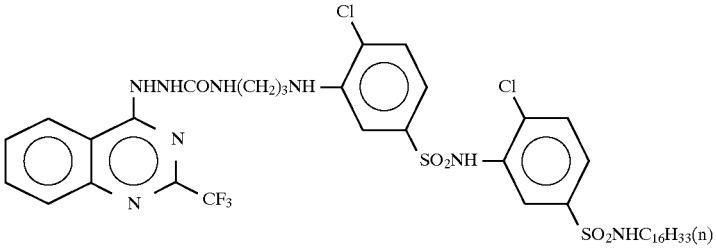
I-57
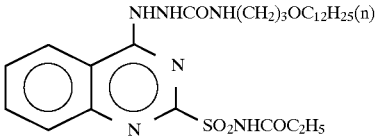

-continued
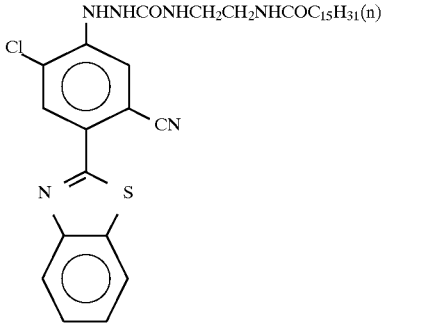
I-58
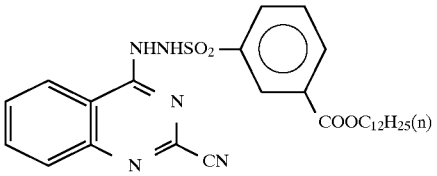
I-59
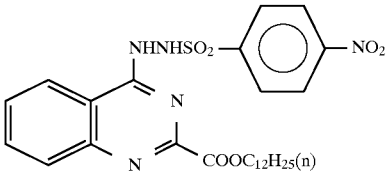
I-60
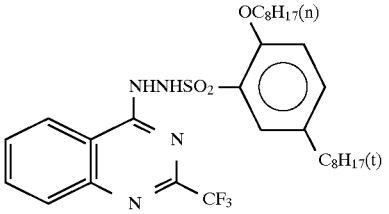
I-61
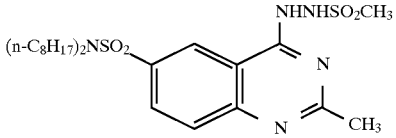
I-62
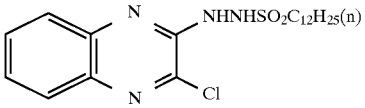
I-63
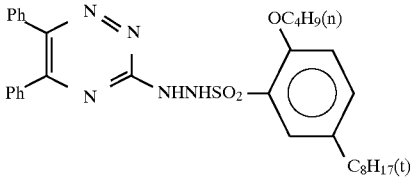
I-64
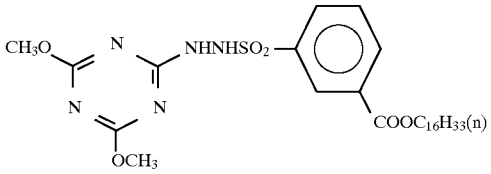
I-65
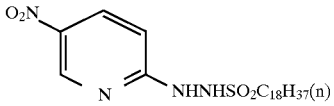
I-66

-continued
I-67
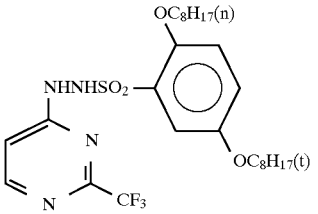
I-68
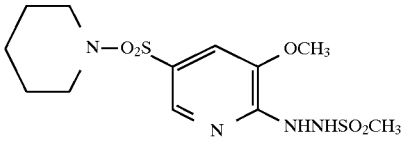
I-69
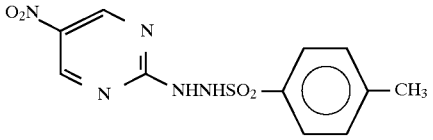
I-70
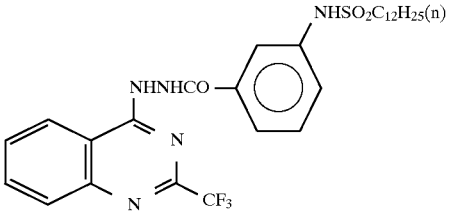
I-71
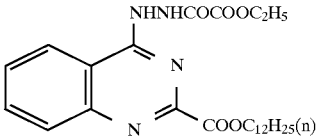
I-72
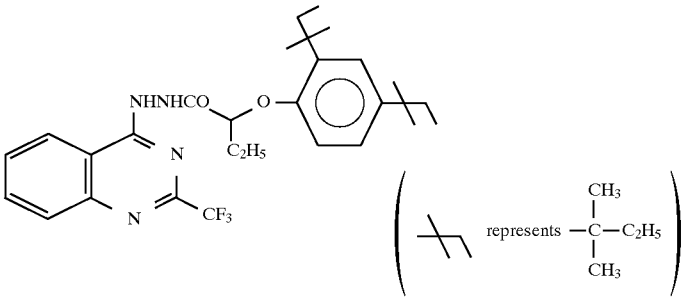
I-73
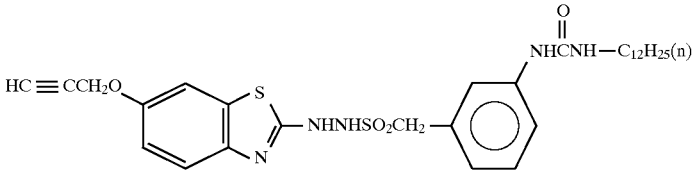
I-74
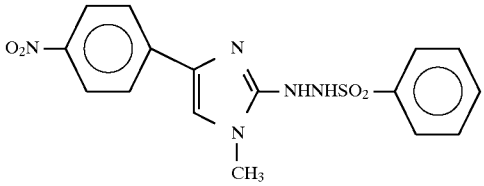

-continued
I-75
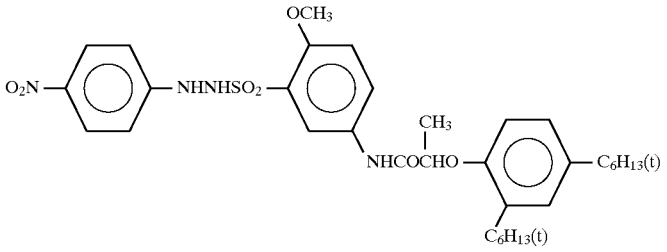
I-76
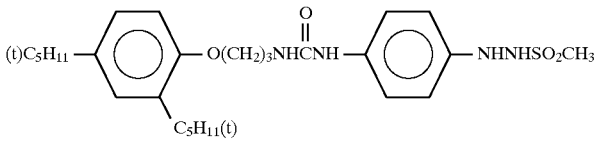
I-77
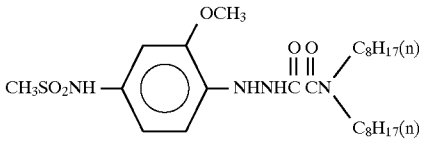
I-78
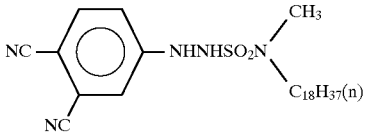
I-79
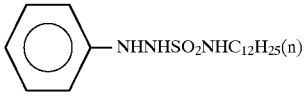
I-80
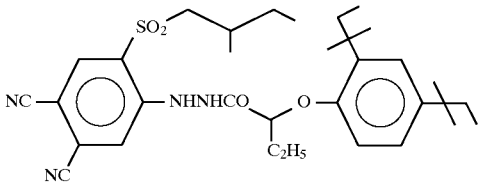
I-81
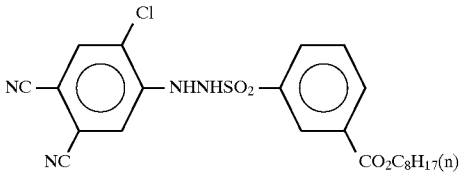
I-82
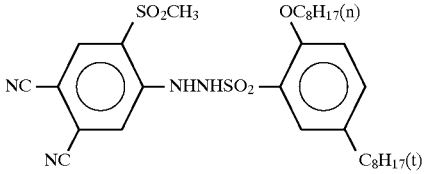
I-83
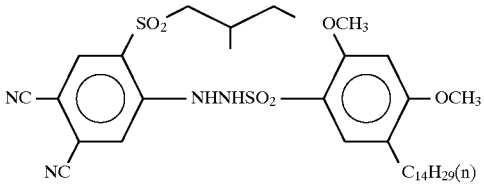

-continued

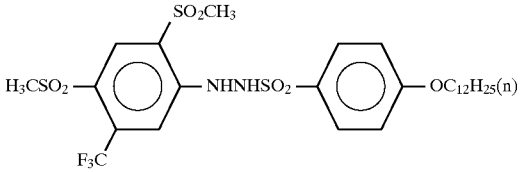

I-84

As couplers that are preferably used in the present invention, compounds having structures described by the following formulae (1) to (12) are mentioned. They are compounds collectively generally referred to as active methyleness, pyrazolones, pyrazoloazoles, phenols, naphthols, and pyrrolotriazoles, respectively, which are compounds known in the art.

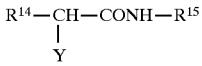

(1)

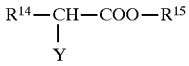

(2)

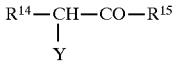

(3)

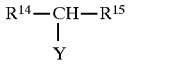

(4)

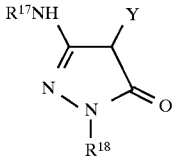

(5)

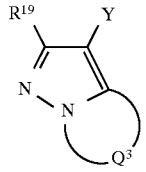

(6)

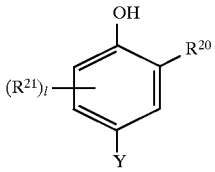

(7)

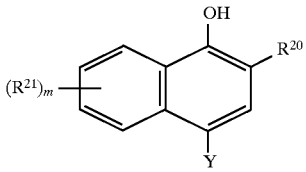

(8)

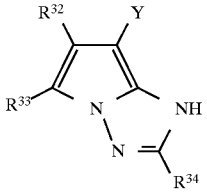

(9)

-continued

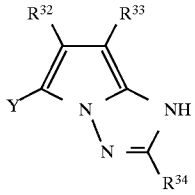

(10)

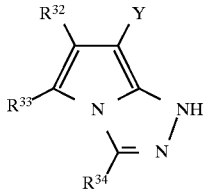

(11)

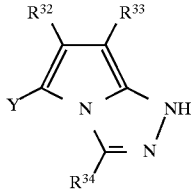

(12)

Formulae (1) to (4) represent couplers that are called active methylene couplers, and, in the formulae, $R^{14}$ represents an acyl group, a cyano group, a nitro group, an aryl group, a heterocyclic residue, an alkoxycarbonyl group, an aryloxycarbonyl group, a carbamoyl group, a sulfamoyl group, an alkylsulfonyl group, or an arylsulfonyl group, optionally substituted.

In formulae (1) to (3), $R^{15}$ represents an optionally substituted alkyl group, aryl group, or heterocyclic residue. In formula (4), $R^{16}$ represents an optionally substituted aryl group or heterocyclic residue. Examples of the substituent that may be possessed by $R^{14}$, $R^{15}$,and $R^{16}$ include those mentioned for $X^1$ to $X^5$.

In formulae (1) to (4), Y represents a hydrogen atom or a group capable of coupling split—off by coupling reaction with the oxidation product of the color-forming reducing agent. Examples of Y are a heterocyclic group (a saturated or unsaturated 5-membered to 7-membered monocyclic or condensed ring having as a hetero atom at least one nitrogen atom, oxygen atom, sulfur atom, or the like, e.g. succinimido, maleinimido, phthalimido, diglycolimido, pyrrole, pyrazole, imidazole, 1,2,4-triazole, tetrazole, indole, benzopyrazole, benzimidazole, benzotriazole, imidazolin-2,4-dione, oxazolidin-2,4-dione, thiazolidin-2,4-dione, imidazolidin-2-one, oxazolin-2-one, thiazolin-2-one, benzimidazolin-2-one, benzoxazolin-2-one, benzthiazolin-2-one, 2-pyrrolin-5-one, 2-imidazolin-5-one, indolin-2,3-dione, 2,6-dioxypurine, parabic acid, 1,2,4-triazolidin-3,5-dione, 2-pyridone, 4-pyridone, 2-pyrimidone, 6-pyridazone, 2-pyrazone, 2-amino-1,3,4-thiazolidine, and 2-imino-1,3,4-thiazolidin-4-one), a halogen atom (e.g. a chlorine atom and a bromine atom), an aryloxy group (e.g. phenoxy and 1-naphthoxy), a heterocyclic oxy group (e.g. pyridyloxy and pyrazolyoxy), an acyloxy group (e.g. acetoxy and benzoyloxy), an alkoxy group (e.g. methoxy and dodecyloxy), a carbamoyloxy group (e.g. N,N-diethylcarbamoyloxy and morpholinocarbonyloxy), an aryloxycarbonyloxy group (e.g. phenoxylcarbonyloxy), an alkoxycarbonyloxy group (e.g. methoxycarbonyloxy and ethoxycarbonyloxy), an arylthio group (e.g. phenylthio and naphthylthio), a heterocyclic thio group (e.g. tetrazolylthio, 1,3,4-thiadiazolylthio, 1,3,4-oxadiazolylthio, and benzimidazolylthio), an alkylthio group (e.g. methylthio, octylthio, and hexadecylthio), an alkylsulfonyloxy group (e.g. methanesulfonyloxy), an arylsulfonyloxy group (e.g. benzenesulfonyloxy and toluenesulfonyloxy), a carbonamido group (e.g. acetamido and trifluoroacetamido), a sulfonamide group (e.g. methanesulfonamido and benzenesulfonamido), an alkylsulfonyl group (e.g. methanesulfonyl), an arylsulfonyl group (e.g. benzenesulfonyl), an alkylsulfinyl group (e.g. methanesulfinyl), an arylsulfinyl group (e.g. benzenesulfinyl), an arylazo group (e.g. phenylazo and naphthylazo), and a carbamoylamino group (e.g. N-methylcarbamoylamino).

Y may be substituted with a substituent, and examples of the substituent that may be possessed by Y include those mentioned for $X^1$ to $X^5$.

Preferably Y represents a halogen atom, an aryloxy group, a heterocyclic oxy group, an acyloxy group, an aryloxycarbonyloxy group, an alkoxycarbonyloxy group, or a carbamoyloxy group.

In formulae (1) to (4), $R^{14}$ and $R^{15}$, and $R^{14}$ and $R^{16}$, may bond together to form a ring.

Formula (5) represents a coupler that is called a 5-pyrazolone coupler, and in the formula, $R^{17}$ represents an alkyl group, an aryl group, an acyl group, or a carbamoyl group. $R^{18}$ represents a phenyl group or a phenyl group that is substituted by one or more halogen atoms, alkyl groups, cyano groups, alkoxy groups, alkoxycarbonyl groups, or acylamino groups.

Preferable 5-pyrazolone couplers represented by formula (5) are those wherein $R^{17}$ represents an aryl group or an acyl group, and $R^{18}$ represents a phenyl group that is substituted by one or more halogen atoms.

With respect to these preferable groups, more particularly, $R^{17}$ is an aryl group, such as a phenyl group, a 2-chlorophenyl group, a 2-methoxyphenyl group, a 2-chloro-5-tetradecaneamidophenyl group, a 2-chloro-5-(3-octadecenyl-1-succinimido)phenyl group, a 2-chloro-5-octadecylsulfonamidophenyl group, and a 2-chloro-5-[2-(4-hydroxy-3-t-butylphenoxy)tetradecaneamido]phenyl group; or $R_{17}$ is an acyl group, such as an acetyl group, a 2-(2,4-di-t-pentylphenoxy)butanoyl group, a benzoyl group, and a 3-(2,4-di-t-amylphenoxyacetamido)benzoyl group, any of which may have a substituent, such as a halogen atom or an organic substituent that is bonded through a carbon atom, an oxygen atom, a nitrogen atom, or a sulfur atom. Y has the same meaning as defined above.

Preferably $R^{18}$ represents a substituted phenyl group, such as a 2,4,6-trichlorophenyl group, a 2,5-dichlorophenyl group, and a 2-chlorophenyl group.

Formula (6) represents a coupler that is called a pyrazoloazole coupler, and, in the formula, $R^{19}$ represents a hydrogen atom or a substituent. $Q^3$ represents a group of nonmetal atoms required to form a 5-membered azole ring containing 2 to 4 nitrogen atoms, which azole ring may have a substituent (including a condensed ring).

Preferable pyrazoloazole couplers represented by formula (6), in view of spectral absorption characteristics of the color-formed dyes, are imidazo[1,2-b]pyrazoles described in U.S. Pat. No. 4,500,630, pyrazolo[1,5-b]-1,2,4-triazoles described in U.S. Pat. No. 4,500,654, and pyrazolo[5,1-c]-1,2,4-triazoles described in U.S. Pat. No. 3,725,067.

Details of substituents of the azole rings represented by the substituents $R^{19}$ and $Q^3$ are described, for example, in U.S. Pat No. 4,540,654, the second column, line 41, to the eighth column, line 27. Preferable pyrazoloazole couplers are pyrazoloazole couplers having a branched alkyl group directly bonded to the 2-, 3-, or 6-position of the pyrazolotriazole group, as described in JP-A-61-65245; pyrazoloazole couplers containing a sulfonamide group in the molecule, as described in JP-A-61-65245; pyrazoloazole couplers having an alkoxyphenylsulfonamido ballasting group, as described in JP-A-61-147254; pyrazolotriazole couplers having an alkoxy group or an aryloxy group at the 6-position, as described in JP-A-62-209457 or 63-307453; and pyrazolotriazole couplers having a carbonamido group in the molecule, as described in JP-A-2-201443. Y has the same meaning as defined above.

Formulae (7) and (8) are respectively called phenol couplers and naphthol couplers, and in the formulae $R^{20}$ represents a hydrogen atom or a group selected from the group consisting of —$CONR^{22}R^{23}$, —$SO_2NR^{22}R^{23}$, —$NHCOR^{22}$, —$NHCONR^{22}R^{23}$, and —$NHSO_2NR^{22}R^{23}$. $R^{22}$ and $R^{23}$ each represent a hydrogen atom or a substituent. In formulae (7) and (8), $R^{21}$ represents a substituent, 1 is an integer selected from 0 to 2, and m is an integer selected from 0 to 4. When 1 and m are 2 or more, $R^{21}$'s may be different. The substituents of $R^{21}$ to $R^{23}$ include those mentioned above as examples for $X^1$ to $X^5$ in the formulae (II) and (IV) above. Y has the same meaning as defined above.

Preferable examples of the phenol couplers represented by formula (7) include 2-acylamino-5-alkylphenol couplers described, for example, in U.S. Pat. Nos. 2,369929, 2,801,171, 2,772,162, 2,895,826, and 3,772,002; 2,5-diacylaminophenol couplers described, for example, in U.S. Pat. Nos. 2,772,162, 3,758,308, 4,126,396, 4,334,011, and 4,327,173, West Germany Patent Publication No. 3,329,729, and JP-A-59-166956; and 2-phenylureido-5-acylaminophenol couplers described, for example, in U.S. Pat. Nos. 3,446,622, 4,333,999, 4,451,559, and 4,427,767. Y has the same meaning as defined above.

Preferable examples of the naphthol couplers represented by formula (8) include 2-carbamoyl-1-naphthol couplers described, for example, in U.S. Pat. Nos. 2,474,293, 4,052,212, 4,146,396, 4,282,233, and 4 296 200; and 2-carbamoyl-5-amido-1-naphthol couplers described, for example, in U.S. Pat. No. 4,690,889. Y has the same meaning as defined above.

Formulas (9) to (12) are couplers called pyrrolotriazoles, and $R^{32}{}_1$ $R^{33}$, and $R^{34}$ each represent a hydrogen atom or a substituent. Y has the same meaning as defined above. Examples of the substituent of $R^{32}{}_1$ $R^{33}$, and $R^{34}$ include those mentioned for $X^1$ to $X^5$. Preferable examples of the pyrrolotriazole couplers represented by formulae (9) to (12) include those wherein at least one of $R^{32}$ and $R^{33}$ is an electron-attracting group, which specific couplers are described in EP-A-488 248 (A1), 491 197 (A1), and 545 300. Y has the same meaning as defined above.

Further, a fused-ring phenol, an imidazole, a pyrrole, a 3-hydroxypyridine, an active methylene other than the above, an active methine, a 5,5-ring-fused heterocyclic, and a 5,6-ring-fused heterocyclic coupler, can be used.

As the fused-ring phenol couplers, those described, for example, in U.S. Pat. Nos. 4,327,173, 4,564,586, and 4,904,575, can be used.

As the imidazole couplers, those described, for example, in U.S. Pat. Nos. 4,818,672 and 5,051,347, can be used.

As the 3-hydroxypyridine couplers, those described, for example, in JP-A-1-315736, can be used.

As the active methylene and active methine couplers, those described, for example, in U.S. Pat. Nos. 5,104,783 and 5,162,196, can be used.

As the 5,5-ring-fused heterocyclic couplers, for example, pyrrolopyrazole couplers described in U.S. Pat. No 5,164,289, and pyrroloimidazole couplers described in JP-A-4-174429, can be used.

As the 5,6-ring-fused heterocyclic couplers, for example, pyrazolopyrimidine couplers described in U.S. Pat. No. 4,950 585, pyrrolotriazine couplers described in JP-A-4-204730, and couplers described in EP-556 700, can be used.

In the present invention, in addition to the above couplers, use can be made of couplers described, for example, in West Germany Patent Nos. 3 819 051A and 3 823 049, U.S. Pat. Nos. 4,840,883, 5,024,930, 5,051,347, and 4,481,268, EP-A-304 856 (A2), EP-329 036, EP-A-354 549 (A2), 374 781 (A2), 379 110 (A2), and 386 930 (A1), and JP-A-63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731, and 4-204732.

Specific examples of the couplers that can be used in the present invention are shown below, but, of course, the present invention is not limited to them:

(C-1)

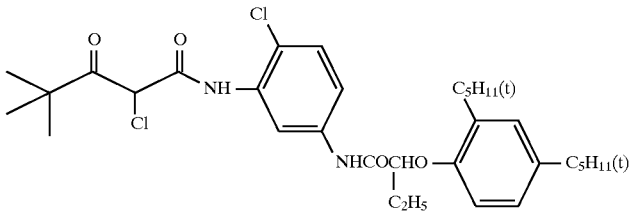

(C-2)

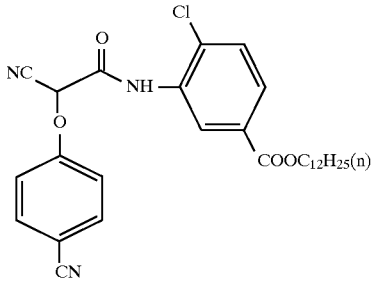

(C-3)

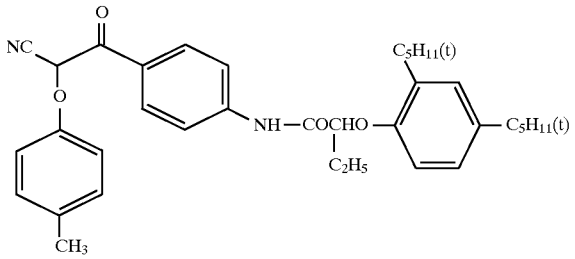

(C-4)

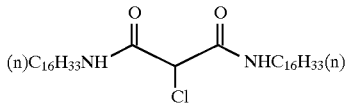

(C-5)

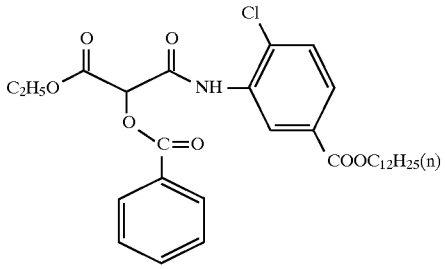

-continued
(C-6)
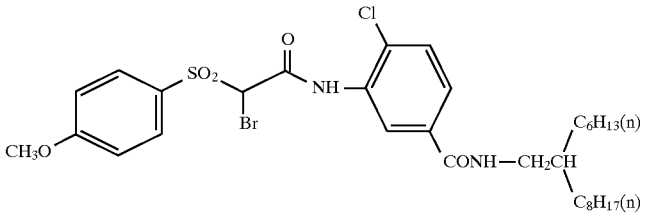
(C-7)
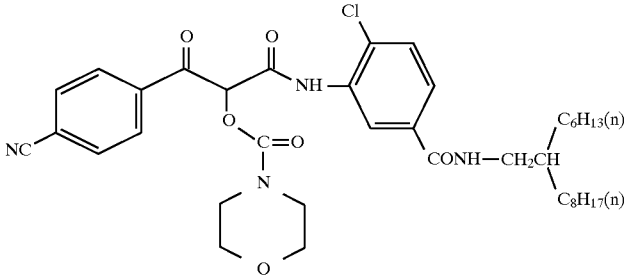
(C-8)
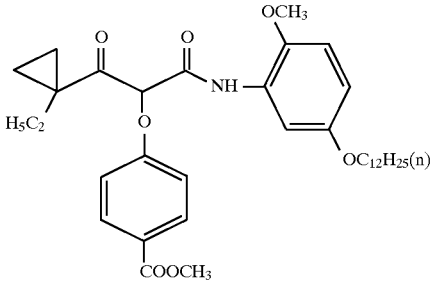
(C-9)
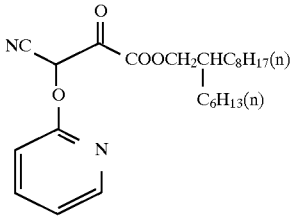
(C-10)
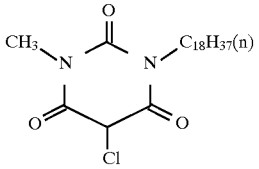
(C-11)
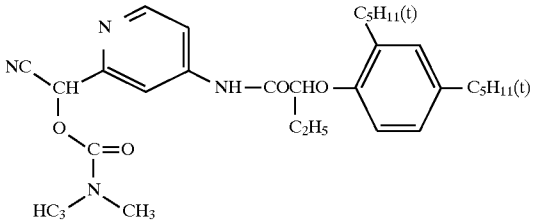
(C-12)
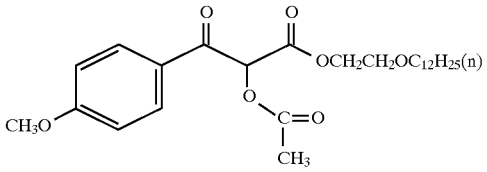

-continued
(C-13)
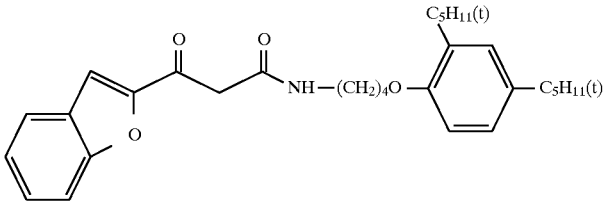
(C-14)
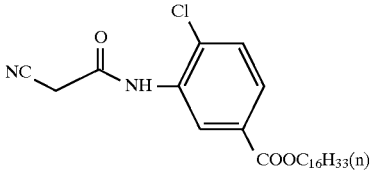
(C-15)
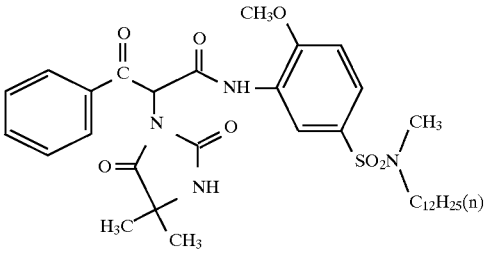
(C-16)
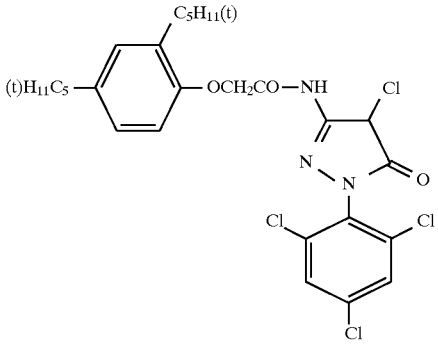
(C-17)
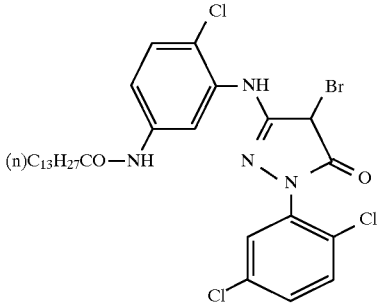
(C-18)
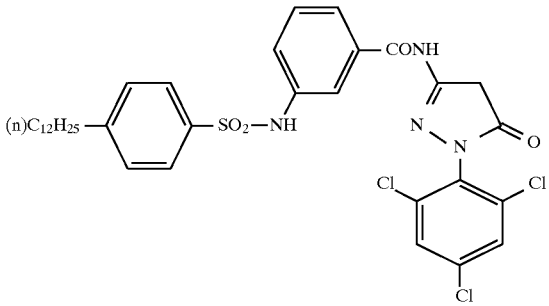

-continued
(C-19)
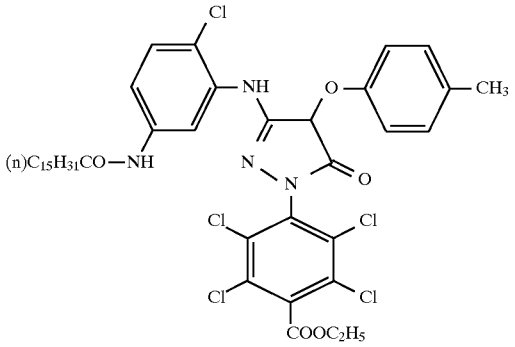
(C-20)
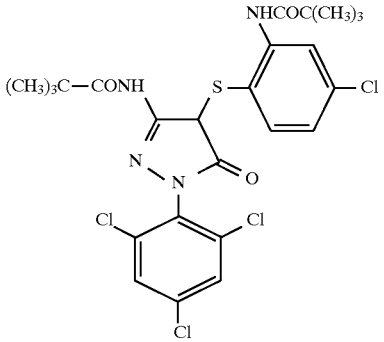
(C-21)
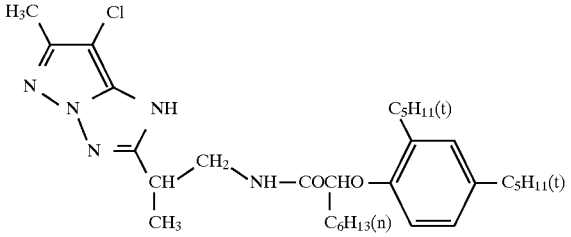
(C-22)
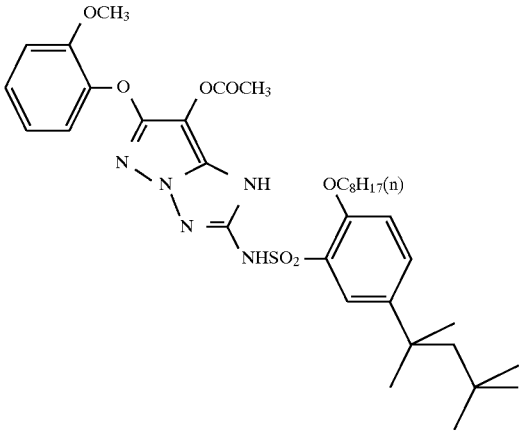

-continued
(C-23)
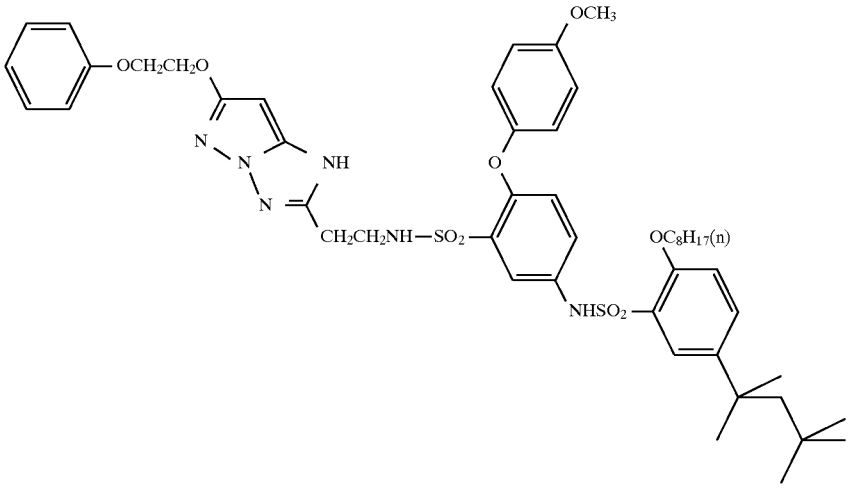
(C-24)
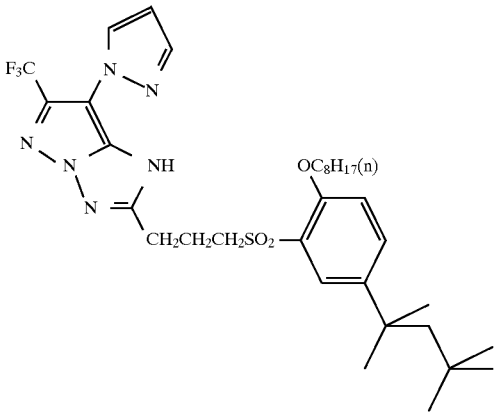
(C-25)
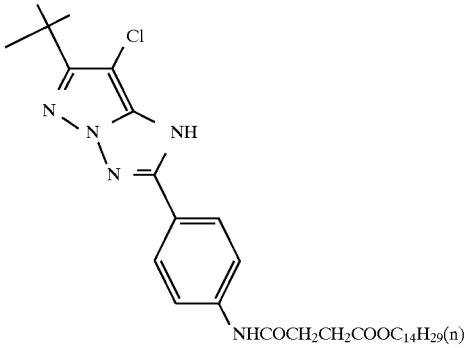
(C-26)
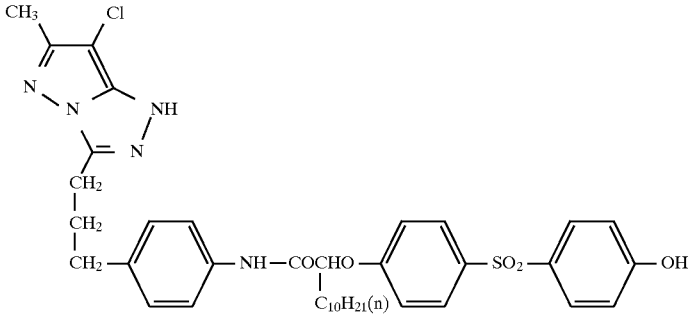

-continued
(C-27)
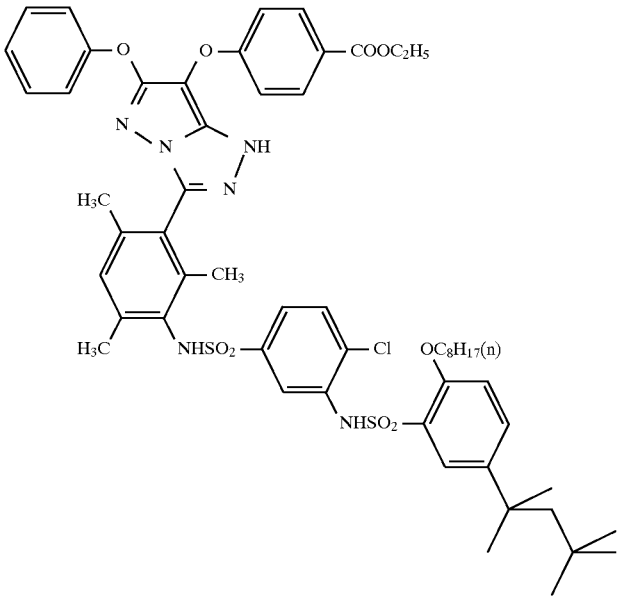
(C-28)
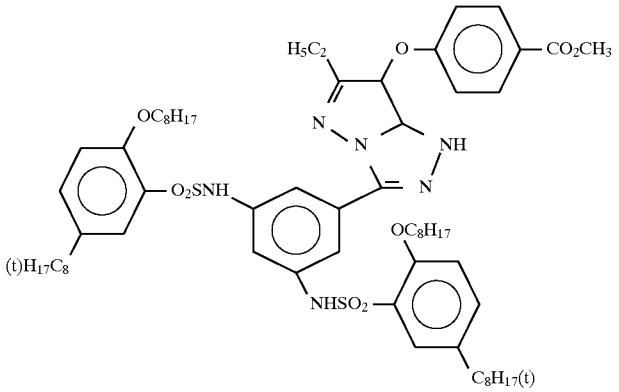
(C-29)
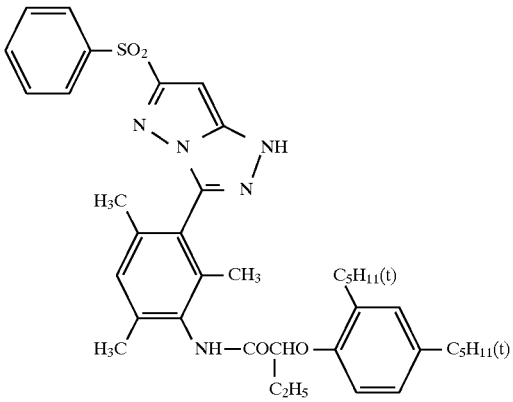

-continued
(C-30)
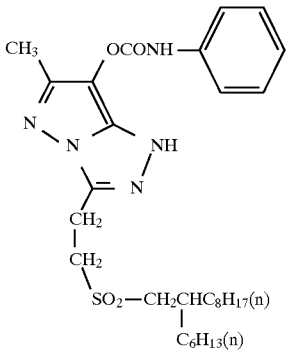
(C-31)
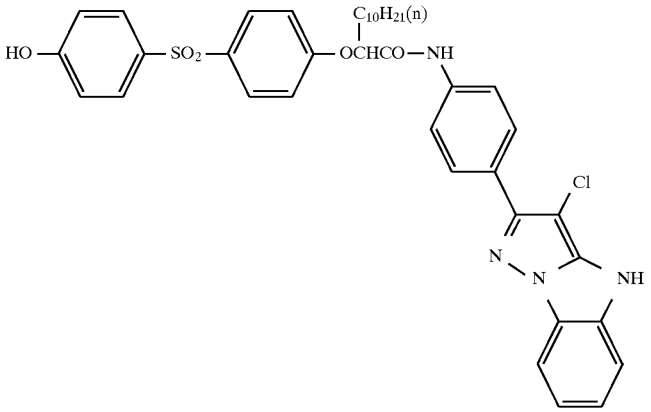
(C-32)
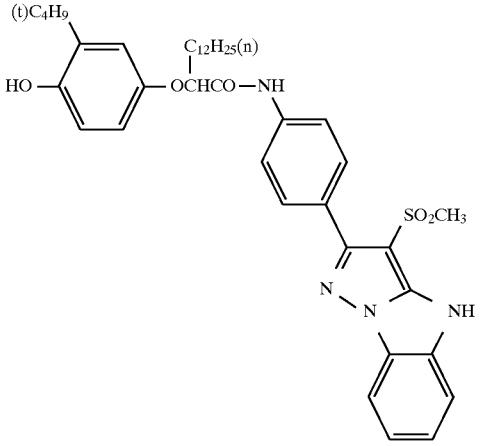
(C-33)
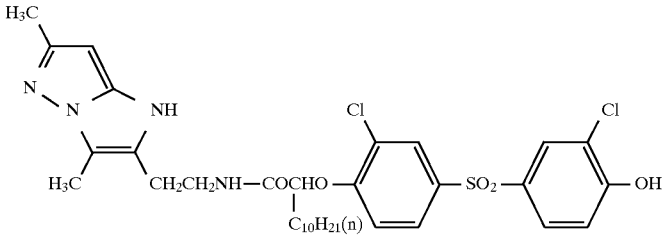

-continued
(C-34)
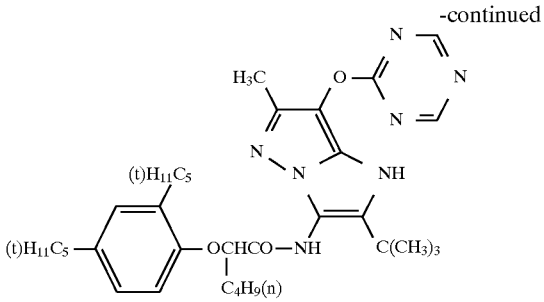
(C-35)
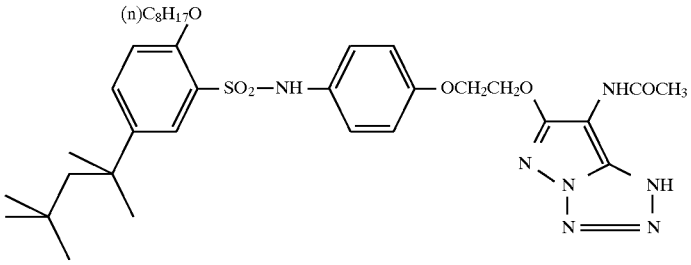
(C-36)
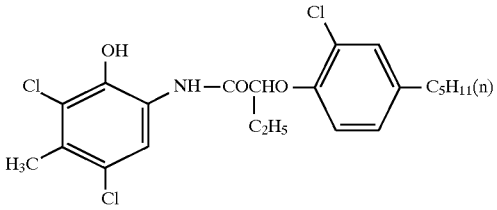
(C-37)
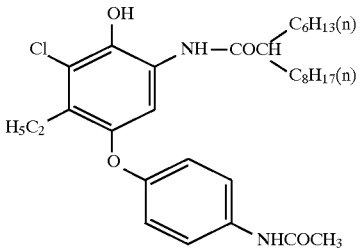
(C-38)
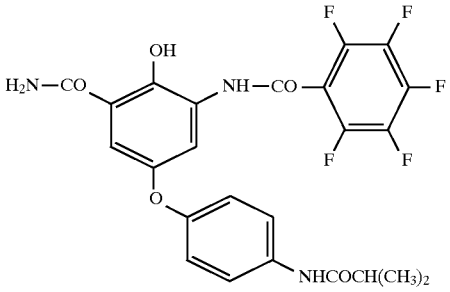
(C-39)
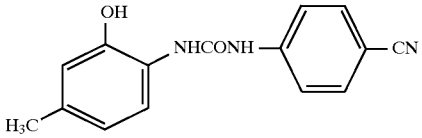
(C-40)
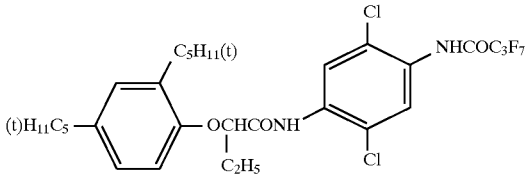

-continued
(C-41)
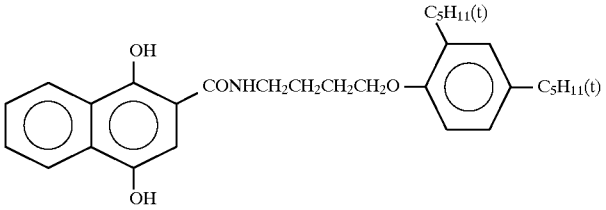
(C-42)
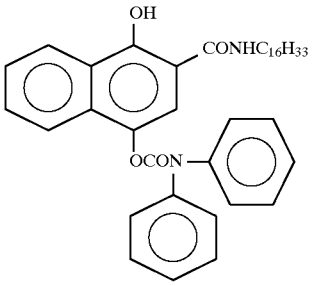
(C-43)
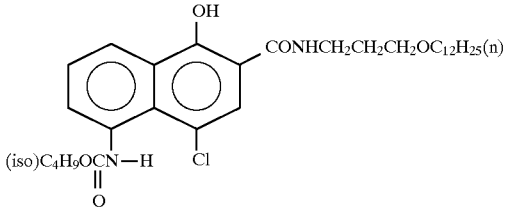
(C-44)
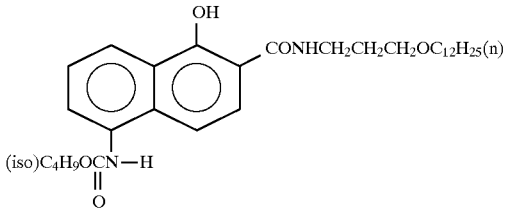
(C-45)
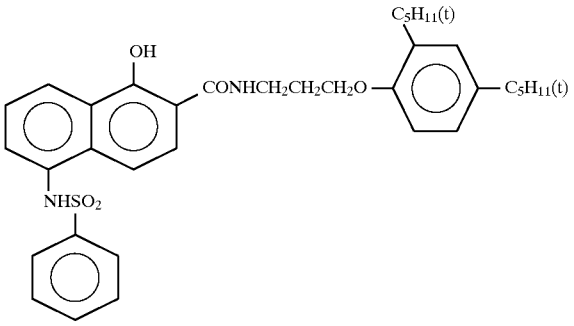

-continued
(C-46)
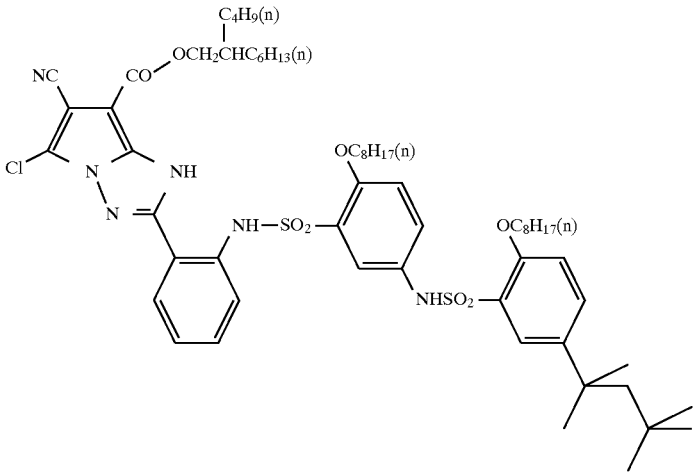
(C-47)
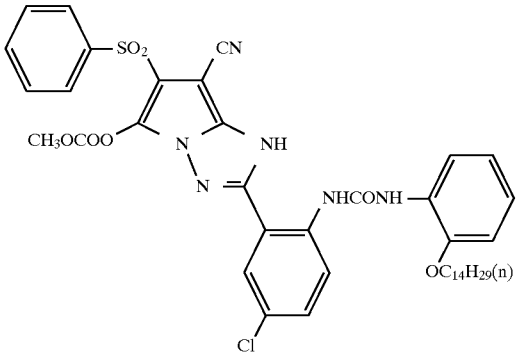
(C-48)
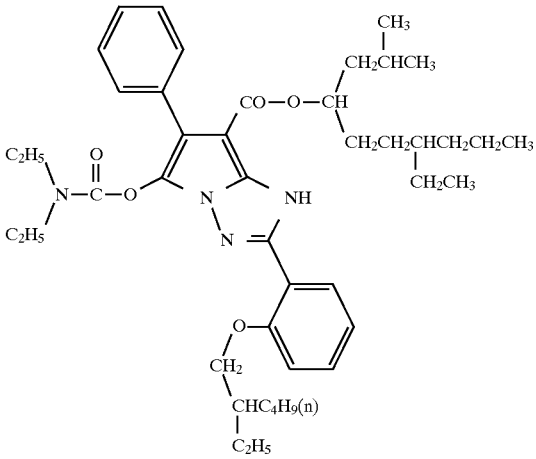
(C-49)
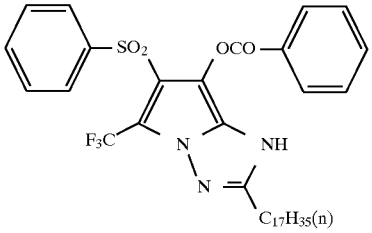

-continued
(C-50)
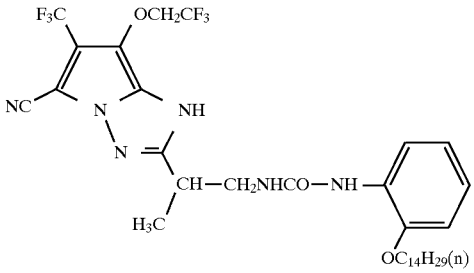
(C-51)
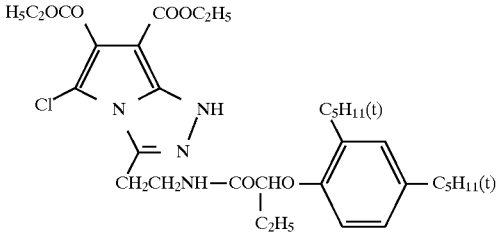
(C-52)
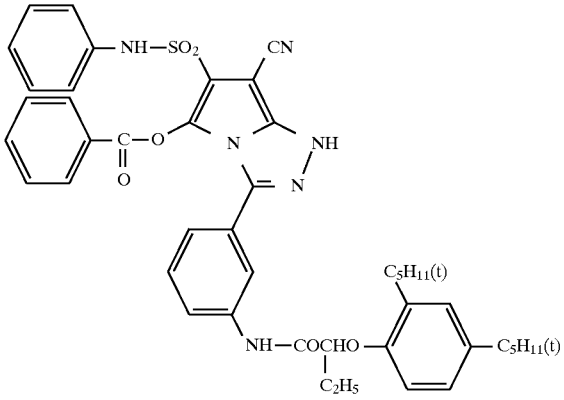
(C-53)
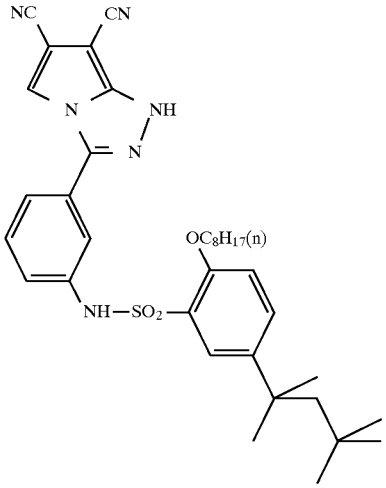

-continued
(C-54)
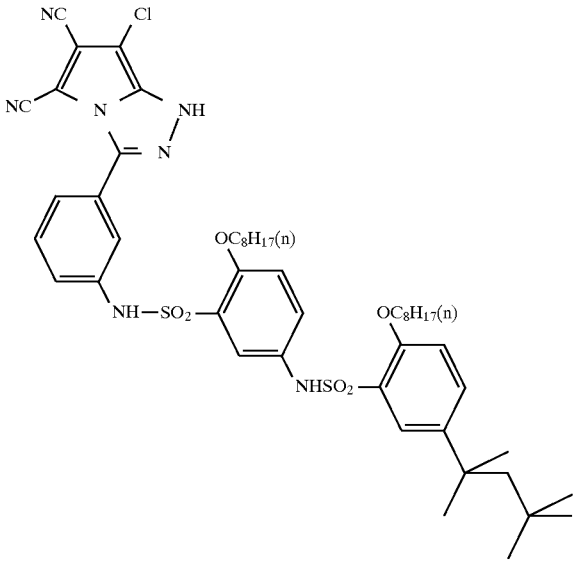
(C-55)
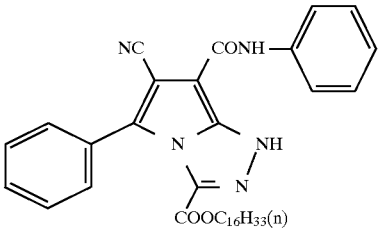
(C-56)
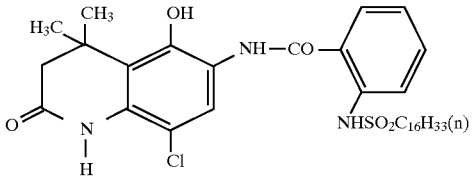
(C-57)
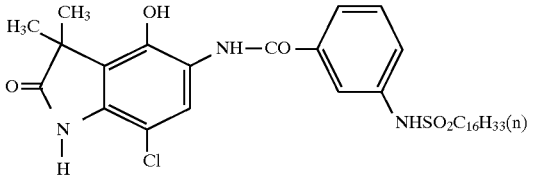
(58)
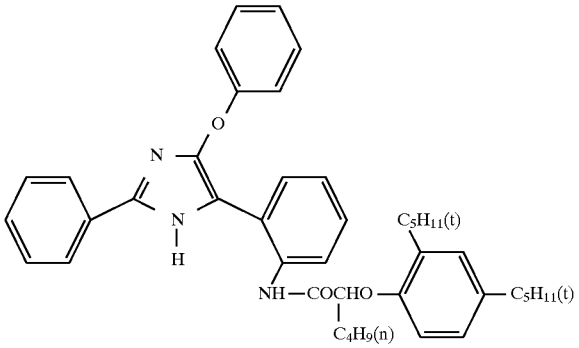

-continued
(C-59)
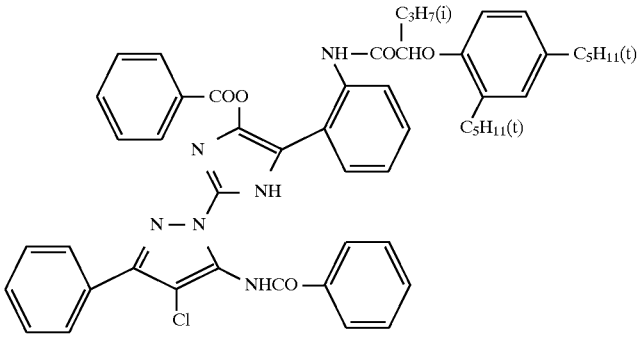
(C-60)
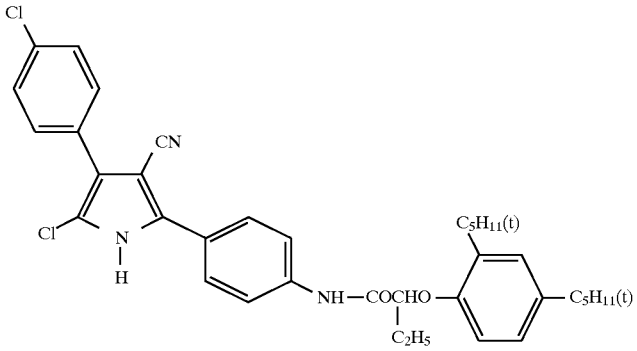
(C-61)
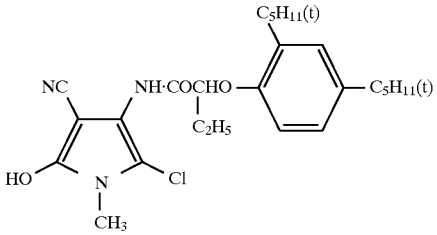
(C-62)
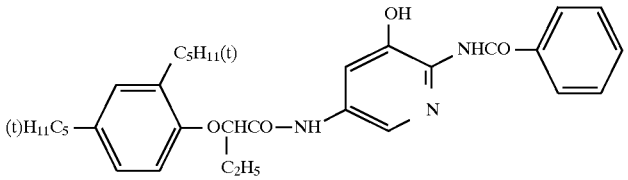
(C-63)
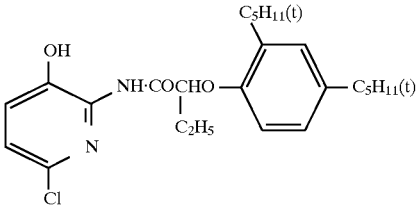
(C-64)
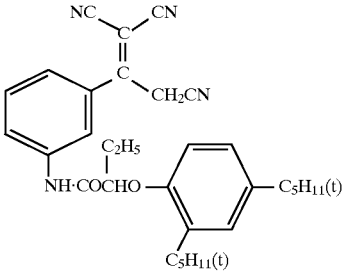

-continued
(C-65)
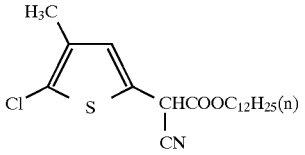
(C-66)
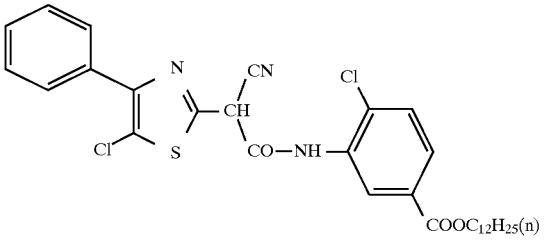
(C-67)
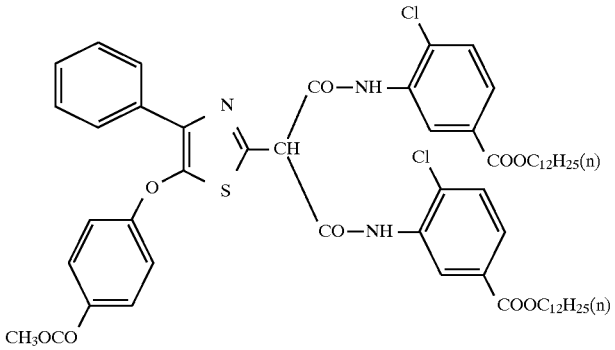
(C-68)
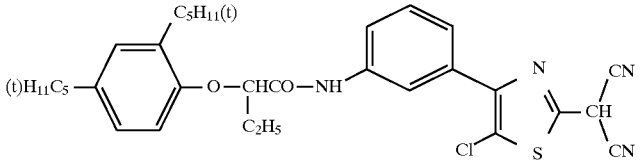
(C-69)
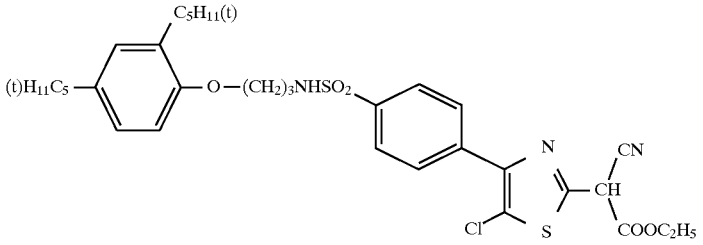
(C-70)
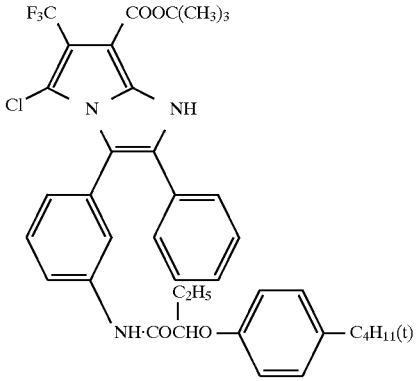

-continued
(C-71)
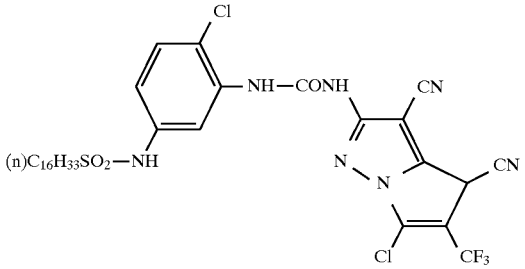
(C-72)
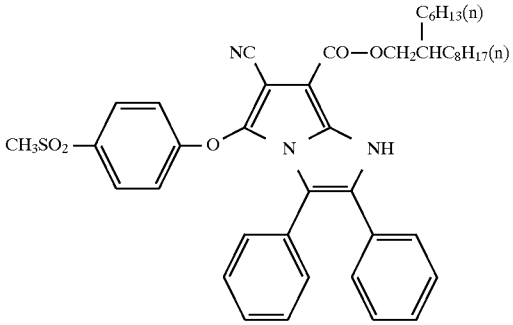
(C-73)
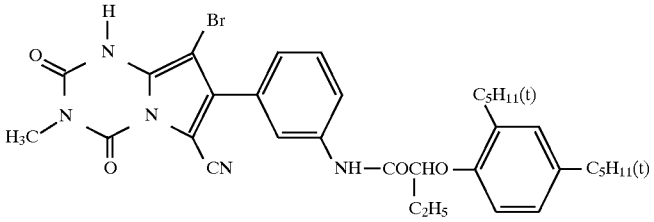
(C-74)
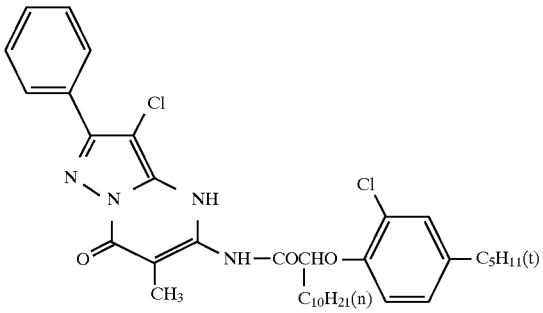
(C-75)
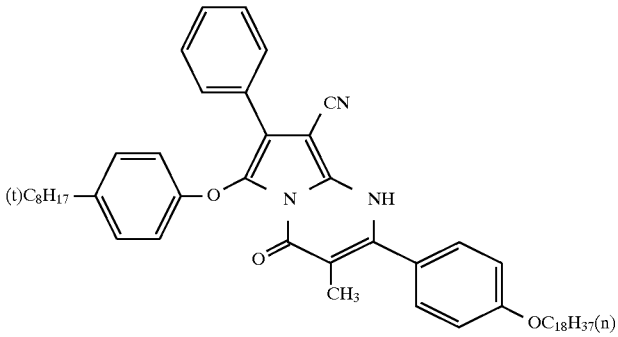
(C-76)
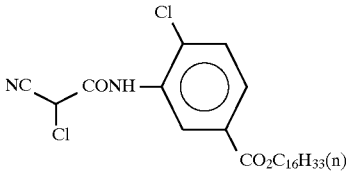

-continued (C-77)

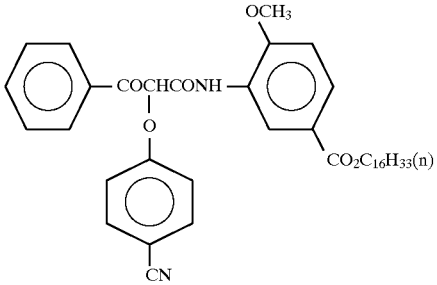

(C-78)

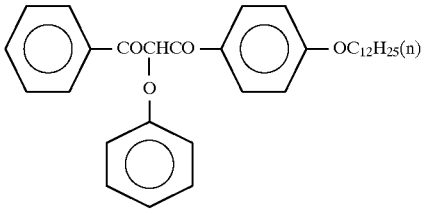

(C-79)

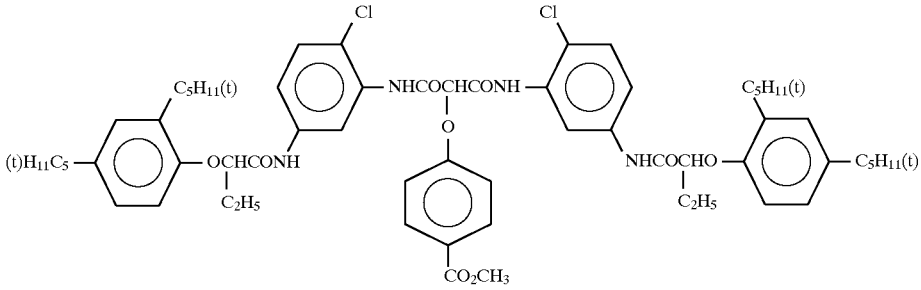

(C-80)

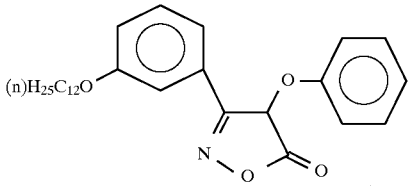

(C-79)

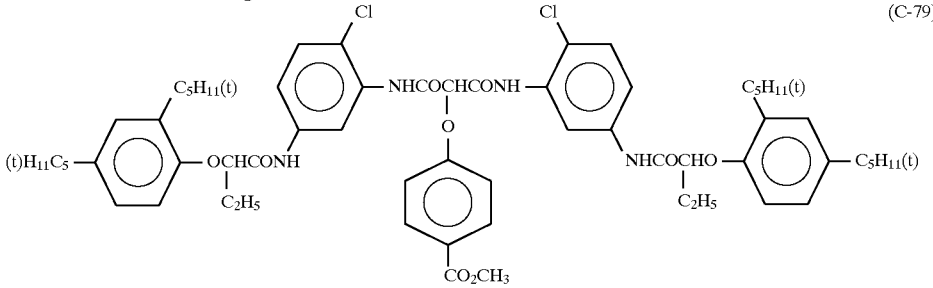

(C-80)

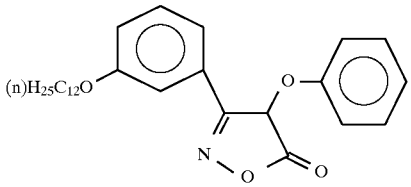

In the present invention, the color-forming reducing agent is preferably used in an amount of 0.01 mmol/$m^2$ to 10 mmol/$m^2$ per one color-forming layer, in order to obtain satisfactory color density. More preferably the amount to be used is 0.05 mmol/$m^2$ to 5 mmol/$m^2$, and particularly preferably 0.1 mmol/$m^2$ to 1 mmol/$m^2$.

A preferable amount of the coupler to be used in the color-forming layer in which the color-forming reducing agent according to the present invention is used, is 0.05 to 20 times, more preferably 0.1 to 10 times, and particularly preferably 0.2 to 5 times, the amount of the color-forming reducing agent in terms of mol.

The color light-sensitive material for use in the present invention basically comprises photographic constitutional layers including at least one hydrophilic colloidal layer coated on a support; and a light-sensitive silver halide, a dye-forming coupler, and a color-forming reducing agent are contained in one or more photographic constitutional layers.

The dye-forming coupler and the color-forming reducing agent used in the present invention are added to an identical layer, in the most typical embodiment, but they can be added divisionally into separate layers, as long as they can react with each other. These ingredients are preferably added to a silver halide emulsion layer or a layer adjacent therewith in the light-sensitive material, and particularly preferably they are added together to an identical silver halide emulsion layer.

The color-forming reducing agent and the coupler for use in the present invention can be introduced into the light-sensitive material by various known dispersion methods. Preferably the oil-in-water dispersion method is used, in which they are dissolved in a high-boiling organic solvent (and, if necessary, together with a low-boiling organic solvent), the solution is emulsified and dispersed in an aqueous gelatin solution, and the emulsified dispersion is added to a silver halide emulsion. The high-boiling organic solvent to be used in the present invention can be a compound nonmiscible with water, and having a melting point of 100° C. or below and a boiling point of 140° C. or higher, that is a good solvent for the color-forming reducing agents and couplers. The melting point of the high-boiling organic solvent is preferably 80° C. or below. The boiling point of the high-boiling organic solvent is preferably 160° C. or over, and more preferably 170° C. or over. Details of these high-boiling organic solvents are described in JP-A-62-215272, page 137, right lower column, to page 144, right upper column. In the present invention, when the high-boiling organic solvent is used, the amount of the high-boiling organic solvent to be used may be any amount, but preferably the amount is such that the weight ratio of the high-boiling organic solvent to the color-forming reducing agent is from 20 or less: 1, more preferably from 0.02 to 5:1, and particularly preferably from 0.2 to 4:1.

Further, in the present invention, known polymer dispersion methods can be used. Specific examples of steps, effects, and latexes for impregnation of the latex dispersion method, which is one polymer dispersion method, are described, for example, in U.S. Pat. No. 4,199,363, West Germany Patent Application (OLS) Nos. 2,541,274 and 2,541,230, JP-B-53-41091 ("JP-B" means examined Japanese patent publication), and EP-029104. As more preferable method, a dispersion method using a water-insoluble and organic solvent-soluble polymer is described in WO-A-88/00723.

The average particle size of the lipophilic fine particles containing the color-forming reducing agent for use in the present invention is not particularly limited, but, in view of the color-forming property, the average particle size is preferably 0.05 to 0.3 $\mu$m, and more preferably 0.05 to 0.2 $\mu$m.

To make the average particle size of lipophilic fine particles small is generally accomplished, for example, by choosing a type of surface-active agent, by increasing the amount of the surface-active agent to be used, by elevating the viscosity of the hydrophilic colloid solution, by lowering the viscosity of the lipophilic organic layer, through use of an additional low-boiling organic solvent, by increasing the rotational frequency of the stirring blades of an emulsifying apparatus, to increase the shearing force, or by prolonging the emulsifying time.

The particle size of lipophilic fine particles can be measured by an apparatus, such as a Nanosizer (trade name, manufactured by British Coulter Co.).

In the present invention, when the dye that is produced from the color-forming reducing agent and the dye-forming coupler is a diffusible dye, preferably a mordant is added to the light-sensitive material. If the present invention is applied to such a mode, it is not required to dip the material in an alkali to form color, and therefore image stability after processing is remarkably improved. Although the mordant for the use in the present invention can be used in any layer, if the mordant is added to a layer containing the color-forming reducing agent for use in the present invention, the stability of the color-forming reducing agent is deteriorated. Therefore preferably the mordant is used in a layer that does not contain the color-forming reducing agent. Further, the dye that is produced from a color-forming reducing agent and a coupler diffuses into the gelatin film that has been swelled during the processing, to dye the mordant. Therefore, in order to obtain good sharpness, the shorter the diffusion distance is, the more preferred it is. Accordingly, the layer to which the mordant is added is preferably a layer adjacent to the layer containing the color-forming reducing agent.

Further, in this case, since the dye that is produced from the color-forming reducing agent and the coupler for use in the present invention is a water-soluble dye, there is a possibility that the dye may flow out into the processing solution. Therefore, to prevent this, preferably the layer to which the mordant is added, is situated on the same side on the base and opposite to (more remote from the base than) the layer containing the color-forming reducing agent. However, when a barrier layer, as described in JP-A-7-168335, is provided on the same side on the base and opposite to (more remote from the base than) a layer in which the mordant is added, also preferably the layer in which the mordant is added, is situated on the same side of the base as and nearer to the base than the layer containing the color-forming reducing agent.

The mordant for use in the present invention may also be added to several layers, and in particular, when several layers contain the color-forming reducing agent, also preferably the mordant is added to each layer adjacent thereto.

The coupler that forms a diffusible dye may be any coupler that results in a diffusible dye formed by coupling with the color-forming reducing agent for use in the present invention, the resultant diffusible dye being capable of reaching the mordant. Preferably the coupler is a coupler that results in a diffusible dye having one or more dissociable groups with a pKa (an acid dissociation constant) of 12 or less, more preferably 8 or less, and particularly preferably 6 or less. Preferably the molecular weight of the diffusible dye that will be formed is 200 or more but 2,000 or less. Further, preferably the ratio (the molecular weight of the dye that will be formed/the number of dissociable groups with a pKa of 12 or less) is 100 or more but 2,000 or less, and more preferably 100 or more but 1,000 or less. Herein the value of pKa is the value measured by using, as a solvent, dimethylformamide/water (1:1).

The coupler that forms a diffusible dye is preferably one that results in a diffusible dye formed by coupling with the color-forming reducing agent for use in the present invention, the resultant diffusible dye being dissolvable in an alkali solution having a pH of 11 in an amount of $1\times10^{-6}$ mol/liter or more, more preferably $1\times10^{-5}$ mol/liter or more, and particularly preferably $1\times10^{-4}$ mol/liter or more, at 25° C. Further, the coupler that forms a diffusible dye is preferably one that results in a diffusible dye formed by coupling with the color-forming reducing agent for use in the present invention, the resultant diffusible dye having a diffusion constant of $1\times10^{-8}$ $m^2/s^{-1}$ or more, more preferably $1\times10^{-7}$ $m^2/s^{-1}$ or more, and particularly preferably $1\times10^{-6}$ $m^2/s^{-1}$ or more, at 25° C. when dissolved in an alkali solution of pH 11, at a concentration of $10^{-4}$ mol/liter.

The mordant that can be used in the present invention can be suitably chosen from among mordants that are usually used, and among them, in particular, polymer mordants are preferable. Herein, by polymer mordant is meant polymers having a tertiary amino group, polymers having a nitrogen-containing heterocyclic moiety, polymers containing a quaternary cation group thereof, etc.

Preferable specific examples of homopolymers and copolymers containing vinyl monomer units with a tertiary imidazole group are described, for example, in U.S. Pat. Nos. 4,282,305, 4,115,124, and 3,148,061 and JP-A-60-118834, 60-122941, 62-244043, and 62-244036.

Preferable specific examples of homopolymers and copolymers containing vinyl monomer units with a quaternary imidazolium salt are described, for example, in GB-2 056 101, 2 093 041, and 1 594 961, U.S. Pat. Nos. 4,124,386, 4,115,124, and 4,450,224, and JP-A-48-28325.

Further, preferable specific examples of homopolymers and copolymers having vinyl monomer units with a quaternary ammonium salt are described, for example, in U.S. Pat. Nos. 3,709,690, 3,898,088, and 3,958,995, and JP-A-60-57836, 60-60643, 60-122940, 60-122942, and 60-235134.

Further, vinylpyridine polymers and vinylpyridinium cation polymers, as disclosed, for example, in U.S. Pat. Nos. 2,548,564, 2,484,430, 3,148,161, and 3,756,814; polymer mordants capable of being crosslinked to gelatin or the like, as disclosed, for example, in U.S. Pat. Nos. 3,625,694, 3,859,096, and 4,128,538, and GB-1 277 453; aqueous sol-type mordants, as disclosed, for example, in U.S. Pat. Nos. 3,958,995, 2,721,852, and 2,798,063, and JP-A-54-115228, 54-145529, and 54-26027; water-insoluble mordants, as disclosed in U.S. Pat. No. 3,898,088; reactive mordants capable of covalent bonding to dyes, as disclosed in U.S. Pat. No. 4,168,976 (JP-A-54-137333); and mordants disclosed in U.S. Pat. Nos. 3,709,690, 3,788,855, 3,642,482, 3,488,706, 3,557,066, and 3,271,147, and JP-A-50-71332, 53-30328, 52-155528, 53-125, and 53-1024, can all be mentioned.

Still further, mordants described in U.S. Pat. Nos. 2,675316 and 2,882,156 can be mentioned.

The molecular weight of the polymer mordants for use in the present invention is suitably generally 1,000 to 1,000,000, and particularly preferably 10,000 to 200,000.

The above polymer mordants are used generally by mixing them with a hydrophilic colloid. As the hydrophilic colloid, a hydrophilic colloid and/or a highly hygroscopic polymer can be used, and gelatin is most typically used. The mixing ratio of the polymer mordant to the hydrophilic colloid, and the coating amount of the polymer mordant, can be determined easily by those skilled in the art in accordance with the amount of the dye to be mordanted, the type and composition of the polymer mordant, and the image formation process to be used. Suitably the mordant/hydrophilic colloid ratio is generally from 20/80 to 80/20 (by weight), and the coating amount of the mordant is suitably generally 0.2 to 15 $g/m^2$, and preferably 0.5 to 8 $g/m^2$, for use.

In the present invention, preferably an auxiliary developing agent and/or a precursor thereof can be used in the light-sensitive material. These compounds are explained below.

The auxiliary developing agent used in the present invention is a compound that has an action to promote electric movement from the color-forming reducing agent to silver halides in the development step of silver halide particles. Preferably the auxiliary developing agent is a compound that can cause development of silver halide particles exposed to light, and the oxidization product of the compound can oxidize a color-forming reducing agent (hereinafter referred to as cross oxidation).

As the auxiliary developing agent for use in the present invention, pyrazolidones, dihydroxybenzenes, reductones, or aminophenols can be used preferably, with pyrazolidones being used particularly preferably. Preferably that the diffusibility of these compounds in a hydrophilic colloidal layer is low, and, for example, the solubility to water (25° C.) is preferably 0.1% or below, more preferably 0.05% or below, and particularly preferably 0.01% or below. The precursor of the auxiliary developing agent used in the present invention is a compound that is present stably in the light-sensitive material, but it rapidly releases the auxiliary developing agent after it has been processed by a processing solution. Also in a case of using the compound, preferably the diffusibility in the hydrophilic colloidal layer is low. For example, the solubility to water (25° C.) is preferably 0.1% or below, more preferably 0.05% or below, and particularly preferably 0.01% or below. There is no particular restriction on the solubility of the auxiliary developing agent released from the precursor, but preferably the solubility of the auxiliary developing agent itself is low.

As an auxiliary developing agent precursor for use in the present invention, compounds described in JP-A-7-63572 may be preferably used.

Specific example of the auxiliary developing agent and its precursor are shown below, but, of cause, the compounds for use in the present invention are not limited to them.

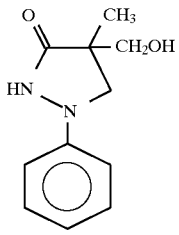

(ETA-1)

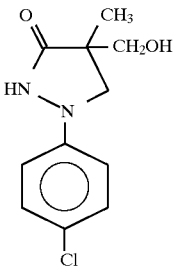

(ETA-2)

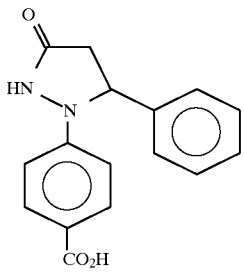

(ETA-3)

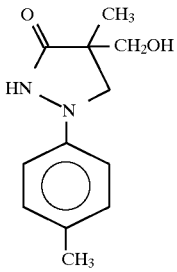

(ETA-4)

-continued
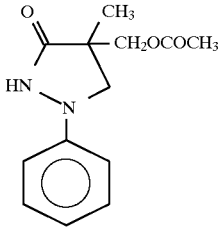
(ETA-5)
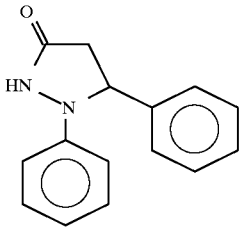
(ETA-6)
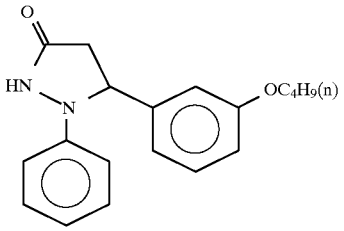
(ETA-7)
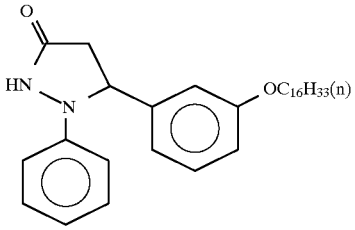
(ETA-8)
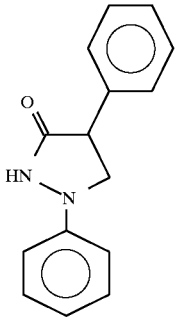
(ETA-9)
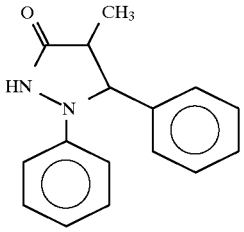
(ETA-10)
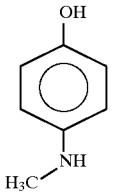
(ETA-11)
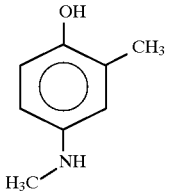
(ETA-12)
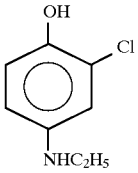
(ETA-13)
-continued
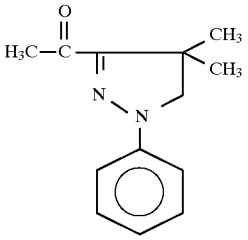
(ETA-14)
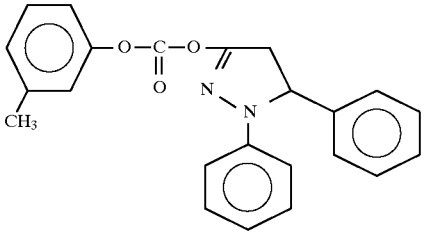
(ETA-15)
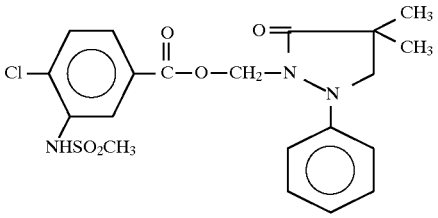
(ETA-16)
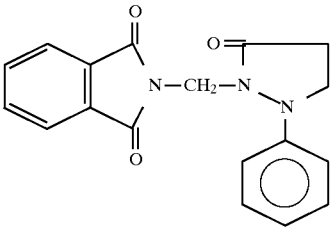
(ETA-17)
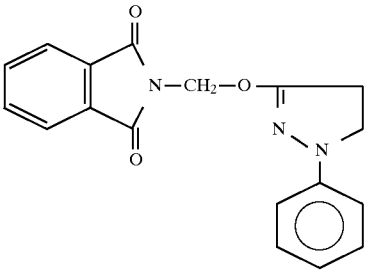
(ETA-18)
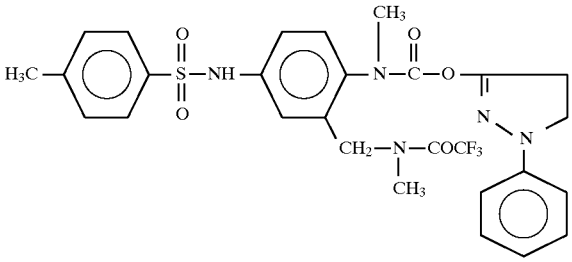
(ETA-19)

-continued

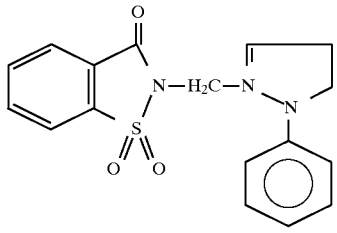

(ETA-20)

The above compound may be added to any of the light-sensitive layer, an intermediate layer, an undercoat layer, and a protective layer of a light-sensitive material, and preferably it is added to and used in a non-light-sensitive layer.

The methods of incorporating the compound into the light-sensitive material include, for example, a method of dissolving the compound in a water-miscible organic solvent, such as methanol, and directly adding this to a hydrophilic colloidal layer; a method of forming an aqueous solution or a colloidal dispersion of the compound, with a surface-active agent also contained, and adding the same; a method of dissolving the compound into a solvent or oil substantially immiscible with water, and then dispersing the solution into water or a hydrophilic colloid, and then adding the same; or a method of adding the compound, in a state of a dispersion of fine solid particles. The known methods may be applied singly or in combination. A method of preparing a dispersion of solid fine particles is described in detail on page 20 in JP-A-2-235044.

The amount of the compound to be added in a light sensitive material is generally 1 mol % to 200 mol %, preferably 5 mol % to 100 mol %, and more preferably 10 mol % to 50 mol %, based on the color-forming reducing agent.

As the support to be used in the present invention, any support can be used if it is a transmissible support or reflective support, on which a photographic emulsion layer can be coated, such as glass, paper, and plastic film. As the plastic film to be used in the present invention, for example, polyester films made, for example, of polyethylene terephthalates, polyethylene naphthalates, cellulose triacetate, or cellulose nitrate; polyamide films, polycarbonate films, and polystyrene films can be used.

"The reflective support" that can be used in the present invention refers to a support that increases the reflecting properties to make bright the dye image formed in the silver halide emulsion layer. Such a reflective support includes a support coated with a hydrophobic resin containing a light-reflecting substance, such as titanium oxide, zinc oxide, calcium oxide, and calcium sulfate, dispersed therein, or a support made of a hydrophobic resin itself containing a dispersed light-reflecting substance. Examples are a polyethylene-coated paper, a polyester-coated paper, a polypropylene-series synthetic paper, a support having a reflective layer or using a reflecting substance, such as a glass sheet; a polyester film made, for example, of a polyethylene terephthalate, cellulose triacetate, or cellulose nitrate; a polyamide film, a polycarbonate film, a polystyrene film, and a vinyl chloride resin. As the polyester-coated paper, particularly a polyester-coated paper whose major component is a polyethylene terephthalate, as described in EP-0 507 489, is preferably used.

The reflective support to be used in the present invention is preferably a paper support, both surfaces of which are coated with a water-resistant resin layer, and at least one of the water-resistant resin layers contains fine particles of a white pigment. Preferably the particles of a white pigment are contained in a density of 12% by weight or more, and more preferably 14% by weight or more. Preferably the light-reflecting white pigment is kneaded well in the presence of a surface-active agent, and the surface of the pigment particles is preferably treated with a dihydric to tetrehydric alcohol.

In the present invention, a support having the second kind diffuse reflective surface can also be used, preferably. "The second kind diffuse reflectivity" means diffuse reflectivity obtained by making a specular surface uneven, to form finely divided specular surfaces facing different directions. The unevenness of the second kind diffuse reflective surface has a three-dimensional average coarseness of generally 0.1 to 2 $\mu$m, and preferably 0.1 to 1.2 $\mu$m, for the center surface. Details about such a support are described in JP-A-2-239244.

In order to obtain colors ranging widely on the chromaticity diagram by using three primary colors: yellow, magenta, and cyan, use is made of a combination of at least three silver halide emulsion layers photosensitive to respectively different spectral regions. For examples, a combination of three layers of a blue-sensitive layer, a green-sensitive layer, and a red-sensitive layer, and a combination of three layers of a green-sensitive layer, a red-sensitive layer, and an infrared-sensitive layer, and the like can be coated on the above support. The photosensitive layers can be arranged in various orders known generally for color light-sensitive materials. Further, each of these light-sensitive layers can be divided into two or more layers if necessary.

In the light-sensitive material, photographic constitutional layers comprising the above photosensitive layers and various non-photosensitive layers, such as a protective layer, an underlayer, an intermediate layer, an antihalation layer, and a backing layer, can be provided. Further, in order to improve the color separation, various filter dyes can be added to the photographic constitutional layer.

As a binder or a protective colloid that can be used in the light-sensitive material according to the present invention, a gelatin is advantageously used, and other hydrophilic colloids can be used alone or in combination with a gelatin. The calcium content of gelatin is preferably 800 ppm or less, and more preferably 200 ppm or less. The iron content of gelatin is preferably 5 ppm or less, and more preferably 3 ppm or less. Further, in order to prevent the proliferation of various molds and bacteria that will proliferate in a hydrophilic colloid layer to deteriorate an image, preferably mildew-proofing agents, as described in JP-A-63-271247, are added.

When the light-sensitive material for use in the present invention is subjected to printer exposure, it is preferable to use a band stop filter described in U.S. Pat. No. 4,880,726, by which light-color-mixing can be removed, to noticeably improve color reproduction.

The light-sensitive material for use in the present invention is used in a print system using usual negative printers, and also it is preferably used for digital scanning exposure that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is desired to use a semiconductor laser for at least one of the exposure light sources.

If such a scanning exposure light source is used, the spectral sensitivity maximum of the light-sensitive material for use in the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the light-sensitive material can be present in each of the usual three regions, the blue region, the green region and the red region. In order to use a semiconductor laser as a light source to make the apparatus inexpensive, high in stability, and compact, preferably each of at least two layers has a spectral sensitivity maximum at 670 nm or over. This is because the emitting wavelength range of the available, inexpensive, and stable III–V group semiconductor laser is present now only in from the red region to the infrared region. However, on the laboratory level, the oscillation of a II–VI group semiconductor laser in the green or blue region is confirmed and it is highly expected that these semiconductor lasers can be used inexpensively and stably if production technique for the semiconductor lasers be developed. In that event, the necessity that each of at least two layers has a spectral sensitivity maximum at 670 nm or over becomes lower.

In such scanning exposure, the time for which the silver halide in the light-sensitive material is exposed to light is the time for which a certain very small area is required to be exposed to light. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is generally from 50 to 2,000 dpi. If the exposure time is defined as the time for which a picture element size is exposed to light with the density of the picture element being 400 dpi, preferably the exposure time is $10^{-4}$ sec or less, more preferably $10^{-6}$ sec or less. There is no particular restriction on the lower limit of the exposure time, but preferably the exposure time is $10^{-8}$ sec or more.

The silver halide grains used in the present invention are made of silver bromide, silver chloride, silver iodide, silver chlorobromide, silver chloroiodide, silver iodobromide, or silver chloroiodobromide. Other silver salts, such as silver rhodanate, silver sulfide, silver selenide, silver carbonate, silver phosphate, or a silver salt of an organic acid, may be contained in the form of independent grains or as part of silver halide grains. If it is desired to make the development/desilvering (bleaching, fixing, and bleach-fix) step rapid, a so-called high-silver-chloride grains having the silver chloride content of 90 mol % or more are desirable. Further, if the development is to be restrained moderately, it is preferable to contain silver iodide. The preferable silver iodide content varies depending on the intended light-sensitive material.

In the high-silver-chloride emulsion used in the present invention, preferably there is provided a silver bromide localized phase having a layered structure or a non-layered structure in each silver halide grain and/or on each silver halide grain surface. The halogen composition of the localized phase has a silver bromide content of preferably at least 10 mol %, and more preferably over 20 mol %. Silver bromide contents of silver bromide localized phase can be analyzed by using a method such as X-ray diffraction (described in such books as "Shin-jikken Kagaku-koza 6/Kozo Kaiseki", edited by Nohonkagakukai, Maruzen). Further, these localized phase can be formed in the grain, at the edges, corners, or planes of surface of grain, as one of preferable examples, a phase which formed epitaxially on a corner of grain can be mentioned.

Further, for the purpose of lowering the replenishing rate of the development processing solution, it is also effective to increase the silver chloride content of the silver halide emulsion further. In such a case, an emulsion of almost pure silver chloride, having a silver halide content, for example, of 98 to 100 mol %, is also preferably used.

The grains of the silver halide emulsion for use in the present invention preferably have a distribution or a structure with respect to the halogen composition. Typical examples thereof are disclosed in JP-B-43-13162 and in JP-A-61-215540, 60-222845, 60-143331, 61-75337, and 60-222844.

In order to make the inside of grains have a structure, not only the enclosing structure, as mentioned above, but also a so-call junctioned structure can be used to form grains. Examples thereof are disclosed, for example, in JP-A-59-133540 and 58-108526, EP-A-199 290 (A2), JP-B-58-24772, and JP-A-59-16254.

In the case of a Functioned structure, not only a combination of silver halides but also a combination of a silver halide with a silver salt compound having no rock salt structure, such as silver rhodanate and silver carbonate, can be used for the Functioned structure.

In the case of grains of silver iodobromide or the like having these structures, a preferable mode is that the core part is higher in silver iodide content than the shell part. Reversely, in some cases, grains having a lower silver iodide content in the core part than in the shell part are preferable. Similarly, in the case of grains having a junctioned structure, the silver iodide content of the host crystals is relatively higher than that of the junctioned crystals, or this may be reversed. The boundary part of the grains having these structures in which different halogen compositions are present, may be distinct or indistinct. Also preferable is a mode wherein the composition is continuously changed positively.

It is important that in the case of that two or more silver halides are present as mixed crystals, or as silver halide grains having structures, the halogen composition distribution between grains is controlled. The method of measuring the halogen composition distribution between grains is described in JP-A-60-254032. In particular, a highly uniform emulsion having a deviation coefficient of the halogen composition distribution of 20% or below is preferable.

It is important to control the silver halide composition near the surface of grains. An increase in the silver iodide content or the silver chloride content at the part near the surface changes the adsorption of a dye or the developing speed. Therefore the silver halide composition can be chosen in accordance with the purpose.

In the silver halide grains used in the present invention, in accordance with the purpose, any of regular crystals having no twin plane, and those described in "Shashin Kogyo no Kiso, Ginen Shashin-hen", edited by Nihon Shashin-gakkai (Corona Co.), page 163 (1979), such as single twins having one twin plane, parallel multiple twins having two or more parallel twin planes, and nonparallel multiple twins having two or more nonparallel twin planes, can be chosen and used. An example in which grains different in shape are mixed is disclosed in U.S. Pat. No. 4,865,964, and if necessary this method can be chosen. In the case of regular crystals, cubes having (100) planes, octahedrons having (111) planes, and dodecahedral grains having (110) planes, as disclosed in JP-B-55-42737 and JP-A-60-222842, can be used. Further, (hlm) plane grains as reported in "Journal of Imaging Science", Vol. 30, page 247 (1986), can be chosen and used in accordance with the purpose. Grains having two or more planes in one grain, such as tetradecahedral grains having (100) and (111) planes in one grain, grains having (100) and (110) planes in one grain, or grains having (111) and (110) planes in one grain, can be chosen and used in accordance with the purpose.

The average aspect ratio of 80% or more of all the projected areas of grains is desirably generally 1 or more but less than 100, more preferably 2 or more but less than 20, and particularly preferably 3 or more but less than 10. As the shape of tabular grains, a triangle, a hexagon, a circle, and the like can be chosen. A regular hexagonal shape having six approximately equal sides, described in U.S. Pat. No. 4,797 354, is a preferable mode.

In many cases, the grain size of tabular grains is expressed by the diameter of the projected area assumed to be a circle, and grains having an average diameter of 0.6 microns or below, as described in U.S. Pat. No 4,748,106, are preferable, because the quality of the image is made high. An emulsion having a narrow grain size distribution, as described in U.S. Pat. No. 4,775,617, is also preferable. It is preferable to restrict the shape of tabular grains so that the thickness of the grains may be 0.5 microns or below, and more preferably 0.3 microns or below, because the sharpness is increased. Further, an emulsion in which the grains are highly uniform in thickness, with the deviation coefficient of grain thickness being 30% or below, is also preferable. Grains in which the thickness of the grains and the plane distance between twin planes are defined, as described in JP-A-63-163451, are also preferable.

In accordance with the purpose, it is preferable to choose grains having no dislocation lines, grains having several dislocation lines, or grains having many dislocation lines. Dislocation introduced straight in a special direction in the crystal orientation of grains, or curved dislocation, can be chosen, and it is possible to choose from, for example, dislocation introduced throughout grains, and dislocation introduced in a particular part of grains, such as dislocation introduced limitedly to the fringes of grains. In addition to the case of introduction of dislocation lines into tabular grains, also preferable is the case of introduction of dislocation lines into regular crystalline grains or irregular grains, represented by potato grains.

The silver halide emulsion used in the present invention may be subjected to a processing for making grains round, as disclosed, for example, in EP-B-96 727 (B1) and 64 412 (B1), or it may be improved in the surface, as disclosed in West Germany Patent No. 2,306,447C2 and JP-A-60-221320.

Generally, the grain surface has a flat structure, but it is also preferable in some cases to make the grain surface uneven intentionally. Examples are described in JP-A-58-106532, 60-221320, and U.S. Pat. No. 4,643,966.

The grain size of the emulsion used in the present invention is evaluated, for example, by the diameter of the projected area equivalent to a circle (the diameter of a circle assuming the projected area to be the circle) using an electron microscope; by the diameter of the grain volume equivalent to a sphere, calculated from the projected area and the grain thickness; or by the diameter of a volume equivalent to a sphere, using the Coulter Counter method. A selection can be made from ultrafine grains having a sphere-equivalent diameter (the diameter of a sphere assuming the grain volume to be a sphere) of 0.01 microns or below, and coarse grains having a sphere-equivalent diameter of 10 microns or more. Preferably grains of 0.1 microns or more but 3 microns or below are used as photosensitive silver halide grains.

As the emulsion used in the present invention, an emulsion having a wide grain size distribution, that is, a so-called polydisperse emulsion, or an emulsion having a narrow grain size distribution, that is, a so-called monodisperse emulsion, can be chosen and used in accordance with the purpose. As the scale for representing the size distribution, the diameter of the projected area of the grain equivalent to a circle, or the deviation coefficient of the sphere-equivalent diameters, is used. If a monodisperse emulsion is used, it is suitable to use an emulsion having such a size distribution that the deviation coefficient is generally 25% or below, more preferably 20% or below, and further more preferably 15% or below.

Further, in order to allow the photographic material to satisfy the intended gradation, in an emulsion layer having substantially the same color sensitivity, two or more monodisperse silver halide emulsions different in grain size are mixed and applied to the same layer or are applied as overlaid layers. Further, two or more polydisperse silver halide emulsions can be used as a mixture; or they can be used to form overlaid layers; or a combination of a monodisperse emulsion and a polydisperse emulsion can be used as a mixture; or the combination can be used to form overlaid layers.

As a protective colloid and as a binder of other hydrophilic colloid layers that are used when the emulsion according to the present invention is prepared, gelatin is used advantageously, but another hydrophilic colloid can also be used.

Use can be made of, for example, a gelatin derivative, a graft polymer of gelatin with another polymer, a protein, such as albumin and casein; a cellulose derivative, such as hydroxyethylcellulose, carboxymethylcellulose, and cellulose sulfate ester; sodium alginate, a saccharide derivative, such as a starch derivative; and many synthetic hydrophilic polymers, including homopolymers and copolymers, such as a polyvinyl alcohol, a polyvinyl alcohol partial acetal, a poly-N-vinylpyrrolidone, a polyacrylic acid, a polymethacrylic acid, a polyacrylamide, a polyvinylimidazole, and a polyvinylpyrazole.

As the gelatin, in addition to lime-processed gelatin, acid-processed gelatin, and enzyme-processed gelatin described in Bull. Soc. Sci. Photo. Japan, No. 16, page 30 (1966), may also be used, and a hydrolyzate or enzymolyzate of gelatin can also be used. For the preparation of tabular grains, it is preferable to use a low-molecular-weight gelatin described in JP-A-1-158426.

When the silver halide emulsion is prepared, in accordance with the purpose, it is preferable to allow a salt of a metal ion to be present, for example, at the time when grains are formed, in the step of desalting, at the time when the chemical sensitization is carried out, or before the application. When the grains are doped, the addition is preferably carried out at the time when the grains are formed; or after the formation of the grains but before the completion of the chemical sensitization, when the surface of the grains is modified or when the salt of a metal ion is used as a chemical sensitizer. As to the doping of grains, selection can be made from a case in which the whole grains are doped, one in which only the core parts of the grains are doped, one in which only the shell parts of the grains are doped, one in which only the epitaxial parts of the grains are doped, and one in which only the substrate grains are doped. For example, Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi can be used. These metals can be added if they are in the form of a salt that is soluble at the time when grains are formed, such as an ammonium salt, an acetate, a nitrate, a sulfate, a phosphate, a hydroxide, a six-coordinate complex, and a four-coordinate complex. Examples include $CdBr_2$, $CdCl_2$, $Cd(NO_3)_2$, $Pd(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. As a ligand of the coordination compound, one can be preferably selected from halo, aquo, cyano, cyanate, thiocyanate, nitrosyl, thionitrosyl, oxo, and carbonyl. With respect to these metal compounds, only one can be used, but two or more can also be used in combination.

In some cases, a method wherein a chalcogen compound is added during the preparation of the emulsion, as described in U.S. Pat. No. 3,772,031, is also useful. In addition to S, Se, and Te, a cyanate, a thiocyanate, a selenocyanate, a carbonate, a phosphate, or an acetate may is be present.

The silver halide grains for use in the present invention can be subjected to at least one of sulfur sensitization, selenium sensitization, tellurium sensitization (these three are called chalcogen sensitization, collectively), noble metal sensitization, and reduction sensitization, in any step of the production for the silver halide emulsion. A combination of two or more sensitizations is preferable. Various types of emulsions can be produced, depending on the steps in which the chemical sensitization is carried out. There are a type wherein chemical sensitizing nuclei are embedded in grains, a type wherein chemical sensitizing nuclei are embedded at parts near the surface of grains, and a type wherein chemical sensitizing nuclei are formed on the surface. In the emulsion for use in the present invention, the location at which chemical sensitizing nuclei are situated can be selected in accordance with the purpose.

Chemical sensitizations that can be carried out preferably in the present invention are chalcogen sensitization and noble metal sensitization, which may be used singly or in combination.

In the sulfur sensitization, an unstable sulfur compound is used, and specifically, thiosulfates (e.g. hypo), thioureas (e.g. diphenylthiourea, triethylthiourea, and allylthiourea), rhodanines, mercaptos, thioamides, thiohydantoins, 4-oxo-oxazolidin-2-thions, di- or poly-sulfides, polythionic acids, and elemental sulfur, and known sulfur-containing compounds can be used. In many cases, sulfur sensitization is used in combination with noble metal sensitization.

In the selenium sensitization, known unstable selenium compounds are used, such as those described, for example, in U.S. Pat. No. 3,297,446 and 3,297,447, specific such selenium compounds are colloidal metal selenium, selenoureas (e.g. N,N-dimethylselenourea and tetramethylselenourea), selenoketones (e.g. selenoacetone), selenoamides (e.g. selenoacetamide), selenocarboxylic acids and esters, isoselenocyanates, selenides (e.g. diethylselenides and triphenylphosphine selenide), and selenophosphates (e.g. tri-p-tolylselenophosphate). In some cases, preferably the selenium sensitization is used in combination with one or both of sulfur sensitization and noble metal sensitization.

As the tellurium sensitizing agent used in the present invention, compounds described in CA-800 958, GB-1 295 462 and 1 396 696, and JP-A-2-333819 and 3-131598 can be used.

In the noble metal sensitization, a salt of a noble metal, such as gold, platinum, palladium, and iridium, can be used, and specifically gold sensitization, palladium sensitization, and a combination thereof are particularly preferable. In the case of gold sensitization, a known compound, such as chloroauric acid, potassium chloroaurate, potassium auriothiocyanate, gold sulfide, and gold selenide, can be used. The palladium compound means salts of divalent or tetravalent palladium salt. A preferable palladium compound is represented by $R_2PdX_6$ or $R_2PdX_4$, wherein R represents a hydrogen atom, an alkali metal atom, or an ammonium group; and X represents a halogen atom, i.e. a chlorine atom, a bromine atom, or an iodine atom.

As the reduction sensitizer, known reduction sensitizers can be selected and used, such as stannous salts, ascorbic acid and its derivatives, amines and polyamines, hydrazine and its derivatives, formamidinesufinic acid, sillane compounds, and boran compounds; and two or more compounds can be used in combination. As the reduction sensitizer, preferable compounds are stannous chloride, aminoiminomethanesulfinic acid (popularly called thiourea dioxide), dimethylamineboran, and ascorbic acid and its derivatives.

The chemical sensitization can be carried out in the presence of a so-called chemical sensitization auxiliary. As a useful chemical sensitization auxiliary, a compound is used that is known to suppress fogging and to increase the sensitivity in the process of chemical sensitization, such as azaindenes, azapyridazines, and azapyrimidines.

Preferably an oxidizing agent for silver is added during the process of the production of the emulsion according to the present invention. The oxidizing agent for silver refers to a compound that acts on metal silver to convert it to silver ions. Particularly useful is a compound that converts quite fine silver grains, which are concomitantly produced during the formation of silver halide grains and during the chemical sensitization, to silver ions. The thus produced silver ions may form a silver salt that is hardly soluble in water, such as a silver halide, silver sulfide, and silver selenide, or they may form a silver salt that is readily soluble in water, such as silver nitrate.

In the photographic emulsion used in the present invention, various compounds can be incorporated for the purpose of preventing fogging during the process of the production of the photographic material, during the storage of the photographic material, or during the photographic processing, or for the purpose of stabilizing the photographic performance. That is, various compounds known as antifoggants or stabilizers can be added, such as thiazoles including benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (e.g., 1-phenyl-5-mercaptotetrazole and 1-(5-methylureidphenyl)-5-mercaptotetrazole); mercaptopyrimidines; mercaptotriazines; thioketo compounds, such as oxazolinthione; and azaindenes, such as triazaindenes, tetraazaindenes (particularly 4-hydroxy-6-methyl(1,3,3a,7)tetraazaindenes), and pentaazaindenes. For examples, those described in U.S. Pat. Nos. 3,954,474 and 3,982.947, and JP-B-62-28660, can be used. A preferable compound is a compound described in JP-A-63-212932.

The photographic emulsion for use in the present invention is preferably spectrally sensitized with methine dyes or the like. Dyes that can be used include cyanine dyes, merocyanine dyes, composite cyanin dyes, composite merocyanine dyes, halopolar cyanine dyes, hemicyanine dyes, styryl dyes, and hemioxonol dyes. Particularly useful dyes are those belonging to cyanine dyes, merocyanine dyes, and composite merocyanine dyes. In these dyes, any of nuclei generally used in cyanine dyes as basic heterocyclic nuclei can be applied.

To the photographic material for use in the present invention, may be added the above-mentioned various additives, and also other various additives in accordance with the purpose.

These additives are described in more detail in Research Disclosure, Item 17643 (December 1978); Research Disclosure, Item 18176 (November 1979); and Research Disclosure, Item 307105 (November 1989), and the particular parts are given below in a table.

| Additive | RD 17643 | RD 18716 | RD 307105 |
|---|---|---|---|
| 1 Chemical sensitizers | p.23 | p.648 (right column) | p.996 |
| 2 Sensitivity-enhancing agents | — | p.648 (right column) | — |
| 3 Spectral sensitizers and Supersensitizers | pp.23–24 | pp.648 (right column)–649 (right column) | pp.996 (right column)–998 (right column) |
| 4 Brightening agents | p.24 | — | p.998 (right column) |
| 5 Antifogging agents and Stabilizers | pp.24–25 | p.649 (right column) | pp.998 (right column)–1000 (right column) |
| 6 Light absorbers, Filter dyes, and UV Absorbers | pp.25–26 | pp.649 (right column)–650 (left column) | p.1003 (left to right column) |
| 7 Stain-preventing agents | p.25 (right column) | p.650 (left to right column) | — |
| 8 Image dye stabilizers | p.25 | — | — |
| 9 Hardeners | p.26 | p.651 (left column) | pp.1004 (right column)–1005 (left column) |
| 10 Binders | p.26 | p.651 (left column) | pp.1003 (right column)–1004 (right column) |
| 11 Plasticizers and Lubricants | p.27 | p.650 (right column) | p.1006 (left to right column) |
| 12 Coating aids and Surface-active agents | pp.26–27 | p.650 (right column) | pp.1005 (left column)–1006 (left column) |
| 13 Antistatic agents | p.27 | p.650 (right column) | pp.1006 (right column)–1007 (left column) |

The total coated amount of silver of the light-sensitive material for use in the present invention is preferably 0.003 to 12 g per $m^2$ in terms of silver. In the case of transmission-type materials, such as color negative films, that amount is preferably 1 to 12 g, and more preferably 3 to 10 g. In the case of reflection-type materials, such as color print papers, that amount is preferably 0.003 to 1 g, in view of rapid processing or lowering of the replenishing rate, and in that case the amount of addition in each light-sensitive layer is preferably 0.001 to 0.4 g. In particular, when the light-sensitive material for use in the present invention is subjected to an intensification process, the amount is preferably 0.003 to 0.3 g, more preferably 0.01 to 0.1 g, and particularly preferably 0.015 to 0.05 g. In that case, the amount in each light-sensitive layer is preferably 0.001 to 0.1 g, and more preferably 0.003 to 0.03 g.

In the present invention, if the coated amount of silver in each light-sensitive layer is too small, the dissolution of silver salts progresses and a satisfactory color density cannot be obtained. On the other hand, if the coated amount of silver in each light-sensitive layer is too large when the intensification process is carried out, there will be an increase in Dmin or bubbling will occur, easily making the resultant material be deteriorated to look it appreciatively.

The total amount of gelatin of the light-sensitive material for use in the present invention is generally 1.0 to 30 g, and preferably 2.0 to 20 g, per $m^2$. In the swelling of the light-sensitive material in an alkali solution having a pH of 12, the time for the swelled film thickness to reach ½ of its saturated swelled film thickness (90% of the maximum swelled thickness) is preferably 15 sec or less, and more preferably 10 sec or less. Further, the swelling rate [(maximum swelled film thickness—film thickness)/film thickness ×100] is preferably 50 to 300%, and particularly preferably 100 to 200%.

Now the processing materials and the processing methods used in the present invention are described in detail. In the present invention, generally, the exposed light-sensitive material is subjected to an activator developing process (silver development/cross-oxidization of color-forming reducing agent), a desilvering process, and a washing process and/or a stabilizing process. However, when a light-sensitive material whose amount of silver is small is subjected to an activator development intensification processing, the desilvering step is preferably omitted.

The activator processing for use in the present invention is carried out with anionic organic substances dissolved out into the activator solution being removed, so that the photographic properties may be kept constant in continuous processing, and the continuous processing solution is generally processed in a processing apparatus having a member (means) for removing the organic substances.

The processing in the processing apparatus having the removing member is carried out, for example, in such a way that continuous processing is performed through a removing apparatus provided in a solution circulating system of the activator processing section, or that the activator solution is once retained in a separate tank, where the removing process is carried out, and then the activator solution is sent into the processing section.

Now, the removing member used in the present invention for removing (eliminating) anionic organic substances dissolved out into the said activator solution is described in detail.

The adsorbing materials (adsorbents) for removing anionic organic substances include a porous inorganic adsorbent having a large surface area, such as activated carbon, activated carbon fiber, synthetic zeolite, silica gel, activated alumina, and activated clay; an anion exchange resin of an adsorbing resin made up of crosslinked polymers that have a large surface area, such as styrene/divinylbenzene, a methacrylate, a vinylpyridine, and a sulfoxidoamidoamino acid, or a polymer having a three-dimensional network structure, each of which is introduced an anion exchange group, such as a quaternary amine or a primary to tertiary amine; and an anion exchange membrane obtained, for example, by methylchlorinating a film of styrene/divinylbenzene, followed by amination and quaternization to form salts, by aminating a film made by copolymerization of chloromethylstyrene and divinylbenzene, or by quaternizing a film of a nitrogen-containing heterocyclic compound to form salts.

The above organic ion exchangers are described, for example, in "Base of Advanced Separation Technique/Ion Exchange (Ion Kokan-Kodo Bunri Gijutsu No Kiso)" (1991, published by Kodansha), Section 2, pages 29 to 70, and the above inorganic adsorbents are described in "New High-Performance Adsorbents (Atarashii Koseino Kyuchakuzai)" (1976, published by Kaken Research Center/Keiei Kaihatsu Center Shuppan), pages 67 to 77.

In the present invention, in particular, the use of anion exchange resin is preferable, and such use is described in detail below.

As the polymer base of the ion exchange resin used in the present invention, a styrene-series including a crosslinked polystyrene, an acrylic acid-series, a methacrylic acid-series, an epoxy-series, or a phenol-series base is mainly used. As the exchange group, a strongly basic group having-a cationic site, such as a 2-hydroxypropylamino group and a trimethylamino group; an intermediately basic group, such as a polyethyleneimino group and a diethylaminoethyl group; a weakly basic group, such as epichlorohydrin triethanolamine; or a most weakly basic group, such as a p-aminobenzyl group, is mainly used, to be introduced into the polymer base.

As other exchange groups, such functional groups as p-aminobenzyl, polyethyleneimine, aminoethyl, and guanidinoethyl can be used and introduced. In the present invention, depending on the purpose of use, a resin having the above polymer base and the above exchange groups in combination may be suitably chosen and used. In particular, an ion exchange resin having strongly basic groups is preferably used, and quaternary salt-type exchange groups having cationic sites represented by the following structure are also preferably introduced:

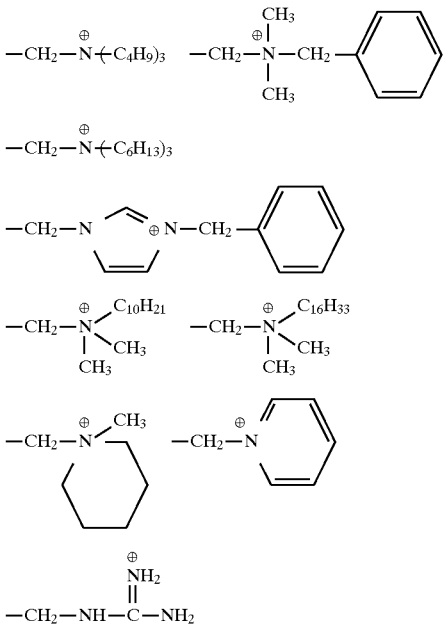

Specific examples of the anion exchange resins for use in the present invention are shown below, which do not restrict the present invention.

(1) Strongly basic ion exchange resins (quaternary salt-type)

Polystyene-series/trimethylamine-type resins, for example:

Trade name: Amberlite IRA-400, -401, and -900
Trade name: Daiaion SA-10A and -11A, and PA-306
Trade name: Dowex SBR, SBR-P, and MSA-1
Trade name: Duolite A-147 and -161
Trade name: Imac A-34 and -33
Trade name: Lewatit M-500 and MP-500

Acrylic acid-series/trimethylamine-type resins, for example:

Trade name: Amberlite IRA-458 and -958
Trade name: Duolite A-132
Trade name: Imac A-31
Trade name: Lewatit AP-247A Polystyrene-series/dimethylethanol amine-type resins, for example:

Trade name: Amberlite IRA-410, -411, and -910
Trade name: Daiaion SA-20A, 21A, and PA-406
Trade name: Dowex SAR and MSA-2
Trade name: Duolite A-162
Trade name: Imac A-32
Trade name: Lewatit M-600 and MP-600

(2) Weakly (intermediately) basic ion exchange resins (primary to tertiary amine-type)

Polystyrene-series/tertiary amine (e.g. dimethylamine)-type resins, for example:

Trade name: Amberlite IRA-93; Trade name: Daiaion WA-20 and -30; Trade name: Dowex 66; Trade name: Duolite A-368, Imac A-205, Lewatit MP-62

Acrylic acid-series/tertiary amine (e.g. dimethylamine)-type resins, for example:

Trade name: Amberlite IRA-35 and -68; Trade name: Daiaion WA-10; Trade name: Imac A-28; Trade name: Lewatit CA-9222

Further, epoxy-series/primary to tertiary amine-type resins, for example: Trade name: Dowex WGR-2; and phenol-series/primary to tertiary amine-type resins, for example: Trade name: Duolite A-7.

Further, resins falling within those described in "Base of Advanced Separation Technique/Ion Exchange (Ion Kokan-Kodo Bunri Gijutsu No Kiso)" (1991, published by Kodansha), pages 255 to 262, can be used.

Quaternary salt-type resins having the below-shown structures can also be used preferably. In addition to them, resins of terpolymers that have, in addition to sites with divinylbenzene and sites with quaternary-salt-containing exchange groups, sites with other functional groups, such as styrene groups and substituted styrene groups, can be used.

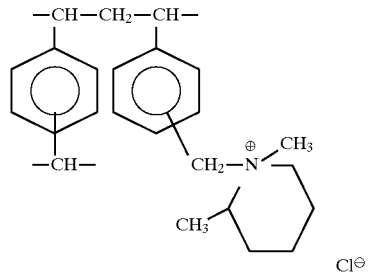

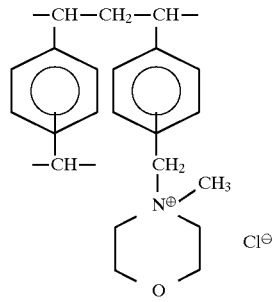

-continued

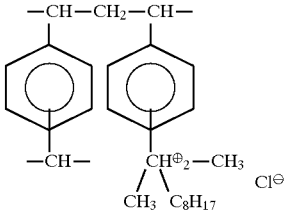

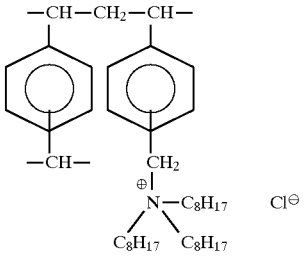

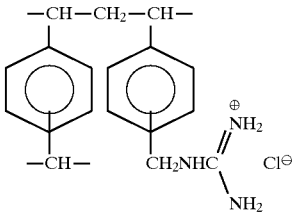

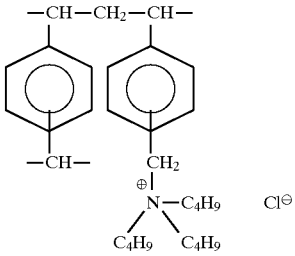

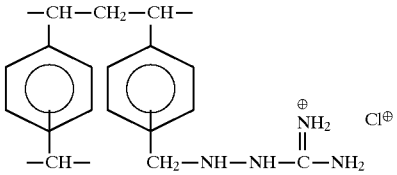

The above compounds are sparingly soluble in water or alkaline solutions, and therefore preferably they are used in a finely ground form so that the efficiency of removing anionic organic substances may be increased.

The means (member) having the above compound is, for example, housed in a cartridge that allows passage of liquids, and it is used in a form suitable for the processing apparatus and the amount to be processed. The means is periodically regenerated to be repeatedly used.

In the method of the present invention, preferably the concentration of anionic organic substances in the activator solution that has been subjected to the adsorption removing process is brought to 1 mmol/l or less, and more preferably 0.2 mmol/l or less.

Generally, although, in an activator solution, as a reducing substance, a developing agent, such as pyrazolidones, dihydroxybenzenes, reductones, and aminophenols, and a preservative, such as sulfites, e.g. sodium sulfite and potassium sulfite, formaldehyde/sodium bisulfite, hydroxylamine sulfate, diethylhydroxylamine, and dialkylhydroxyamines described in JP-A-4-97355 may be used, preferably the activator solution for use in the present invention is substantially free from them. Herein, the term "substantially free from" means that the concentration of each of them is preferably 0.5 mmol/l or less, more preferably 0.1 mmol/l or less, and particularly preferably not contained at all.

In the activator solution, halide ions, such as chloride ions, bromide ions, and iodide ions, can be contained.

Herein the halide ions may be added directory to the activator solution, or they may be dissolved out from the photographic material into the activator solution during the activator processing.

To retain a pH of activator solution, it is preferable to use various buffers, such as carbonates, phosphates, tetraborates, and hydroxybenzoates.

The amount of the buffer to be added to the activator solution is preferably 0.05 mol/liter or more, and particularly preferably 0.1 to 0.4 mol/liter.

In addition, in the activator solution, as a sediment-preventive agent against calcium and magnesium, or as an agent for stabilizing the activator solution, various chelating agents can be used.

With respect to the amount of the chelating agent to be added, preferably the amount is enough to sequester the metal ions in the activator solution, and, for example, these chelating agents are used in an amount in the order of 0.1 to 10 g per liter.

In the present invention, if required, an arbitrary antifoggant can be added. As the antifoggant, nitrogen-containing heterocyclic compounds, and alkali metal halide, such as sodium chloride, potassium bromide, and potassium iodide, can be used.

The amount of the nitrogen-containing heterocyclic compound to be added is generally $1\times10^{-5}$ to $1\times10^{-2}$ mol/liter, and preferably $2.5\times10^{-5}$ to $1\times10^{-3}$ mol/liter.

In the activator solution, if necessary, an arbitrary development accelerator or a fluorescent whitening agent such as 4,4-diamino-2,2'-disulfostilbene-series compounds, can be added.

The processing temperature of the activator solution to be applied to the present invention is generally 20° to 50° C., and preferably 30° to 45° C. The processing time is generally 5 sec to 2 min, and preferably 10 sec to 1 min. With respect to the replenishing rate, although a small amount is preferable, the replenishing rate is generally 15 to 600 ml, preferably 25 to 200 ml, and more preferably 35 to 100 ml, per $m^2$ of the photographic material.

After the activator development, a desilvering process can be carried out. The desilvering process comprises a fixing process, or both bleaching process and a fixing process. When both bleaching and fixing are carried out, the bleaching process and the fixing process may be carried out separately or simultaneously (bleach-fixing process). Also, according to the purpose, the processing may be carried out in a bleach-fixing bath having two successive tanks; or the fixing process may be carried out before the bleach-fixing process; or the bleaching process may be carried out after the bleach-fixing process.

In some cases, it is preferable to carry out the stabilizing process, to stabilize silver salts and dye images, without carrying out the desilvering process after the development.

After the development, image-intensifying process (intensification) can be performed using peroxides, halorous acids, iodoso compounds, and cobalt(III) complex compounds described, for example, in West Germany Patent (OLS) Nos. 1,813,920, 2,044,993, and 2,735,262, and JP-A-48-9728, 49-84240, 49-102314, 51-53826, 52-13336, and 52-73731. To further intensify the image, an oxidizing agent for intensifying the image can be added to the above activator solution, so that the development and the intensification may be carried out at the same time in one bath. In particular, hydrogen peroxide is preferable, because the amplification rate is high. These intensification methods are preferable processing methods in view of environmental preservation. This is because the amount of silver in the light-sensitive material can be reduced considerably, and therefore, for example, a bleaching process is not required and silver (or silver salts) will not be released, for example, by a stabilizing process or the like.

Example bleaching agents for use in the bleaching solution or the bleach-fix solution include, for example, compounds of polyvalent metals, such as iron(III), cobalt(III), chromium(IV), and copper(II); peracids; quinones; and nitro compounds. Among them, aminopolycarboxylic acid iron (III) of ethylenediaminetetraacetic acid iron(III) complex salt and 1,3-diaminopropanetetraacetic acid iron(III) complex salt, hydrogen peroxide, persulfates, and the like are preferred, in view of rapid processing and the prevention of environmental pollution.

The bleaching solution and bleach-fix solution that use these aminopolycarboxylic acid irons(III) complex salts are generally used at a pH of 3 to 8, and preferably 5 to 7. The bleaching solution that uses persulfates and hydrogen peroxide is generally used at a pH of 4 to 11, and preferably 5 to 10.

In the bleaching solution, the bleach-fix solution, and the bath preceding them, if required, a bleach-accelerating agent can be used.

In the bleaching solution, the bleach-fix solution, and the fixing solution, use can be made of known additives, such as a rehalogenating agent, a pH buffering agent, and a metal corrosion-preventive agent. In particular, it is preferable to contain an organic acid having an acid dissociation constant (pKa) of 2 to 7, to prevent bleach stain.

Example fixing agents for use in the fixing solution and the bleach-fix solution include thiosulfates, thiocyanates, thioureas, a large amount of iodide salts, nitrogen-containing heterocyclic compounds, having a sulfide group, as described in JP-A-4-365037, pages 11 to 21, and JP-A-5-66540, pages 1088 to 1092; metho-ionic compounds, and thioether compounds.

Preferable preservatives for the fixing solution and the bleach-fix solution are sulfites, bisulfites, carbonylbisulfite abducts, and sulfinic acid compounds described in EP-A-294 769.

In the fixing solution and the bleach-fix solution, further, for example, any of various fluorescent whitening agents, antifoaming agents, surface-active agents, polyvinylpyrolidones, and methanol can be contained.

The processing temperature of the desilvering step is generally 20° to 50° C., and preferably 30° to 45° C. The processing time is generally 5 sec to 2 min, and preferably 10 sec to 1 min. Although a small replenishing rate is preferable, the replenishing rate is generally 15 to 600 ml, preferably 25 to 200 ml, and more preferably 35 to 100 ml, per $m^2$ of the photographic material. The processing is also preferably carried out without replenishment in such a way that the evaporated amount is supplemented with water.

The light-sensitive material for use in the present invention, after being subjected to a desilvering process, is generally subjected to a washing step. If a stabilizing process is carried out, the washing process can be omitted. As the stabilizing process, any known processes described in JP-A-57-8543, 58-14834, 60-220345, JP-A-58-127926, 58-137837, and 58-140741 can be used. Also, a washing process/stabilizing process that uses, as a final bath, a stabilizing bath containing a dye stabilizing agent and a surface-active agent, which process is representatively used for processing photographing color light-sensitive materials, can be carried out.

In the washing solution and the stabilizing solution, use can be made, for example, of a sulfite; a water softener, such as inorganic phosphoric acids, polyaminocarboxylic acids, and organic aminophosphonic acids; a metal salt, such as Mg salts, Al salts, and Bi salts; a surface-active agent; a hardener; a pH buffer; a fluorescent whitening agent; and a silver-salt-forming agent, such as nitrogen-containing heterocyclic compounds.

As the dye stabilizing agent in the stabilizing solution, aldehydes, such as formaldehyde and glutaraldehyde; N-methylol compounds, hexamethylenetetramine or aldehyde sulfite adducts can be mentioned.

The pH of the washing water and the stabilizing solution is generally 4 to 9, and preferably 5 to 8. The processing temperature is generally 15° to 45° C., and preferably 25° to 40° C. The processing time is generally 5 sec to 2 min, and preferably 10 sec to 40 sec.

The overflow involved in the replenishment of the washing solution and/or the stabilizing solution can be used again in some other process, such as the desilvering process.

The amount of the washing water and/or the stabilizing solution can be set in a wide range depending on various conditions, and the replenishing rate is preferably 15 to 360 ml, and more preferably 25 to 120 ml, per $m^2$ of the photographic material. To reduce the replenishing rate, it is preferable to use multiple tanks and a multi-stage countercurrent system.

In the present invention, in order to save water, water can be used that has been obtained by treating the overflow liquid or the in-tank liquid using a reverse osmosis membrane. For example, the treatment by reverse osmosis is preferably carried out for water from the second tank, or the more latter tank of the multi-stage countercurrent washing process and/or the stabilizing process.

In the present invention, preferably the stirring is intensified as much as possible. To intensify the stirring, specifically a method wherein a jet stream of a processing solution is caused to impinge on the emulsion surface of a photographic material, as described in JP-A-62-183460 and 62-183461; a method wherein a rotating means is used to increase the stirring effect, as described in JP-A-62-183461; a method wherein a photographic material is moved, with the emulsion surface of the material being in contact with a wiper blade provided in a liquid, so that a turbulent flow may occur near the emulsion surface, to improve the stirring effect; and a method wherein the total amount of a processing solution to be circulated is increased, can be mentioned. These means of improving the stirring are useful in any of the developing solution, the bleaching solution, the fixing solution, the bleach-fix solution, the stabilizing solution, and the washing water. These methods are effective in that the effective constituents in the solution are supplied to the photographic material and the diffusion of unnecessary components in the photographic material is promoted.

In the present invention, any state of the liquid opening rate [contact area of air ($cm^2$)/liquid volume ($cm^3$)] of any of the baths can exhibit excellent performance, but in view of the stability of the liquid components, preferably the liquid opening rate is 0 to 0.1 $cm^{-1}$. In the continuous processing, from a practical point of view, the liquid opening rate is preferably 0.001 to 0.05 $cm^{-1}$, and more preferably 0.002 to 0.03 $cm^{-1}$.

The automatic developing machine (automatic processor) that can be used for the photographic material for use in the present invention, is preferably provided with a means of transporting a photographic material, as described in JP-A-60-191257, 60-191258, and 60-191259. Such a transporting means can reduce remarkably the carry-in of the processing solution from a preceding bath to a succeeding bath. Therefore it is high in the effect of preventing the performance of a processing solution from being deteriorated. Such an effect is particularly effective in shortening the processing time of each process and in reducing the process replenishing rate. To shorten the processing time, it is preferable to shorten the crossover time (the aerial time), and a method wherein a photographic material is transported between processes through a blade having a screening effect, as described, for example, in JP-A-4-86659, FIG. 4, 5, or 6, and JP-A-5-66540, FIG. 4 or 5, is preferable.

Further, if each of the processing solutions in the continuous process is concentrated due to evaporation, preferably water is added to compensate for the evaporation.

The processing time in each process according to the present invention means the time required from the start of the processing of the photographic material at any process, to the start of the processing in the next process. The actual processing time in an automatic processor is determined generally by the linear speed and the volume of the processing bath, and in the present invention, as the linear speed, 500 to 4,000 mm/min can be mentioned as a guide. Particularly in the case of a small-sized processor, 500 to 2,500 mm/min is preferable.

The processing time in the whole processing steps, that is, the processing time from the activator development process to the drying process, is preferably 360 sec or below, more preferably 120 sec or below, and particularly preferably 90 to 30 sec. Herein the processing time means the time from the dipping of the photographic material into the developing solution, till the emergence from the drying part of the processor.

In the processings applied to the invention, various additives can be used, and more details are described in Research Disclosure Item 36544 (September 1994), whose related section is summarized below.

| Processing agents | Page |
|---|---|
| Antifoggants | 537 |
| Chelating agents | 537, right column |
| Buffers | 537, right column |
| Surface-active agents | 538, left column, and 539, left column |
| Bleaching agents | 538 |
| Bleach-accelerating agents | 538, right column to 539, left column |
| Chelating agents for bleaching | 539, left column |
| Rehalogenating agents | 539, left column |
| Fixing agents | 539, right column |
| Preservatives for fixing agents | 539, right column |
| Chelating agents for fixing | 540, left column |

According to the present invention, since a light-sensitive material containing a color-forming reducing agent and a dye-forming coupler is continuously processed by using an alkaline activator bath substantially free from any color-developing agent, with removing anionic organic substances dissolved out from the light-sensitive material (for example, by a processing apparatus having a member for eliminating anionic organic substances), an image having low minimum density and high color density can be obtained, even by continuous processing of the activator processing. Further, a sharp image with the photographic properties less fluctuated can be obtained, even by continuous processing.

The present invention will now be described specifically with reference to the examples, but of course the present invention is not limited to them.

EXAMPLES

Example 1

(Preparation of Light-Sensitive Material)

A paper base both surfaces of which had been laminated with polyethylene, was subjected to surface corona discharge treatment; then it was provided with a gelatin undercoat layer containing sodium dodecylbenzensulfonate, and it was coated with various photographic constitutional layers, to prepare a multi-layer photographic color printing paper having the layer constitution shown below. This is designated as Sample (100).

The coating solutions were prepared as follows.

Predation of First-Layer Coating Solution 19.0 g of a cyan dye-forming coupler (ExC-1), 20.4 g of a color-forming reducing agent (I-1), 26.1 g of Cpd-A, 4.3 g of Cpd-B, and 14.4 g of Cpd-C, were dissolved in 67 g of a solvent (Solv-4) and 73 ml of ethyl acetate, and the resulting solution was emulsified and dispersed in 400 ml of a 12% aqueous gelatin solution containing 10% sodium dodecylbenzensulfonate and citric acid, to prepare an emulsified dispersion A.

On the other hand, a silver chlorobromide emulsion A (cubes; an average grain size of 0.18 $\mu$m; silver bromide content of 25 mol %) was prepared. To this emulsion, had been added each of red-sensitive sensitizing dyes A-1 and A-2. The chemical ripening of this emulsion was carried out optimally with a sulfur sensitizer and a gold sensitizer being added.

The above emulsified dispersion A and this silver chlorobromide emulsion A were mixed and dissolved, and a first-layer coating solution was prepared so that it would have the composition shown below. Preparation of coating solutions for the second layer to the seventh layer In the similar way as the method of preparing of the first-layer coating solution, coating solutions for the second layer to the seventh layer were prepared.

The above coating solutions for each layers were applied on the base, to prepare Sample (100) of a light-sensitive material having the layer constitution shown below.

As the gelatin hardener for each layers, 1-oxy-3,5-dichloro-s-triazine sodium salt was used.

Further, to each layer, were added Cpd-4 and Cpd-5, so that the total amounts would be 25.0 mg/m$^2$ and 50.0 mg/m2, respectively.

For the silver chlorobromide emulsion of each photosensitive emulsion layer, the following spectral sensitizing dyes were used.

Red-sensitive emulsion layer

Sensitizing dye A-1

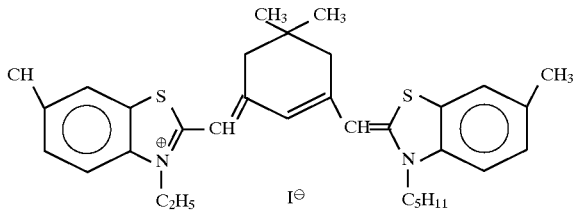

(2.5 × 10$^{-4}$ mol per mol of the silver halide)

Further, the following compound was added in an amount of 5×10$^{-3}$ mol per mol of the silver halide.

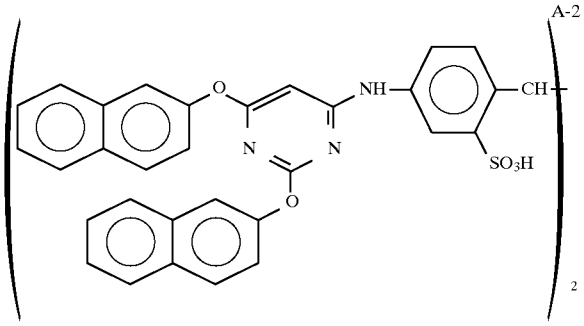

Green-sensitive emulsion layer

Sensitizing dye B

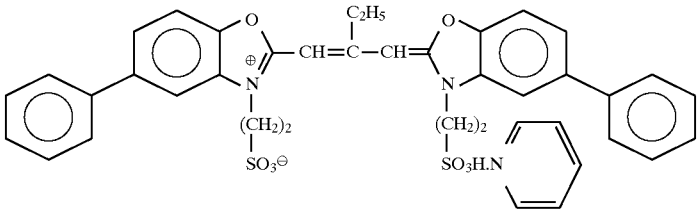

(9.5 × $10^{-4}$ mol per mol of the silver halide)

Blue-sensitive emulsion layer

Sensitizing dye C

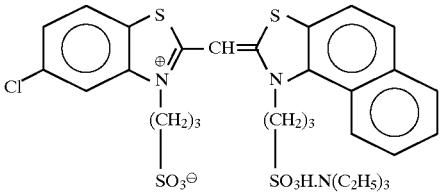

(3.0 × $10^{-4}$ mol per mol of the silver halide)

Further, to the red-sensitive emulsion layer, the green-sensitive emulsion layer, and the blue-sensitive emulsion layer, was added 1-(5-methylureidophenyl)-5-mercaptotetrazole in amounts of $3.0\times10^{-4}$ mol, $2.0\times10^{-4}$ mol, and $8.0\times10^{-4}$ mol, respectively, per mol of the silver halide.

To the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to neutralize irradiation, the following dye was added to the emulsion layers (the coating amount is shown in parentheses).

Irradiation neutralizing dye (10 mg/$m^2$)

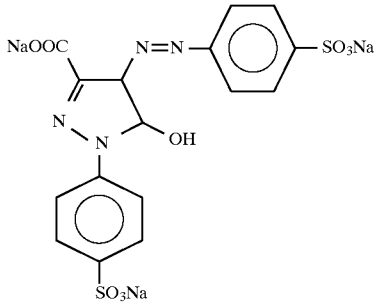

-continued

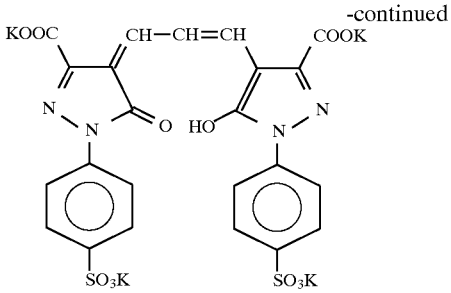

(10 mg/m$^2$)

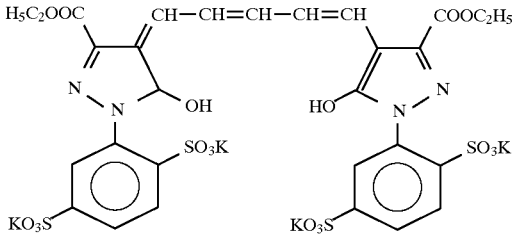

(40 mg/m$^2$)

and

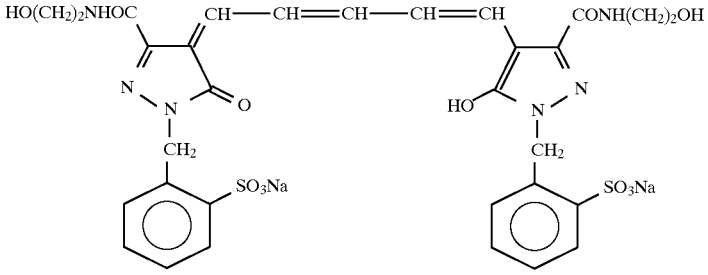

(20 mg/m$^2$)

(Layer Constitution)

The composition of each layer is shown below. The numbers show coating amounts (g/m$^2$). In the case of the silver halide emulsion, the coating amount is in terms of silver.

| | |
|---|---|
| Base | |
| Polyethylene-Laminated Paper [The polyethylene on the first layer side contained a white pigment ($TiO_2$: 15 wt %) and a blue dye (ultramarine)] | |
| First Layer (Red-Sensitive Emulsion Layer) | |
| The above silver chlorobromide emulsion A | 0.20 |
| Gelatin | 1.18 |
| Cyan coupler (ExC-1) | 0.19 |
| Color-forming reducing agent (I-1) | 0.26 |
| Cpd-A | 2.61 |
| Cpd-B | 0.43 |
| Cpd-C | 1.44 |
| Solvent (Solv-4) | 0.67 |
| Second Layer (Color-Mixing Inhibiting Layer) | |
| Gelatin | 1.00 |
| Auxiliary developing agent (ETA-6) | 0.04 |
| Color-mixing inhibitor (Cpd-1) | 0.08 |
| Solvent (Solv-1) | 0.25 |
| Solvent (Solv-2) | 0.15 |
| Solvent (Solv-3) | 0.13 |
| Third Layer (Green-Sensitive Emulsion Layer) | |
| A silver chlorobromide emulsion (cubes; average grain size of 0.12 μm; AgBr 25 mol %) | 0.20 |
| Gelatin | 1.25 |

-continued

| | |
|---|---|
| Magenta coupler (EXM-1) | 0.25 |
| Color-forming reducing agent (I-32) | 0.20 |
| Cpd-A | 2.61 |
| Cpd-B | 0.43 |
| Cpd-C | 1.44 |
| Solvent (Solv-4) | 0.67 |
| Fourth Layer (Color-Mixing Inhibiting Layer) | |
| Gelatin | 1.00 |
| Auxiliary developing agent (ETA-6) | 0.04 |
| Color-mixing inhibitor (Cpd-1) | 0.08 |
| Solvent (Solv-1) | 0.25 |
| Solvent (Solv-2) | 0.15 |
| Solvent (Solv-3) | 0.13 |
| Fifth Layer (Blue-Sensitive Emulsion Layer) | |
| A silver chlorobromide emulsion (cubes; average grain size of 0.41 μm; silver bromide 0.3 mol %) | 0.015 |
| Gelatin | 1.26 |
| Yellow coupler (ExY-1) | 0.24 |
| Color-forming reducing agent (I-16) | 0.26 |
| Cpd-A | 2.61 |
| Cpd-B | 0.43 |
| Cpd-C | 1.44 |
| Solvent (Solv-4) | 0.67 |
| Sixth Layer (Ultraviolet Absorbing Layer) | |
| Gelatin | 0.60 |
| Ultraviolet absorbing agent (UV-1) | 0.57 |
| Color image stabilizer (Cpd-2) | 0.06 |
| Solvent (Solv-1) | 0.05 |
| Seventh Layer (Protective Layer) | |
| Gelatin | 1.00 |
| Acryl-modified copolymer of polyvinyl alcohol (modification degree: 17%) | 0.05 |

-continued

| | |
|---|---|
| Liquid paraffin | 0.02 |
| Surface-active agent (Cpd-3) | 0.01 |

(ExY-1) Yellow coupler

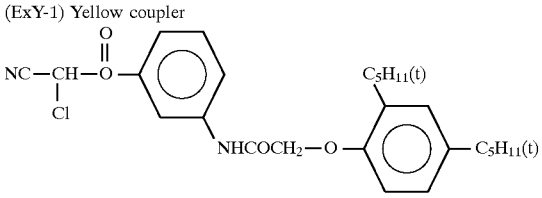

(ExM-1) Magenta coupler

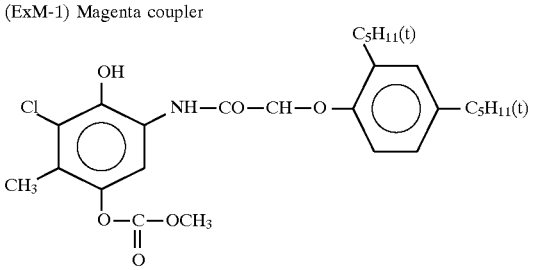

(ExC-1) Cyan coupler

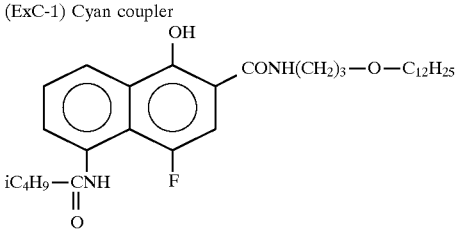

(Solv-1) Solvent

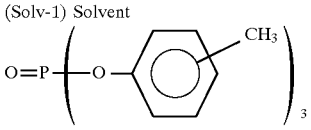

(Solv-2) Solvent

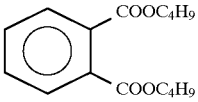

(Solv-3) Solvent

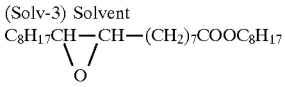

(Solv-4) Solvent

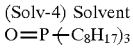

Cpd A

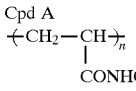

Average molecular weight 60,000

Cpd-B

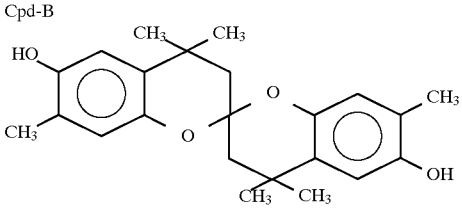

-continued

Cpd-C

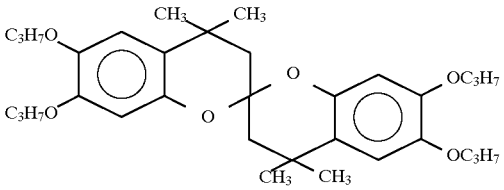

(Cpd-1) Color mixing inhibitor
a mixture in 1:1:1 in weight ratio of

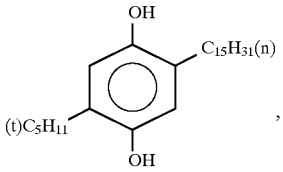

,

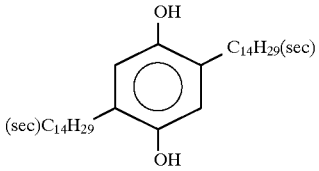

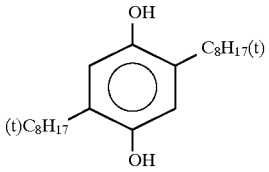

(Cpd-2) Dye image stabilizer

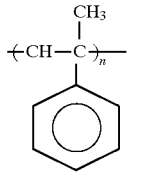

number average molecular weight 600

(Cpd-3) Surface-active agent
a mixture in 2:1:1 in weight ratio of

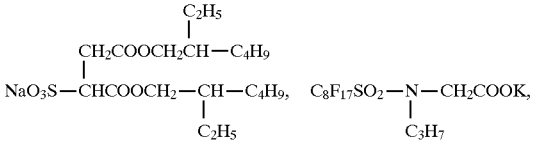

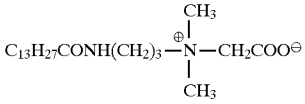

(Cpd-4) Antiseptic

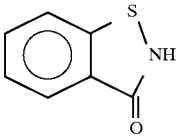

(Cpd-5) Antiseptic

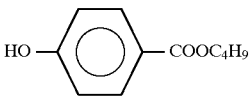

(UV-1) Ultraviolet absorber
a mixture in 1:2:2:3:1 in weight ratio of

-continued

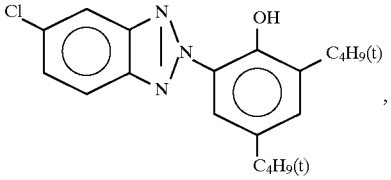

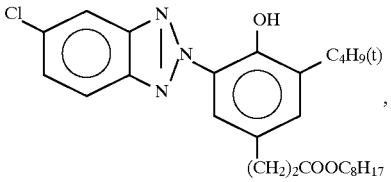

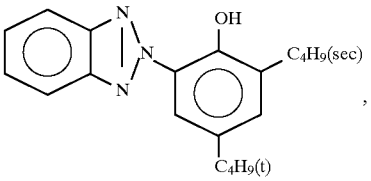

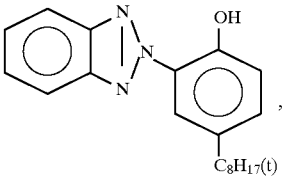

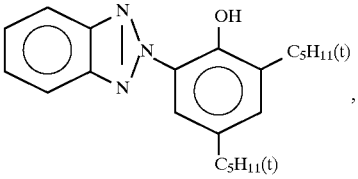

The auxiliary developing agent (ETA-6) in a state of a dispersion of fine solid particles was added in an amount of 0.040 g per $m^2$ to each of the intermediate layers of the second layer and the fourth layer.

Each of the thus-prepared samples was cut and was subjected to gradation exposure through a three-color separation filter for sensitometry by using a sensitometer (manufactured by Fuji Photo Film Co., Ltd.; FW-type; Color temperature of the light source, 3,200° K.).

The samples that had been exposed to light were continuously processed using the below-shown processing steps and processing solution compositions until the activator solution was replenished in an amount corresponding to the volume of the tank.

| Processing step | Temperature | Replenishment rate | Time | Tank volume (liter) |
|---|---|---|---|---|
| Activator development | 40° C. | 30 ml | 20 sec | 2.0 |
| Bleach-fix | 40° C. | 30 ml | 15 sec | 2.0 |
| Stabilizing (1) | 30° C. | — | 5 sec | 1.0 |
| Stabilizing (2) | 30° C. | — | 5 sec | 1.0 |
| Stabilizing (3) | 30° C. | 60 ml | 10 sec | 1.0 |
| Drying | 80° C. | | 10 sec | |

(the replenishment rate was the amount per $m^2$ of the light-sensitive material)
(the stabilizing was conducted in a 3-tank counter-current system of Stabilizing (3) to Stabilizing (1))

-continued

| (Activator (Developing) Solution) | Tank Solution | Replenisher |
|---|---|---|
| Water | 800 ml | 800 ml |
| Tripotassium phosphate | 30 g | 39 g |
| Potassium chloride | 10 g | — |
| Hydroxylethylidene-1,1-diphosphonic acid (30% solution) | 4 ml | 4 ml |
| Water to make 1 liter pH | 12.0 | |
| (Bleach-fix Solution) | | |
| Water | 600 ml | 150 ml |
| Ammonium thiosulfate (700 g/liter) | 100 ml | 250 ml |
| Ammonium sulfite monohydrate | 40 g | 40 g |
| Ethylenediaminetetraacetic acid iron (III) ammonium salt | 77 g | 154 g |
| Ethylenediaminetetraacetic acid | 5 g | 10 g |
| Ammonium bromide | 10 g | 20 g |
| Acetic acid (50%) | 70 ml | 140 ml |
| Water to make 1 liter | pH 6.0 | pH 5.5 |

(Stabilizing solution)
(Both tank solution and replenisher)

| | |
|---|---|
| Water | 900 ml |
| Citric acid | 4.2 g |
| Hydroxylethylidene-1,1-diphosphonic acid (30% solution) | 1.0 ml |
| 5-Chloro-2-methyl-isothiazolin-3-one | 0.02 g |
| Water to make 1 liter | pH 6.0 |

After the continuous processing, 250 ml of the activator solution was separated, 10 g of the adsorbent or the anion exchange resin shown in Table 1 was added to the separated activator solution, the mixture was stirred for 30 min and then was filtered. The filtered activator solution was used to process the light-sensitive material (100), which had been exposed to light in the same way as above, through the same processing steps as above for the same processing time as above by using a processing apparatus for small volumes. The image densities of the yellow, the magenta, and the cyan of each of the light-sensitive materials processed by the respective solutions were measured through B, G, and R filters corresponding to the respective dyes, thereby measuring the minimum density ($D^r$min) and the maximum density ($D^r$max).

The values of the $D^r$min and the $D^r$ max were compared with the measured values of the $D^f$min and the $D^f$max of the light-sensitive materials processed with the activator solution before the continuous processing. The results were evaluated using the following ΔDmin and ΔDmax. The results are shown in Table 1.

$$\Delta Dmin = D^r min - D^f min$$

$$\Delta Dmax = D^r max - D^f max$$

TABLE 1

| | Δ Dmin | | | Δ Dmax | | |
|---|---|---|---|---|---|---|
| Adsorbent | B | G | R | B | G | R |
| 1 None | 0.15 | 0.10 | 0.05 | −0.15 | −0.25 | −0.20 |
| 2 Activated carbon | 0.05 | 0.04 | 0.03 | −0.04 | −0.08 | −0.07 |
| 3 Silica gel | 0.06 | 0.05 | 0.03 | −0.06 | −0.09 | −0.08 |
| 4 Acrylic acid ester resin: Amberlite XAD-7 | 0.09 | 0.07 | 0.04 | −0.08 | −0.12 | −0.09 |
| 5 Vinylpyridine resin: Daiaion VP 10 | 0.07 | 0.05 | 0.03 | −0.06 | −0.10 | −0.08 |

TABLE 1-continued

| Adsorbent | Δ Dmin | | | Δ Dmax | | |
|---|---|---|---|---|---|---|
| | B | G | R | B | G | R |
| 6 Polystyrene-series/ trimethylamine-type resin: Daiaion SA-10A | 0.01 | 0.00 | 0.00 | 0.00 | −0.02 | −0.01 |
| 7 Methacrylic acid-series/trimethylamine-type resin: Amberlite IRA-458 | 0.01 | 0.00 | 0.00 | 0.00 | −0.03 | −0.01 |
| 8 Polystyrene-series/ Dimethylamine-type resin: Daiaion WA-30 | 0.05 | 0.03 | 0.02 | −0.04 | −0.07 | −0.06 |

As a result, when the activator solution processed with the adsorbent or the anion exchange resin for use in the present invention was used, the fluctuation of the image density after the continuous processing could be remarkably suppressed and the gradation was the same as that before the continuous processing and was less fluctuated. On the other hand, when the activator solution after the continuous processing was used directly without processing, an increase in Dmin, a decease in Dmax, and softening of gradation conspicuously took place.

It can be understood that, according to the method of the present invention, even continuous processing could give stabilized constant photographic properties, and that the photographic properties were further stabilized particularly when the anion exchange resin for use in the present invention was used.

Example 2

(Preparation of light-sensitive material)

On the same base in Example 1, layers having the below-described constitution were formed, to prepare a multi-layer color printing paper. This was named Sample (200).

The coating solutions were prepared as follows.

Preparation of First-Layer Coating Solution 24.1 g of a yellow color-forming coupler (ExY-2) and 14.0 g of a color-forming reducing agent (I-32) were dissolved in 67 g of a solvent (Solv-4) and 73 ml of ethyl acetate, and the resulting solution was emulsified and dispersed in 420 ml of a 12% aqueous gelatin solution containing 10% sodium dodecylbenzenesulfonate and citric acid, to prepare an emulsified dispersion D.

On the other hand, a silver chlorobromide emulsion D (cubes; a mixture of a large-size emulsion having an average grain size of 0.88 μm, and a small-size emulsion having an average grain size of 0.70 μm (3:7 in terms of mol of silver), the deviation coefficients of the grain size distributions being 0.08 and 0.10, respectively, and each emulsion having 0.3 mol % of silver bromide locally contained in part of the grain surface whose substrate was made up of silver chloride) was prepared. To the large-size emulsion of this emulsion, had been added $1.4\times10^{-4}$ mol, per mol of silver, of each of blue-sensitive sensitizing dyes-1, -2, and -3 shown below, and to the small-size emulsion of this emulsion, had been added 1.7×10'∝mol, per mol of silver, of each of blue-sensitive sensitizing dyes-1, -2, and -3 shown below. The chemical ripening of this emulsion was carried out optimally with a sulfur sensitizer and a gold sensitizer being added. The above emulsified dispersion D and this silver chlorobromide emulsion D were mixed and dissolved, to prepare a first-layer coating solution.

Blue-sensitive sensitizing dye

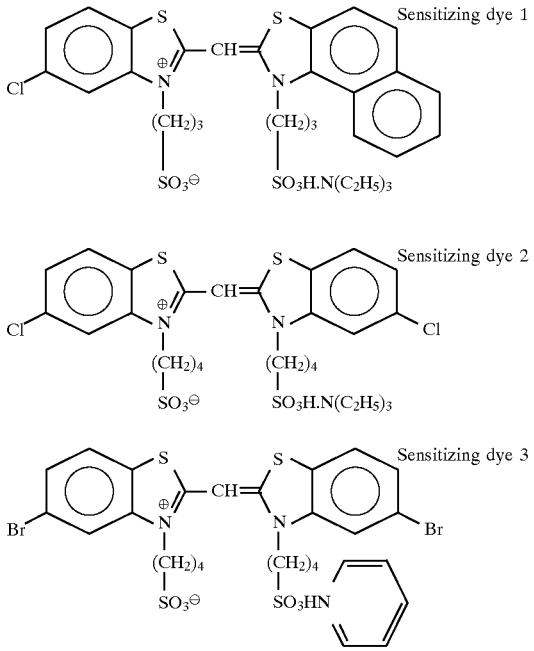

Similarly to the first-layer coating solution, coating solutions for the third layer and the fifth layer were prepared in the following manner. A silver chlorobromide emulsion E (cubes; a mixture of a large-size emulsion having an average grain size of 0.50 μm, and a small-size emulsion having an average grain size of 0.41 μm (1:4 in terms of mol of silver), the deviation coefficients of the grain size distributions being 0.09 and 0.11, respectively, and each emulsion having 0.8 mol % of silver bromide locally contained in part of the grain surface whose substrate was made up of silver chloride) for the third layer was prepared. To the large-size emulsion of this emulsion, had been added $3.0\times10^{-4}$ mol, per mol of silver, of a green-sensitive sensitizing dye-1 shown below, and to the small-size emulsion of this emulsion, had been added $3.6\times10^{-4}$ mol, per mol of silver, of the green-sensitive sensitizing dye-1 shown below; and to the large-size emulsion of this emulsion, had been added $4.0\times10^{-5}$ mol, per mole of silver, of a green-sensitive sensitizing Dye-2 shown below, and to the small-size emulsion of this emulsion, had been added $7.0\times10^{-5}$ mol, per mol of silver, of the green-sensitive sensitizing dye-2 shown below; and to the large-size emulsion of this emulsion, had been added $2.0\times10^{-4}$ mol, per mol of silver, of a green-sensitive sensitizing dye-3 shown below, and to the small-size emulsion of this emulsion, had been added $2.8\times10^{-4}$ mol, per mol of silver, of the green-sensitive sensitizing dye-3 shown below. This silver chlorobromide emulsion E, and an emulsified dispersion E containing a magenta color-forming coupler (ExM-2), which was prepared in the same manner as for the above emulsified dispersion D, were mixed and dissolved, to prepare the third-layer coating solution.

Green-sensitive sensitizing dye

Sensitizing dye 1

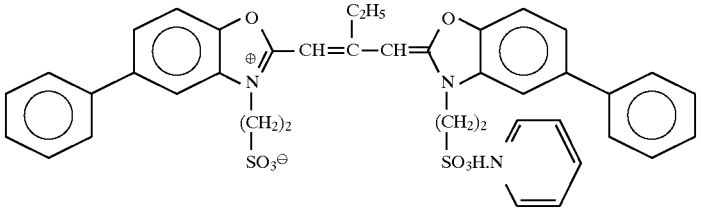

Sensitizing dye 2

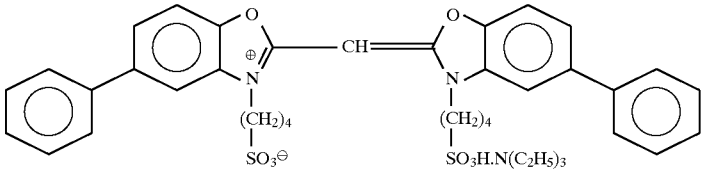

Sensitizing dye 3

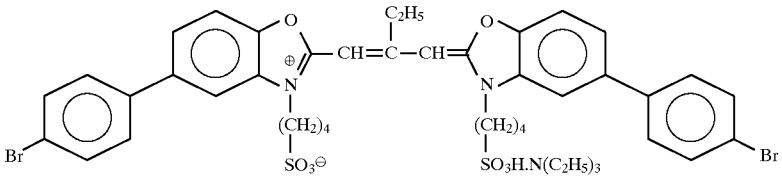

A silver chlorobromide emulsion F (cubes; a mixture of a large-size emulsion having an average grain size of 0.50 $\mu$m, and a small-size emulsion having an average grain size of 0.41 $\mu$m (1:4 in terms of mol of silver), the deviation coefficients of the grain size distributions being 0.09 and 0.11, respectively, and each emulsion having 0.8 mol % of silver bromide locally contained in part of the grain surface whose substrate was made up of silver chloride) for the fifth layer was prepared. To the large-size emulsion of this emulsion, had been added $5.0\times10^{-5}$ mol, per mol of silver, of a red-sensitive sensitizing dyes-1 shown below; and to the small-size emulsion of this emulsion, had been added $6.0\times10^{-5}$ mol, per mol of silver, of the red-sensitive sensitizing dye-1 shown below; and to the large-size emulsion of this emulsion, had been added $5.0\times10^{-5}$ mol, per mol of silver, of a red-sensitive sensitizing dyes-2 shown below; and to the small-size emulsion of this emulsion, had been added $6.0\times10^{-5}$ mol, per mol of silver, of the red-sensitive sensitizing dye-2 shown below.

Red-sensitive sensitizing dye

Red-sensitive sensitizing dye-1

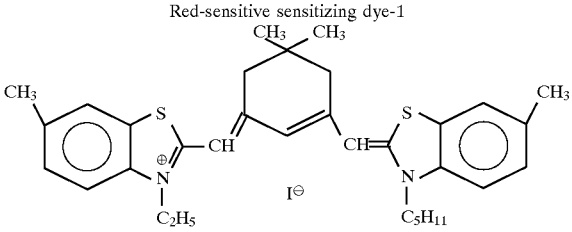

-continued

Red-sensitive sensitizing dye-2

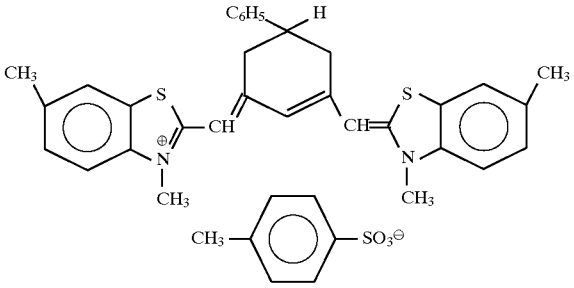

Further, the same A-2 compound as used in Example 1 was added to the fifth layer in an amount of $2.6\times10^{-3}$ mol per mol of silver.

This silver chlorobromide emulsion F, and an emulsified dispersion F containing a cyan color-forming coupler (ExC-2), which was prepared in the same manner as for the above emulsified dispersion D, were mixed and dissolved, to prepare the fifth-layer coating solution.

(ExY-2) Yellow coupler

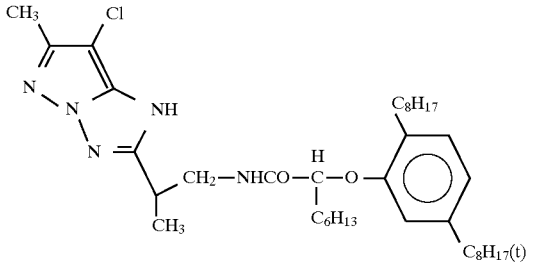

(ExM-2) Magenta coupler

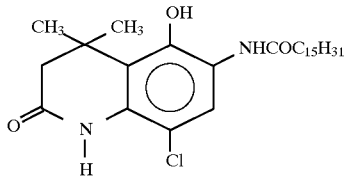

(ExC-2) Cyan coupler

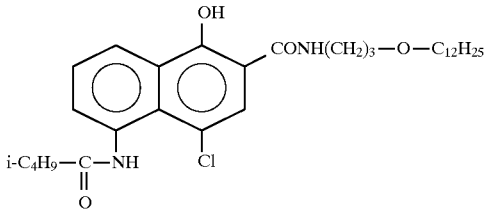

The second, sixth and seventh layers were prepared such that they would have the compositions shown below.

To each of the second and the fourth layers, i.e. the intermediate layers, was added an auxiliary developing agent (ETA-6) in the state of a fine-particle solid dispersion in an amount of $1.4\times10^{-4}$ mol.

With respect to solvents, image dye stabilizers, ultraviolet absorbers, color-mixing inhibitors, surface-active agents, and the like, the same compounds as used in Example 1 were used.

As the gelatin hardener of each layer, 1-oxy-3,5-dichloro-s-triazine sodium salt was used.

Further, Cpd-4 and Cpd-5 were added to each layer so that the total amount would be 25 mg/m$^2$ and 50 mg/m$^2$, respectively.

To the blue-sensitive emulsion layer, the green-sensitive emulsion layer, and the red-sensitive emulsion layer, was added 1-(5-mthylureidophenyl)-5-mercaptotetrazole in amounts of $8.5\times10^{-5}$ mol, $9.0\times10^{-4}$ mol, and $2.5\times10^{-4}$ mol, respectively, per mol of the silver halide. Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to neurtalize irradiation, the same dye as used in Sample (100) of Example 1 was added to the emulsion layers in the same amount.

(Layer Constitution)

The composition of each layer is shown below. Each figure indicates the coated amount (g/m$^2$). For the silver halide emulsions, the coated amounts are given in terms of silver.

| | |
|---|---|
| Base | |
| Polylethylene-laminated paper [The polyethylene on the first layer side contained a white pigment ($TiO_2$, 15 wt %) and a bluish dye (ultramarine)] | |
| First layer (blue-sensitive emulsion layer) | |
| The above Silver Chlorobromide Emulsion D | 0.20 |
| Gelatin | 1.54 |
| Yellow coupler (ExY-2) | 0.24 |
| Color-forming reducing agent (I-32) | 0.14 |
| Cpd-A | 2.61 |
| Cpd-B | 0.43 |
| Cpd-C | 1.44 |
| Solvent (Solve-4) | 0.67 |
| Second layer (color-mixing inhibition layer) | |
| Gelatin | 1.00 |
| Auxiliary developing agent (ETA-6) | 0.07 |
| Color-mixing inhibitor (Cpd-1) | 0.08 |
| Solvent (Solv-1) | 0.25 |
| Solvent (Solv-2) | 0.15 |
| Solvent (Solv-3) | 0.13 |
| Third layer (green-sensitive emulsion layer) | |
| Silver Chlorobromide Emulsion E | 0.20 |
| Gelatin | 1.55 |
| Magenta coupler (ExM-2) | 0.22 |
| Color-forming reducing agent (I-32) | 0.20 |
| Cpd-A | 2.61 |
| Cpd-B | 0.43 |
| Cpd-C | 1.44 |
| Solvent (Solv-4) | 0.67 |
| Fourth layer (color-mixing inhibition layer) | |
| Gelatin | 1.00 |
| Auxiliary developing agent (ETA-6) | 0.07 |
| Color-mixing inhibitor (Cpd-1) | 0.08 |
| Solvent (Solv-1) | 0.25 |
| Solvent (Solv-2) | 0.15 |
| Solvent (Solv-3) | 0.13 |
| Fifth layer (red-sensitive emulsion layer) | |
| Silver Chlorobromide Emulsion F | 0.20 |
| Gelatin | 1.50 |
| Cyan coupler (ExC-2) | 0.21 |
| Color-forming reducing agent (I-16) | 0.26 |
| Cpd-A | 2.61 |
| Cpd-B | 0.43 |
| Cpd-C | 1.44 |
| Solvent (Solv-4) | 0.67 |
| Sixth layer (ultraviolet absorbing layer) | |
| Gelatin | 0.60 |
| Ultraviolet absorber (UV-1) | 0.57 |
| Dye image stabilizer (Cpd-2) | 0.06 |
| Solvent (Solv-1) | 0.05 |
| Seventh layer (protective layer) | |
| Gelatin | 1.00 |
| Acryl-modified copolymer of polyvinyl alcohol (degree of modification: 17%) | 0.05 |
| Liquid paraffin | 0.02 |
| Surface-active agent (Cpd-3) | 0.01 |

Each of the thus-prepared samples was cut and was subjected to gradation exposure through a three-color separation filter for sensitometry by using a sensitometer (manufactured by Fuji Photo Film Co., Ltd.; FW-type; Color temperature of the light source, 3,200° K).

The samples that had been exposed to light were processed with the processing apparatus shown in FIG. 1A by using the below-shown processing steps and processing solution compositions. In the figure, 10 indicates the processing apparatus, which has a developing tank 12 for carrying out the activator development, a bleach-fix tank 14, a washing tank 16 (consisting of rinsing tanks 16*a*, 16*b*, 16*c*, 16*d*, and 16*e*), a draining section 17, and a drying section 18. 20 indicates the light-sensitive material to be processed by this apparatus. 24 indicates a pair of conveying rollers, 26 indicates a reverse osmosis membrane apparatus provided for the rinsing tanks, 28 indicates a pump, 30 indicates a fan, 32 indicates a slit, and 54 indicates a processing roller. The activator solution is taken from the lower part of the developing tank 12, it is passed by a circulating pump 70 through a cartridge 71 for adsorbing and removing anionic organic substances, and then it is returned to the developing tank 12.

Figure 2A:
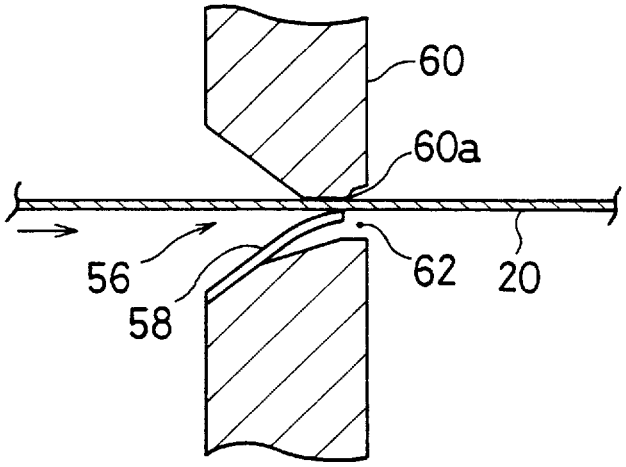
FIG. 2A shows an example wherein one blade is used.
Figure 2B:
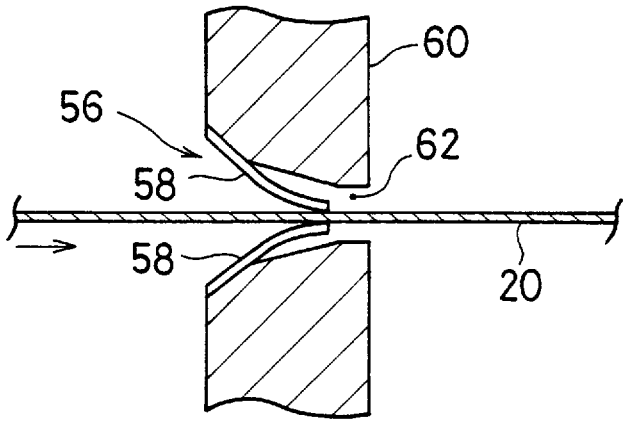
FIG. 2B shows an example wherein a pair of blades is used.

In the processing apparatus 10, each shutter means, which has a blade, seals each section between the rinsing tanks 16*a* and 16*b*, 16*b* and 16*c*, 16*c* and 16*d*, and 16*d* and 16*e*. This is shown in an enlarged crosssection in FIG. 2A and FIG. 2B. In the figures, FIG. 2A shows the case when one blade is provided only on one side, and FIG. 2B shows the case when a pair of blades is provided. In the figures, 58 indicates a blade, 60 indicates a tank wall, and 62 indicates a slit through which the light-sensitive material 20 is passed. 60*a* indicates the tip of the tank wall 60, and 56 indicates the shutter means having such a constitution.

| Processing step | Temperature | Replenishment rate | Time | Tank volume (liter) |
|---|---|---|---|---|
| Activator development | 40° C. | 30 ml | 25 sec | 2.0 |
| Bleach-fix | 40° C. | 30 ml | 15 sec | 2.0 |
| Rinse (1) | 30° C. | — | 3 sec | 0.3 |
| Rinse (2) | 30° C. | — | 3 sec | 0.3 |
| Rinse (3) | 30° C. | — | 3 sec | 0.3 |
| Rinse (4) | 30° C. | — | 3 sec | 0.3 |
| Rinse (5) | 30° C. | 60 ml | 5 sec | 0.3 |

(the replenishment rate was the amount per $m^2$ of the light-sensitive material)
(the rinse was conducted in a 5-tank counter-current system of Rinse (5) to Rinse (1))

In the above processing, the water of the Rinse (4) was pumped to the reverse osmosis membrane, the passed water was supplied to the Rinse (5), and the condensed water that did not pass through the reverse osmosis membrane was returned to the Rinse (4). To shorten the crossover time, each blade was placed between each of two rinsing tanks to pass the light-sensitive material between them.

| (Activator (Developing) Solution) | Tank Solution | Reple-nisher |
|---|---|---|
| Water | 800 ml | 800 ml |
| Tripotassium phosphate | 30 g | 39 g |
| Benzotriazole | 0.01 g | 0.02 g |
| Potassium chloride | 10 g | — |
| Hydroxylethylidene-1,1-diphosphonic acid (30% solution) | 4 ml | 4 ml |
| Water to make 1 liter pH | 12.0 | 12.0 |

As bleach-fix solution, the same tank solution in Example 1 was used.

| (Rinse solution) |
|---|
| Tap water |

Continuous processing was carried out in such a way that a strongly basic ion exchange resin, Daiaion SA-11A (trade name), was packed in a liquid-permeable member in the form of a cartridge, and the cartridge was placed in a circulating section of the activator bath of the apparatus shown in FIG. 1A. In the same way as in Example 1, continuous processing was carried out until the activator solution was replenished in an amount corresponding to the volume of the tank (in this case, the concentration of anionic organic substances was about 1/10 or less of the case in which the continuous processing was carried out without carrying out the adsorption and elimination). In the same way as in Example 1, the evaluation was carried out. The results are shown in Table 2.

TABLE 2

| | Δ Dmin | | | Δ Dmax | | |
|---|---|---|---|---|---|---|
| Adsorbent | B | G | R | B | G | R |
| None | 0.18 | 0.13 | 0.06 | −0.18 | −0.31 | −0.24 |
| Daiaion SA-11A | 0.01 | 0.00 | 0.00 | 0.00 | −0.03 | −0.02 |

As a result, it was found that when the strongly basic anion exchange resin for use in the present invention was placed in the circulating system of the apparatus, to process continuously the activator solution, the fluctuation of the image density after the continuous processing could be remarkably suppressed. On the other hand, in the continuous processing by using the apparatus having no ion-exchange-resin-containing member, a remarkable increase of Dmin, a remarkable decease of Dmax, and softening of gradation took place.

It can be understood that, according to the method of the present invention, even continuous processing could give stabilized constant photographic properties, and the photographic properties were further stabilized particularly when the anion exchange resin for use in the present invention was used.

Figure 1B:
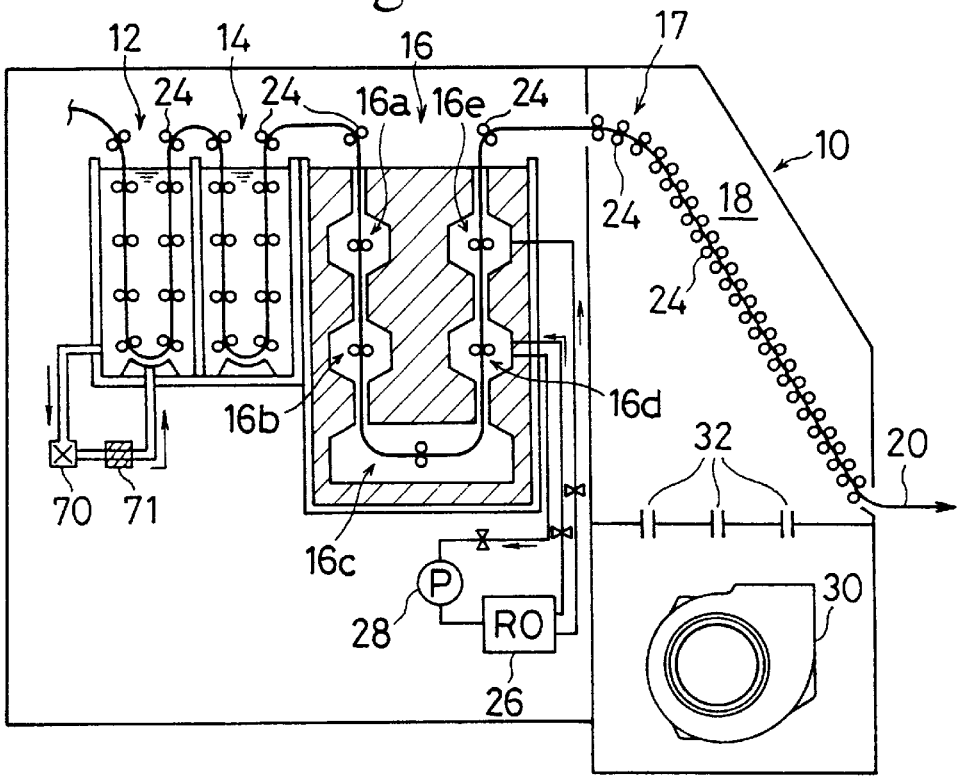
FIG. 1B is a schematic view showing an example wherein said rinsing tanks are vertically arranged.

In place of the apparatus shown in FIG. 1A, an apparatus as shown in FIG. 1B can be used to carry out the activator processing in the same way. The apparatus shown in FIG. 1B is the same as the apparatus shown in FIG. 1A, except that the rinsing tanks 16*a* to 16*e* of the washing tank 16 are arranged vertically. In FIG. 1B, like reference symbols designate like parts as in FIG. 1A.

Example 3

Samples (300), (301), (302), (303), (304), and (305) were prepared in the same manner as in Sample (200) of Example 2, except that, instead of the color-forming reducing agent in the blue-sensitive layer (BL), color-forming reducing agents (I-27), (I-29), (I-31), (I-39), (I-40), and (I-67) were used, respectively, in the same molar amount. In Sample (305), wherein (I-67) was used, instead of EXY-2 as a dye-forming coupler, a four-equivalent coupler, wherein the coupling split-off group is a hydrogen atom, was used. The same processing and the same evaluation as in Example 2 were carried out. The results in BL are shown in Table 3.

TABLE 3

| | Color-forming | BL | | BL | |
|---|---|---|---|---|---|
| Sample | reducing agent | Dmax | Δ Dmax | Dmin | Δ Dmin |
| 300 | I-27 | 2.10 | 0.00 | 0.13 | 0.01 |
| 301 | I-29 | 2.07 | 0.00 | 0.12 | 0.01 |
| 302 | I-31 | 2.12 | 0.00 | 0.13 | 0.01 |
| 303 | I-39 | 2.07 | −0.02 | 0.13 | 0.02 |

TABLE 3-continued

| Sample | Color-forming reducing agent | BL Dmax | BL Δ Dmax | BL Dmin | BL Δ Dmin |
|---|---|---|---|---|---|
| 304 | I-40 | 2.06 | −0.03 | 0.13 | 0.02 |
| 305 | I-67 | 2.00 | −0.08 | 0.12 | 0.04 |

As a result, it can be understood that, similarly to the results of Example 2, according to the present invention, continuous processing of the activator gave stabilized photographic properties.

Example 4

Sample (601) was prepared in the same manner as in Sample (100) of Example 1, except that the coating amounts of silver in the first layer, the third layer, and the fifth layer were 0.01 g, 0.01 g, and 0.015 g, respectively, per $m^2$.

After this sample was exposed to light in the same manner as in Example 1, and the sample was processed in the same manner as in Example 1, except that an intensifier of a 0.3% aqueous hydrogen peroxide solution having a pH of 12.0, prepared by adding hydrogen peroxide to the activator solution of Example 1, was used. Thus, although a light-sensitive material whose amount of silver was considerably lowered was used, an image high in maximum density as in Example 1 was obtained. Also by continuous processing, a sharp image less fluctuated in Dmax, Dmin, and gradation was obtained.

It was understood that the method for forming an image of the present invention was preferable to form an image amplified by intensifying a low-silver light-sensitive material.

Example 5

Sample (200) of Example 2 was processed and evaluated in the same manner as in Example 2, except that the following exposure to light was carried out:

(Exposure to light)

Light having a wavelength of 473 nm, taken out by wavelength conversion of a YAG solid laser (oscillation wavelength, 946 nm) by an SHG crystal of $KNbO_3$, using, as a light source, a semiconductor laser GaAlAs (oscillation wavelength, 808.5 nm) serving as an excitation light source; light having a wavelength of 532 nm, taken out by wavelength conversion of a $YVO_4$ solid laser (oscillation wavelength, 1064 nm) by an SHG crystal of KTP, using, as a light source, a semiconductor laser GaAlAs (oscillation wavelength: 808.7 nm) serving as an excitation light source; and light from AlGaInP (oscillation wavelength, about 670 nm; Type No. TOLD 9211, manufactured by Toshiba Corporation) were used. The laser beams of the apparatus could be scanned successively by a rotating polyhedron over a color print paper moved vertically to the scanning direction for exposure to light. Using this apparatus, the amount of light was varied, to find the relationship D-log E between the density (D) of the light-sensitive material and the amount of light (E). At that time, with respect to the laser beams having three wavelengths, the amounts of the lights were modulated using an external modulator, to control the exposure amounts. In this scanning exposure, the density of the picture element was 400 dpi, and the average exposure time per picture element was about $5\times10^{-8}$ sec. The temperature of the semiconductor lasers was kept constant by using Peltier elements to suppress the fluctuation of the amounts of lights due to the temperature.

As a result, even in the case of the image formed by high-illumination digital exposure, an image having high maximum density could be obtained, and a sharp image, with the Dmax, Dmin, and gradation less fluctuated, could be obtained, even by continuous processing.

Having described our invention as related to the present embodiments, it is our intention that the invention not be limited by any of the details of the description, unless otherwise specified, but rather be construed broadly within its spirit and scope as set out in the accompanying claims.

What I claim is:

1. A method for forming a color image comprising the steps of exposing a silver halide light-sensitive material that comprises at least one light-sensitive silver halide emulsion layer on a base, to light, and then development-processing the said silver halide light-sensitive material, to form a color image, wherein the step of development-processing the said silver halide light-sensitive material that contains at least one dye-forming coupler, and at least one color-forming reducing agent represented by formula (D-1), and an auxiliary developing agent and/or its precursor, with an alkaline activator solution substantially free from any color-developing agent, comprises the step of adsorbing anionic organic substances dissolved out into the said activator solution, to remove the substances: formula (D-1)

$$(L)_n—D$$

wherein, in formula (D-1), L represents an electron-attracting group capable of coupling split-off during the development processing, D represents a compound residue formed by removing n hydrogen atoms from a compound HnD having a development activity, and n is an integer of 1 to 3.

2. The method for forming a color image as claimed in claim 1, wherein a content of the color-developing agent in the said alkaline activator solution is 0.5 mmol/l or less.

3. The method for forming a color image as claimed in claim 1, wherein the said alkaline activator solution has a pH value of 9 to 14.

4. The method for forming a color image as claimed in claim 1, wherein the said alkaline activator solution is substantially free from any auxiliary developing agent.

5. The method for forming a color image as claimed in claim 1, wherein the color-forming reducing agent represented by formula (D-1) is represented by formula (D-2):

$$L^1L^2N—(NH)_p—(X{=}Y)_q—Z \qquad \text{formula (D-2)}$$

wherein, in formula (D-2), $L^1$ and $L^2$ each represent a hydrogen atom or a monovalent electron-attracting group capable of coupling split-off during the color-development processing, with the proviso that $L^1$ and $L^2$ are not hydrogen atoms respectively simultaneously; X and Y each independently represent methine or azomethine; Z represents a hydrogen atom, a hydroxyl group, an amino group, or —$NHL^3$, in which $L^3$ represents an electron attracting group; p is an integer of 0 or 1, q is an integer of 1 to 3, and any two of $L^1$, $L^2$, X, Y, and Z may bond together to form a ring.

6. The method for forming a color image as claimed in claim 5, wherein the color-forming reducing agent represented by formula (D-2) is represented by one of formulae (D-3) to (D-10):

$$R^1SO_2NH—\phi^1—NR^2R^3 \qquad \text{Formula (D-3)}$$

$$R^4SO_2NH—\phi^2—OH \qquad \text{Formula (D-4)}$$

$R^5CONH—\phi^3—NR^6R^7$ Formula (D-5)

$R^8CONH—\phi^4—OH$ Formula (D-6)

$R^9SO_2NHNHR^{10}$ Formula (D-7)

$R^{11}CONHNHR^{12}$ Formula (D-8)

$R^{13}SO_2NHN=\phi^5$ Formula (D-9)

$R^{14}CONHNH=\phi^6$ Formula (D-10)

wherein, in formulas (D-3) to (D-10), $R^2$, $R^3$, $R^6$, and $R^7$ each represent an alkyl group, an aryl group, or a heterocyclic group; $R^{10}$ and $R^{12}$ each represent an aryl group or a heteroaryl group; $R^1$, $R^4$, $R^5$, $R^8$, $R^9$, $R^{11}$, $R^{13}$, and $R^{14}$ each represent a hydrogen atom, an alkyl group, an aryl group, a heterocyclic group, an alkoxy group, an aryloxy group, or an amino group; $\phi^1$, $\phi^2$, $\phi^3$, and $\phi^4$ each represent an arylene group or a heteroarylene group; and $\phi^5$ and $\phi^6$ each represent a heterocyclic group or hydrocarbon ring group bonded to the nitrogen atom through a double bond.

7. The method for forming a color image as claimed in claim 1, wherein the at least one dye-forming coupler and the at least one color-forming reducing agent are contained in the same silver halide emulsion layer of the said silver halide light-sensitive material.

8. The method for forming a color image as claimed in claim 1, wherein the auxiliary developing agent is selected from the group consisting of pyrazolidones, dihydroxybenzenes, reductones, and aminophenoles.

9. The method for forming a color image as claimed in claim 1, wherein the said auxiliary developing agent and/or its precursor are contained in a non-light-sensitive layer of the said silver halide light-sensitive material.

10. The method for forming a color image as claimed in claim 1, wherein a concentration of the said anionic organic substances in the alkaline activator solution after subjected to the said adsorption removing step is 1 mmol/l or less.

11. The method for forming a color image as claimed in claim 1, wherein the color-forming reducing agent represented by formula (D-1) is a compound represented by formula (I):

$R^{11}—NHNH—X—R^{12}$ formula (I)

wherein, in formula (I), $R^{11}$ represents an aryl group or a heterocyclic group, $R^{12}$ represents an alkyl group, an alkenyl group, an alkynyl group, an aryl group, or a heterocyclic group, and X represents $—SO_2—$, —CO—, —COCO—, —CO—O—, —CO—$N(R^{13})$—, —COCO—O—, —COCO—N—$(R^{13})$—, or $—SO_2—N(R^{13})$—, in which $R^{13}$ represents a hydrogen atom or a group represented by $R^{12}$ that is defined above.

12. The method for forming a color image as claimed in claim 11, wherein the color-forming reducing agent represented by formula (I) is represented by formula (II) or formula (III):

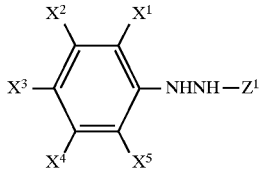

formula (II)

$R^3—NHNH—Z^2$ formula (III)

wherein, in formulae (II) and (III), $Z^1$ represents an acyl group, a carbamoyl group, an alkoxycarbonyl group, or an aryloxycarbonyl group; $Z^2$ represents a carbamoyl group, an alkoxycarbonyl group, or an aryloxycarbonyl group; $X^1$, $X^2$, $X^3$, $X^4$, and $X^5$ each represent a hydrogen atom or a substituent, provided that the sum of the Hammett substituent constant σp values of $X^1$, $X^3$, and $X^5$ and the Hammett substituent constant σm values of $X^2$ and $X^4$ is 0.80 or more but 3.80 or below; and $R^3$ represents a heterocyclic group.

13. The method for forming a color image as claimed in claim 12, wherein the color-forming reducing agent represented by formula (II) or formula (III) is represented by formula (IV) or formula (V), respectively.

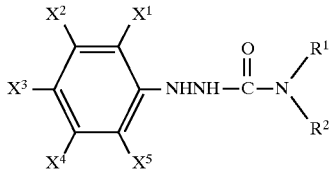

formula (IV)

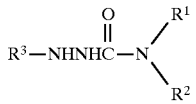

formula (V)

wherein, in formulae (IV) and (V), $R^1$ and $R^2$ each represent a hydrogen atom or a substituent; $X^1$, $X^2$, $X^3$, $X^4$, and $X^5$ each represent a hydrogen atom or a substituent, provided that the sum of the Hammett substituent constant σp values of $X^1$, $X^3$, and $X^5$ and the Hammett substituent constant σm values of $X^2$ and $X^4$ is 0.80 or more but 3.80 or below; and $R^3$ represents a heterocyclic group.

14. The method for forming a color image as claimed in claim 13, wherein the color-forming reducing agent represented by formula (IV) or formula (V) is represented by formula (VI) or formula (VII), respectively.

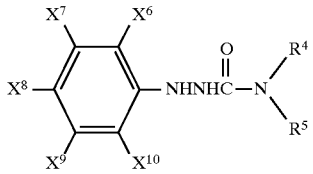

formula (VI)

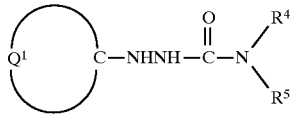

formula (VII)

wherein, in formulae (VI) and (VII), $R^4$ and $R^5$ each represent a hydrogen atom or a substituent; $X^6$, $X^7$, $X^8$, $X^9$, and $X^{10}$ each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, provided that the sum of the Hammett substituent constant σp values of $X^6$, $X^8$, and $x^{10}$ and the Hammett substituent constant σm values of $X^7$ and $X^9$ is 1.20 or more but 3.80 or below; and $Q^1$ represents a group of nonmetal atoms required to form, together with the C, a nitrogen-containing 5-membered to 8-membered heterocyclic ring.

15. The method for forming a color image as claimed in claim 1, wherein the said step of adsorbing anionic organic substances to remove is carried out using an anion exchange resin or an anion exchange membrane.

16. The method for forming a color image as claimed in claim 1, wherein the said step of adsorbing anionic organic substances to remove is carried out using an adsorbent.

17. The method for forming a color-image as claimed in claim 16, wherein the adsorbent is activated carbon, activated carbon fiber, silica gel, activated alumina, or activated clay.

18. The method for forming a color image as claimed in claim 1, wherein the exposure to light is carried out by scanning exposure with the exposure time being $10^{-8}$ to $10^{-4}$ sec per picture element.

19. The method for forming a color image as claimed in claim 1, wherein the activator solution in which the anionic organic substances are adsorbed and removed, is circulated and returned to be used.

* * * * *